US011472622B2

(12) United States Patent
Bazbaz et al.

(10) Patent No.: US 11,472,622 B2
(45) Date of Patent: Oct. 18, 2022

(54) WOVEN PLASTIC BAGS WITH FEATURES THAT REDUCE LEAKAGE, BREAKAGE, AND INFESTATIONS

(71) Applicant: POLYTEX FIBERS CORPORATION, Houston, TX (US)

(72) Inventors: Jacobo Bazbaz, Bellaire, TX (US); Alberto Zaroli, Katy, TX (US)

(73) Assignee: Polytex Fibers LLC, Houston, TX (US)

( * ) Notice: Subject to any disclaimer, the term of this patent is extended or adjusted under 35 U.S.C. 154(b) by 0 days.

(21) Appl. No.: 17/077,725

(22) Filed: Oct. 22, 2020

(65) Prior Publication Data

US 2021/0039864 A1 Feb. 11, 2021

Related U.S. Application Data

(63) Continuation-in-part of application No. 16/930,975, filed on Jul. 16, 2020, which is a continuation of (Continued)

(51) Int. Cl.
*B65D 77/38* (2006.01)
*B65D 30/08* (2006.01)
(Continued)

(52) U.S. Cl.
CPC ..... *B65D 77/38* (2013.01); *B65D 31/02* (2013.01); *B65D 31/10* (2013.01); *B65D 33/00* (2013.01); *B65D 33/02* (2013.01); *B65D 33/16* (2013.01)

(58) Field of Classification Search
CPC ..... B65D 77/38; B65D 31/02; B65D 31/10; B65D 33/00; B65D 33/02; B65D 33/16
See application file for complete search history.

(56) References Cited

U.S. PATENT DOCUMENTS 258,925 A 6/1882 Holmes
2,634,896 A 4/1953 Graveno
(Continued)

FOREIGN PATENT DOCUMENTS

CA 2269652 4/2000
EP 1035028 9/2000
(Continued)

OTHER PUBLICATIONS

U.S. Appl. No. 16/930,975 , Non-Final Office Action, dated Jan. 14, 2022, 14 pages.
(Continued)

*Primary Examiner* — Derek J Battisti
(74) *Attorney, Agent, or Firm* — Kilpatrick Townsend & Stockton LLP

(57) ABSTRACT

A woven laminated plastic bag having features that further prevent leakage of contents out of the bag, or infestation of organisms into the contents of the bag is provided. In various aspects the bag can be fabricated from woven polypropylene and/or polyethylene layer which can be laminated with a film layer, can form a pinch bottom bag, and can have one or both sides include graphics and/or printing. The bag can also provide a top end and/or a bottom end either or both of which provide a discrete area which may contain discrete graphics and/or printing.

31 Claims, 35 Drawing Sheets

Related U.S. Application Data application No. 15/440,970, filed on Feb. 23, 2017, now Pat. No. 10,759,585, which is a continuation of application No. 14/678,641, filed on Apr. 3, 2015, now Pat. No. 9,669,983.

(60) Provisional application No. 61/975,689, filed on Apr. 4, 2014.

(51) Int. Cl.

| | |
|---|---|
| ***B65D 33/16*** | (2006.01) |
| ***B65D 33/02*** | (2006.01) |
| ***B65D 33/00*** | (2006.01) |
| ***B65D 30/20*** | (2006.01) |

(56) References Cited

U.S. PATENT DOCUMENTS

| | | | |
|---|---|---|---|
| 2,991,000 | A | 7/1961 | Spees |
| 3,058,647 | A | 10/1962 | Reiselt |
| 3,203,620 | A | 8/1965 | Becker |
| 3,285,498 | A | 11/1966 | Becker, III |
| 3,508,701 | A | 4/1970 | Saito et al. |
| 3,565,328 | A | 2/1971 | Hudson |
| 3,648,922 | A | 3/1972 | Gebo |
| 3,650,460 | A | 3/1972 | Lokey |
| 3,685,720 | A | 8/1972 | Brady |
| 3,687,356 | A | 8/1972 | Goodrich et al. |
| 3,990,626 | A | 11/1976 | Goodrich |
| 4,008,850 | A | 2/1977 | Goodrich |
| 4,142,667 | A | 3/1979 | Runo |
| 4,292,332 | A | 9/1981 | Mcham |
| 4,373,979 | A | 2/1983 | Planeta |
| 4,441,613 | A | 4/1984 | Hain et al. |
| 4,460,091 | A | 7/1984 | Hain et al. |
| 4,480,752 | A | 11/1984 | Jacobs |
| 4,512,479 | A | 4/1985 | Hain et al. |
| 4,515,273 | A | 5/1985 | Jacobson et al. |
| 4,557,385 | A | 12/1985 | Robinson |
| 4,567,987 | A | 2/1986 | Lepisto et al. |
| 4,610,651 | A | 9/1986 | Jacobson et al. |
| 4,768,654 | A | 9/1988 | Jacobs |
| 4,785,940 | A | 11/1988 | Wilson |
| 4,811,849 | A | 3/1989 | Pausing |
| 4,836,378 | A | 6/1989 | Lephardt |
| 4,955,981 | A | 9/1990 | Provost |
| 5,048,692 | A | 9/1991 | Handler et al. |
| 5,188,235 | A | 2/1993 | Pierce et al. |
| 5,217,307 | A | 6/1993 | McClintock |
| 5,551,781 | A | 9/1996 | Wilkes et al. |
| 5,558,438 | A | 9/1996 | Warr |
| 5,655,843 | A | 8/1997 | Conrad et al. |
| 5,830,543 | A | 11/1998 | Miyake et al. |
| 5,836,697 | A | 11/1998 | Chiesa |
| 5,855,435 | A | 1/1999 | Chiesa |
| 5,902,047 | A | 5/1999 | Yeager |
| 5,908,246 | A | 6/1999 | Arimura et al. |
| 5,938,013 | A | 8/1999 | Palumbo et al. |
| 5,979,655 | A | 11/1999 | Tseng et al. |
| 6,013,018 | A | 1/2000 | Bannister |
| 6,047,883 | A | 4/2000 | Calvert et al. |
| 6,074,095 | A | 6/2000 | Bannister et al. |
| 6,126,316 | A | 10/2000 | Bannister |
| 6,126,317 | A | 10/2000 | Anderson et al. |
| 6,224,262 | B1 | 5/2001 | Hogan et al. |
| 6,241,390 | B1 | 6/2001 | Schneck |
| 6,315,448 | B1 | 11/2001 | Thrall |
| 6,328,472 | B1 | 12/2001 | Laurence et al. |
| 6,334,711 | B1 | 1/2002 | Risgalla et al. |
| 6,367,976 | B1 | 4/2002 | Bannister |
| 6,478,465 | B1 | 11/2002 | Thrall |
| 6,609,999 | B2 | 8/2003 | Albright |
| 6,635,711 | B1 | 10/2003 | Miskovic et al. |
| 6,698,928 | B2 | 3/2004 | Miller |
| 6,800,051 | B2 | 10/2004 | Koehn |
| 6,966,134 | B2 | 11/2005 | Ngan |
| 6,979,482 | B2 | 12/2005 | Hartzell et al. |
| 7,090,904 | B2 | 8/2006 | Hartzell et al. |
| 7,165,887 | B2 | 1/2007 | Strand et al. |
| 7,237,953 | B2 | 7/2007 | Healy et al. |
| 7,311,442 | B1 | 12/2007 | Moravek |
| 7,523,825 | B2 | 4/2009 | Velazquez et al. |
| 7,563,027 | B2 | 7/2009 | Allen et al. |
| 7,722,255 | B2 | 5/2010 | Tessera Chiesa |
| 7,731,425 | B2 | 6/2010 | Lin et al. |
| 7,753,588 | B2 | 7/2010 | Bazbaz |
| 8,173,233 | B2 | 5/2012 | Rogers et al. |
| 8,221,062 | B2 | 7/2012 | Liotta et al. |
| 8,240,915 | B2 | 8/2012 | Sargin et al. |
| 8,241,193 | B2 | 8/2012 | Jansen |
| 8,241,194 | B2 | 8/2012 | Skopek et al. |
| 8,297,840 | B2 | 10/2012 | Jansen |
| 8,443,578 | B2 | 5/2013 | Sargin et al. |
| 8,475,046 | B2 | 7/2013 | Jansen |
| 8,535,209 | B2 | 9/2013 | Sargin |
| 8,540,427 | B2 | 9/2013 | Steele |
| 8,613,547 | B2 | 12/2013 | Steele |
| 9,073,281 | B2 | 7/2015 | Sargin |
| 9,233,502 | B2 | 1/2016 | Sargin et al. |
| 9,669,983 | B2 | 6/2017 | Bazbaz et al. |
| 9,809,354 | B2 | 11/2017 | Brauer et al. |
| 9,926,107 | B2 | 3/2018 | Koesters et al. |
| 10,183,796 | B2 | 1/2019 | Kruse et al. |
| 10,569,933 | B2 | 2/2020 | Koesters |
| 10,759,585 | B2 | 9/2020 | Bazbaz et al. |
| 10,766,667 | B2 | 9/2020 | Bazbaz |
| 10,822,140 | B2 | 11/2020 | Koesters |
| 2003/0040411 | A1 | 2/2003 | Albright |
| 2003/0139516 | A1 | 7/2003 | Quinn et al. |
| 2003/0152299 | A1 | 8/2003 | Culbertson et al. |
| 2003/0228077 | A1 | 12/2003 | Laske |
| 2004/0091648 | A1 | 5/2004 | Hartzell et al. |
| 2005/0087542 | A1 | 4/2005 | Bazbaz |
| 2005/0226542 | A1 | 10/2005 | Kendall et al. |
| 2006/0045392 | A1 | 3/2006 | Bannister et al. |
| 2006/0072856 | A1 | 4/2006 | Su et al. |
| 2006/0285777 | A1 | 12/2006 | Howell et al. |
| 2006/0285781 | A1 | 12/2006 | Zoss |
| 2007/0047852 | A1 | 3/2007 | Sharp et al. |
| 2007/0047853 | A1 | 3/2007 | Sharp et al. |
| 2007/0104905 | A1 | 5/2007 | Floyd, Jr. |
| 2007/0140600 | A1 | 6/2007 | Nowak et al. |
| 2007/0292053 | A1 | 12/2007 | Lin et al. |
| 2008/0047228 | A1 | 2/2008 | Anzini et al. |
| 2008/0187695 | A1 | 8/2008 | Nowak et al. |
| 2008/0292223 | A1 | 11/2008 | Bannister |
| 2009/0080813 | A1 | 3/2009 | Rasmussen et al. |
| 2009/0136161 | A1 | 5/2009 | Hickey |
| 2009/0148081 | A1* | 6/2009 | Rogers ..... B65D 33/24 383/203 |
| 2009/0159192 | A1* | 6/2009 | Bannister ..... A45C 3/001 156/250 |
| 2009/0263048 | A1 | 10/2009 | Iannelli, II et al. |
| 2009/0324143 | A1 | 12/2009 | Sharp et al. |
| 2010/0029455 | A1 | 2/2010 | Skopek et al. |
| 2010/0154362 | A1 | 6/2010 | Jansen |
| 2010/0158417 | A1 | 6/2010 | Sharp et al. |
| 2010/0158418 | A1 | 6/2010 | Jansen |
| 2010/0189380 | A1 | 7/2010 | Sargin et al. |
| 2010/0209026 | A1 | 8/2010 | Koenigkramer |
| 2010/0266223 | A1 | 10/2010 | Lin et al. |
| 2010/0270309 | A1 | 10/2010 | Files et al. |
| 2010/0278454 | A1 | 11/2010 | Huffer |
| 2010/0293897 | A1 | 11/2010 | Jansen |
| 2011/0002560 | A1 | 1/2011 | Robles et al. |
| 2011/0019944 | A1 | 1/2011 | Sargin |
| 2011/0038569 | A1 | 2/2011 | Huffer et al. |
| 2011/0082019 | A1 | 4/2011 | Bannister |
| 2011/0103721 | A1 | 5/2011 | Sargin et al. |
| 2011/0147383 | A1 | 6/2011 | Soudais et al. |
| 2011/0255807 | A1 | 10/2011 | Shapiro et al. |
| 2011/0263400 | A1 | 10/2011 | Sargin |
| 2012/0314979 | A1 | 12/2012 | Heininga |
| 2012/0321229 | A1 | 12/2012 | Surdziel et al. |

(56) References Cited

U.S. PATENT DOCUMENTS

| | | | |
|---|---|---|---|
| 2013/0016926 | A1 | 1/2013 | Koehn et al. |
| 2013/0047555 | A1 | 2/2013 | Jansen |
| 2013/0206631 | A1 | 8/2013 | Bazbaz |
| 2013/0209002 | A1 | 8/2013 | Bazbaz |
| 2013/0330028 | A1 | 12/2013 | Bannister et al. |
| 2014/0090339 | A1 | 4/2014 | Sargin |
| 2015/0183194 | A1 | 7/2015 | Lehmann et al. |
| 2020/0148423 | A1 | 5/2020 | Koesters |
| 2020/0189248 | A1 | 6/2020 | Koesters et al. |
| 2020/0239215 | A1 | 7/2020 | Bazbaz et al. |
| 2020/0307171 | A1 | 10/2020 | Koesters |
| 2020/0377262 | A1 | 12/2020 | Bazbaz |
| 2021/0047096 | A1 | 2/2021 | Obermann et al. |

FOREIGN PATENT DOCUMENTS

| | | | |
|---|---|---|---|
| EP | 1468931 | | 10/2004 |
| EP | 1780136 | | 5/2007 |
| EP | 2263949 | | 12/2010 |
| EP | 2599617 | | 6/2013 |
| EP | 2987744 | B1 | 7/2017 |
| WO | 9961344 | | 12/1999 |
| WO | 2005030600 | | 4/2005 |
| WO | 2008146142 | | 12/2008 |
| WO | 2008157681 | | 12/2008 |
| WO | 2009016644 | | 2/2009 |
| WO | 2009082712 | | 7/2009 |
| WO | 2012040097 | | 3/2012 |
| WO | 2012141981 | | 10/2012 |
| WO | 2013123015 | | 8/2013 |
| WO | 2015103103 | | 7/2015 |
| WO | 2015154014 | A1 | 10/2015 |

OTHER PUBLICATIONS

U.S. Appl. No. 14/678,641, Advisory Action dated Sep. 1, 2016, 2 pages.
U.S. Appl. No. 14/678,641, Final Office Action dated Jun. 3, 2016, 15 pages.
U.S. Appl. No. 14/678,641, Non-Final Office Action dated Nov. 25, 2015, 12 pages.
U.S. Appl. No. 14/678,641, Notice of Allowability dated Apr. 20, 2017, 2 pages.
U.S. Appl. No. 14/678,641, Notice of Allowance dated Feb. 3, 2017, 8 pages.
U.S. Appl. No. 15/440,970, Advisory Action dated Jun. 4, 2019, 2 pages.
U.S. Appl. No. 15/440,970, Corrected Notice of Allowability dated Jul. 30, 2020, 2 pages.
U.S. Appl. No. 15/440,970, Final Office Action dated Mar. 15, 2019, 11 pages.
U.S. Appl. No. 15/440,970, Non-Final Office Action dated Oct. 25, 2019, 10 pages.
U.S. Appl. No. 15/440,970, Non-Final Office Action dated Sep. 10, 2018, 9 pages.
U.S. Appl. No. 15/440,970, Notice of Allowance dated Apr. 27, 2020, 5 pages.
U.S. Appl. No. 15/495,772, Notice of Allowance dated Jun. 26, 2020, 9 pages.
European Application No. EP17199258.9, Office Action dated Aug. 3, 2020, 4 pages.
Mexican Application No. MX/A/2016/013051 Office Action dated Aug. 4, 2020, 4 pages.
Application No. MX/A/2016/013051 , Office Action, dated Dec. 15, 2020, 5 pages.
Mexican Application No. MX/A/2016/013051 , Notice of Allowance, dated Jul. 16, 2021, 2 pages.
Canadian Application No. 2,944,904, Office Action dated May 12, 2021, 5 pages.
European Application No. 20207311.0, European Search Report dated May 11, 2021, 9 pages.
U.S. Appl. No. 16/930,975, Final Office Action, dated May 17, 2022, 13 pages.

* cited by examiner

FIG. 13A
FIG. 13B
FIG. 13C
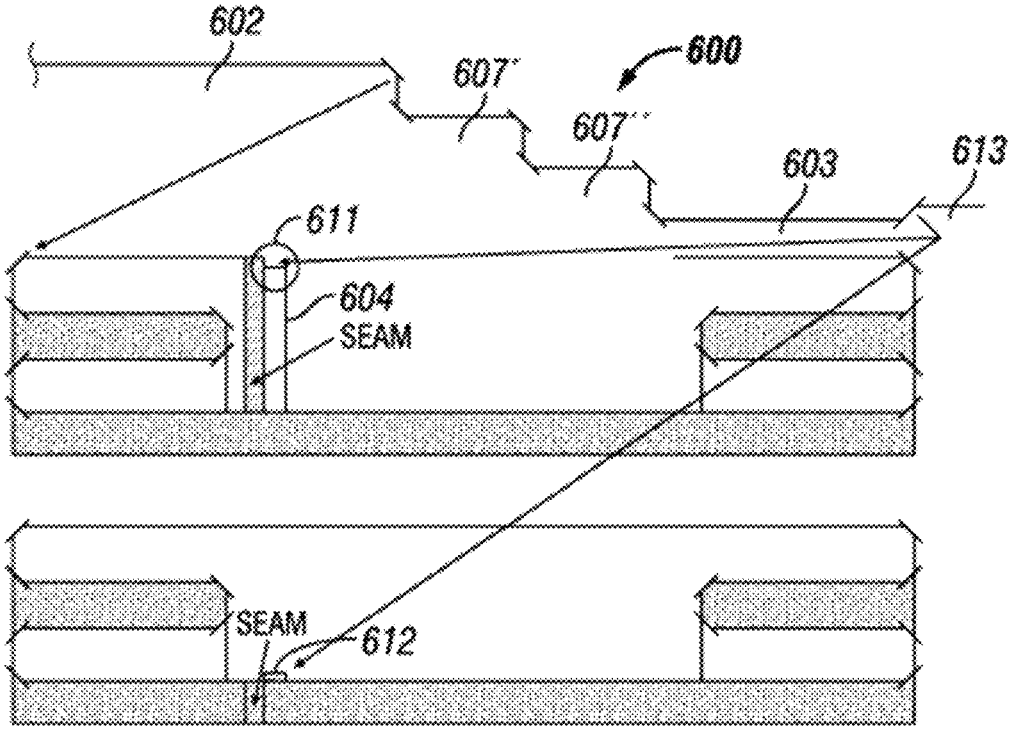
FIG. 14A
FIG. 14B
FIG. 14C
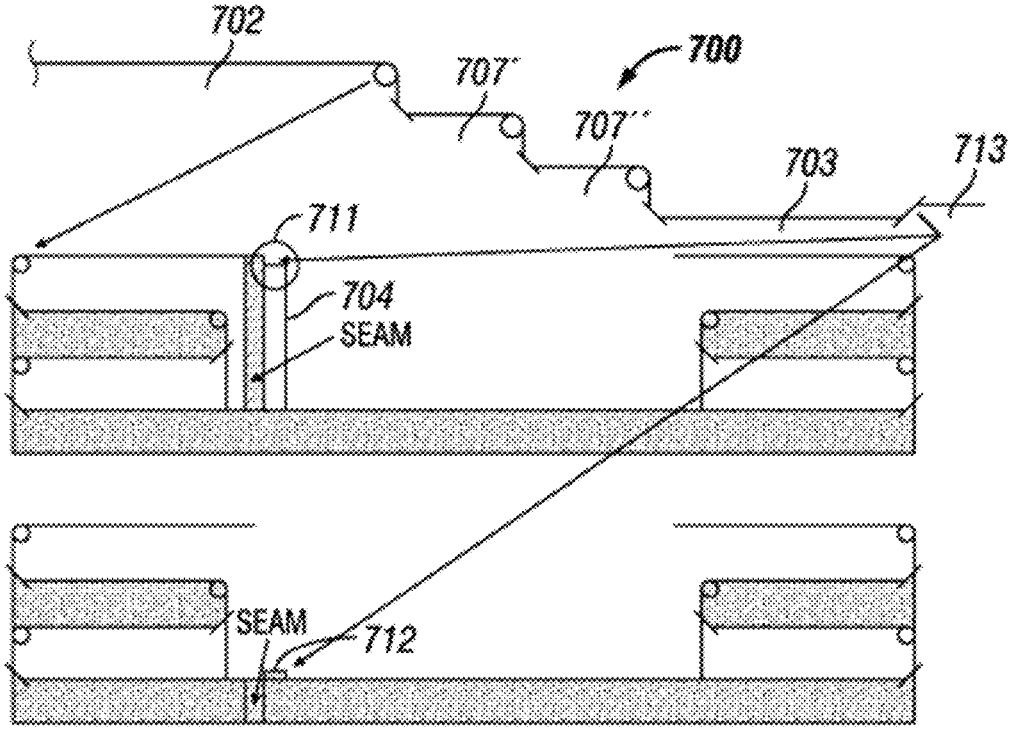

WOVEN PLASTIC BAGS WITH FEATURES THAT REDUCE LEAKAGE, BREAKAGE, AND INFESTATIONS

CROSS-REFERENCES TO RELATED APPLICATIONS

This application is a continuation-in-part and claims benefit of priority of co-pending U.S. patent application Ser. No. 16/930,975, filed on Jul. 16, 2020, which is in turn a continuation and claims benefit of priority of U.S. patent application Ser. No. 15/440,970, filed on Feb. 23, 2017, which is turn is a continuation and claims benefit of priority of U.S. patent application Ser. No. 14/678,641, filed Apr. 3, 2015, which claims benefit of priority of U.S. Provisional Application Ser. No. 61/975,689, filed Apr. 4, 2014, all of which are incorporated by reference herein in their entirety for all purposes.

FIELD OF THE INVENTION

The present disclosure generally relates to woven plastic bags, and more particularly to woven plastic bags with features that reduce the potential for leakage, breakage and infestation.

BACKGROUND

Conventional plastic bags of a wide variety of size and shape are used in various situations. Bulk materials, such as flour, sugar, rice, seed, animal feed, chemicals, powdered materials or the like, for example, typically have been packaged in woven plastic bags in the past. Pet food, bird seed and other products sold in retail stores typically have not been packaged in conventional woven plastic bags. Among other reasons for this, woven plastic bags were considered too rudimentary to be printed with high end graphics suitable for consumer type of packaging. In addition, the high speed requirements in the filling and packaging operations limited the use of the woven bags in these applications.

Laminated woven sacks (LWS) were developed using a woven polypropylene structure laminated to a bi-oriented polypropylene film (BOPP) that can be reverse printed with high end graphics suitable for consumer type of packaging. The LWS provides a stronger, more attractive bag than the more conventional multiwall bags used for that purpose over the last 20 years. Due to their tough strong structure, conventional LWS bags are typically sewn shut on both ends. These LWS recently met with success and have been successfully substituted for the conventional multiwall paper bags used in the pet food industry for many years.

One major drawback of the sewn LWS has been the closing of the bags at high speed filling lines, such as those for filling such bags with pet food. Experience has shown that sewing production lines are typically slower than the filling of the multiwall pinch bottom bags. Additionally, the sewn bags do not provide an aesthetically pleasing and useful clean display on the ends of the bags, thus making it difficult for consumers to identify or find a desired brand quickly when the bags are displayed on the shelves at the point of sale, such as when they are stacked on top of one another. In addition, the sewn ends required puncturing the plastic bags and thus result in a bag that is not sealed, leading to somewhat reduced shelf-life and possible infestation of the contents of the bag.

Woven plastic bags have been used and are conventional for certain applications. An example of a conventional woven plastic bag is provided in U.S. Pat. No. 4,373,979 ("the '979 patent"), issued on Feb. 15, 1983. The '979 patent describes the use of woven strips of highly longitudinally-oriented, high-density polyethylene or polypropylene in a bag construction in which the bag is formed from a seamed tube made of the woven plastic material. The seamed tube has gussets on either side and, when a portion is cut from the rest of the tube, a bag having two open, unsealed ends is provided. The '979 patent describes the use of ultrasonic spot welds to seal portions of a bag made of such woven plastic strips, as opposed to sewing the seams of a bag or using a hot melt adhesive to seal the gusset forming pleat. The '979 patent is hereby incorporated by reference herein. The '979 patent purports to be an improvement for sealing a plastic bag. As noted in the '979 patent, sewing one end tends to take longer, thus adding time to the manufacturing process. In addition, the sewn ends in a conventional bag tend to be a weak portion of the bag, and a likely location for rips, tearing, and subsequent loss of contents during storing, shipping and handling. In addition, such bags may not provide sufficient protection from infestation from vermin and/or insects.

Another example of plastic bags is disclosed in U.S. Patent Application Publication Number US 2010/0029455 A1 ("the '455 publication"), published on Feb. 4, 2010, which describes production of web sections from a flexible web material that is provided with tear-off lines produced by laser beam processing at the distance of the length of the web sections to be formed. The tear-off lines weaken the flexible web material, but do not result in complete separation of the web sections from the web material, which occurs upon tearing the flexible web material. The '455 publication is incorporated by reference herein.

More recently, some types of plastic bags have provided improvements in sealing the ends of the bags. For example, in U.S. Pat. No. 6,800,051 B2 ("the '051 patent"), issued on Oct. 5, 2004, a process for sealing side fold sacks made of plastic film is described. According to the '051 patent, a web of plastic tubular film is cut to provide a staggered detachment along a perforation so that one wall (e.g., the front wall) projects beyond the opposing wall (e.g., the back wall). The projecting portion of the first wall is then folded over and sealed to the opposing wall by means of a plastic adhesive such as a polyurethane adhesive or hot melt. The '051 patent is hereby incorporated by reference herein. However, such bags involve plastic films, not woven plastic materials, and therefore are unable to handle the weight loads of conventional bulk bags made of paper and other materials. Such bags are useful for only certain lightweight contents, such as bread.

There are a variety of conventional ways of providing for reusable openings in bags. For example, U.S. Pat. No. 6,478,465 B1 ("the '465 patent"), issued Nov. 12, 2002, describes a peelable opening in a multiwall, pinched bottom open mouth bag construction. The '465 patent also describes the use of an adhesive layer that can be used so that the bag opening is reclosable. The '465 patent is hereby incorporated by reference herein.

In other types of conventional plastic bags, such as those used in retail and grocery stores, the use of weakened portion provided by one or more perforations in the plastic bag wall is known. A number of approaches have been taken in connection with such bags, including those shown in U.S. Pat. No. 5,188,235 (the '235 patent), issued Feb. 23, 1993, as well as in U.S. Published Patent Application No. 2005/

0087542 A1 (the '542 application), published Apr. 28, 2005, U.S. Pat. No. 5,979,655 (the '655 patent), issued Nov. 9, 1999, and U.S. Published Patent Application No. 2006/0072856 (the '856 application), issued Apr. 6, 2006. However, none of these bags are woven bags, let alone bags with multiple layers. The '235 patent, the '655 patent, the '542 application, and the '856 application are hereby incorporated by reference.

Newly developed pinch laminated woven sacks overcome these drawbacks in the filling and closing operations while allowing an attractive graphic display of the bags' ends at the retail outlet and also providing a strong, durable bag which remains sealed. However, such bags still remain susceptible to leakage, breakage and infestation at both ends of the seam and in the area along the top and bottom of the gussets. There is a need for such a pinch bottom laminated woven sack that includes one or more feature(s) that prevent leakage, breakage and/or infestation at both ends of the seam and in the area along the top and bottom of the gussets. Moreover, the bag needs to be strong enough to avoid leakage, breakage or infestation, which can begin with a small opening or crack that then gets larger over time, such as with additional forces or movement of the bag. At the same time, however, it is desirable to avoid "solutions" that require additional plastic material, additional adhesive material, such as for extra strength, or that slow the speed of manufacture. Such "solutions" increase the cost of the bag.

SUMMARY

The present disclosure provides woven plastic bags comprising one or more features that prevent leakage and/or infestation at both ends of the seam and in the area along the top and bottom of the gussets.

The present disclosure provides bags that have certain sections that are separated by an angled portion or edge, a curved portion or edge, or a combination thereof, and/or bags that comprise a cut-out and corresponding tab at opposing ends of the bag proximal to the portions of the back wall that form the seam. In one embodiment, the bag comprising a front wall, a back wall having a first portion and a second portion, a first side wall having a first portion proximal to the first portion of the back wall and a second portion proximal to the front wall, a second side wall having a first portion proximal to the second portion of the back wall and a second portion proximal to the front wall, an interior surface, an exterior surface, a top end, a bottom end, a first layer and a second layer, each of the front wall, back wall, first side wall and second side wall having an interior surface, an exterior surface, a top end and a bottom end, wherein the first layer comprises a woven polymer and the second layer comprises a polymer or paper attached to the first layer, wherein the back wall projects further than the top end of the first portion of the first side wall and the top end of the first portion of the second side wall, the top end of the first portion of the first side wall and the top end of the first portion of the second side wall projects further than the top end of the second portion of the first side wall and the top end of the second portion of the second side wall, and the top end of the second portion of the first side wall and the top end of the second portion of the second side wall projects further than the top end of the front wall, wherein at least a portion of the bottom end of the front wall projects further than the bottom end of the second portion of the first side wall and the bottom end of the second portion of the second side wall, the bottom end of the second portion of the first side wall and the bottom end of the second portion of the second side wall project further than the bottom end of the first portion of the first side wall and the bottom end of the first portion of the second side wall, and the bottom end of the first portion of the first side wall and the bottom end of the first portion of the second side wall project further than the bottom end of the back wall, and wherein the top end of the first portion of the back wall and the top end of the first portion of the first side wall, the top end of the first portion of the first side wall and the top end of the second portion of the first side wall, the top end of the second portion of the first side wall and the top end of the front wall, the top end of the front wall and the top end of the second portion of the second side wall, the top end of the second portion of the second side wall and the top end of the first portion of the second side wall, the top portion of the first portion of the second side wall and the top portion of the second portion of the back wall, the bottom end of the first portion of the back wall and the bottom end of the first section of the first side wall, the bottom end of the first portion of the first side wall and the bottom end of the second portion of the first side wall, the bottom end of the second portion of the first side wall and the bottom end of the front wall, the bottom end of the front wall and the bottom end of the second portion of the second side wall, the bottom end of the second portion of the second side wall and the bottom end of the first portion of the second side wall, and the bottom end of the first portion of the second side wall and the bottom end of the second portion of the back wall are separated by an angled edge or portion, a curved edge or portion, or a combination thereof, and wherein the top end of the second portion of the back wall comprises a cut-out and the bottom end of the second portion of the back wall comprises a corresponding tab.

In certain embodiments the angled edge or portion is between about 15° and about 75°, or between about 30° and about 60°, with respect to the top end of the front wall. In other embodiments the angled edge or portion is about 10°, 15°, 20°, 25°, 30°, 35°, 40°, 45°, 50°, 55°, 60°, 65°, 70°, 75°, or 80° with respect to the top end of the front wall. In further embodiments the curved edge or portion is a radial edge or portion, an elliptical edge or portion, a parabolic edge or portion, or a hyperbolic edge or portion. In additional embodiments the bag comprises an easy open or easy access feature, which in certain embodiments can comprise a weakened area.

The present disclosure additionally provides a bag comprising a front wall, a back wall, a first side wall, a second side wall, an interior surface, an exterior surface, a top end, a bottom end, a first layer and a second layer, each of the front wall, back wall, first side wall and second side wall having an interior surface, an exterior surface, a top end and a bottom end, wherein the first layer comprises a woven polymer and the second layer comprises a polymer or paper attached to the first layer, and wherein the bag comprises a weakened area located on the front wall of the bag, the first side wall of the bag and the back wall of the bag proximal the top end of the bag. In some embodiments the first layer comprises polypropylene, high density polyethylene, low density polyethylene, polyester, or any combination thereof. In other embodiments the second layer comprises a film. In still other embodiments the second layer comprises polypropylene, polyethylene, polyethylene terephthalate, polyamide, or any combination thereof or paper. In yet other embodiments the second layer comprises oriented polypropylene, biaxially-oriented polypropylene, oriented polyethylene, biaxially-oriented polyethylene, oriented polyethylene terephthalate, biaxially-oriented polyethylene terephthalate, oriented polyamide, biaxially-oriented polyamide, coated paper or any combination thereof. In further embodiments at least a portion of the second layer comprises a printed area thereon. In still further embodiments the first layer and second layer are laminated together. In yet further embodiments the first layer and second layer are laminated together using adhesive lamination or extrusion lamination.

In additional embodiments the weakened area comprises a plurality of perforations that penetrate through at least a portion of the front wall of the bag, the first side wall of the bag and the back wall of the bag. In some embodiments the plurality of perforations forms a line. In various embodiments the plurality of perforations forms a line that extends from any position on the front wall of the bag, for example about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 97%, about 98% or about 99% of a distance across the front wall of the bag, across the first side wall of the bag, to any position on the back wall of the bag, for example about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 97%, about 98% or about 99% of a distance across the back wall of the bag. In other embodiments the plurality of perforations forms a wave pattern. In further embodiments the plurality of perforations forms a zigzag pattern. In still further embodiments the weakened area comprises a deformation in least a portion of the front wall of the bag, the first side wall of the bag and the back wall of the bag. In yet further embodiments the weakened area further comprises a scoring mark. In certain embodiments each of the first layer and the second layer of the bag comprise a weakened portion. In still other embodiments the back wall of the bag comprises a seam.

In certain embodiments the top end of the back wall projects further than the top end of a portion of the first side wall proximal to the back wall and the top end of a portion of the second side wall proximal to the back wall, the top end of a portion of the first side wall proximal to the back wall and the top end of a portion of the second side wall proximal to the back wall projects further than the top end of a portion of the first side wall proximal to the front wall and the top end of a portion of the second side wall proximal to the front wall, and the top end of a portion of the first side wall proximal to the front wall and the top end of a portion of the second side wall proximal to the front wall projects further than the top end of the front wall. In other embodiments at least a portion of the bottom end of the front wall projects further than the bottom end of a portion of the first side wall proximal to the front wall and the bottom end of a portion of the second side wall proximal to the front wall, the bottom end of a portion of the first side wall proximal to the front wall and the bottom end of a portion of the second side wall proximal to the front wall project further than the bottom end of a portion of the first side wall proximal to the back wall and the bottom end of a portion of the second side wall proximal to the back wall, and the bottom end of a portion of the first side wall proximal to the back wall and the bottom end of a portion of the second side wall proximal to the back wall project further than the bottom end of the rear wall. In further embodiments the top end of a portion of the first side wall proximal to the back wall and the top end of a portion of the first side wall proximal to the front wall are separated by an angled cut, and the bottom end of a portion of the first side wall proximal to the back wall and the bottom end of a portion of the first side wall proximal to the front wall are separated by an angled cut.

In additional embodiments the portion of the bottom end of the front wall that projects further than the bottom end of the first side wall and the bottom end of the second side wall, and the portion of the bottom end of the first side wall and the bottom end of the second side wall that project further than the bottom end of the rear wall are sealed to the outer surface of the bottom end of the rear wall. In certain embodiments the bottom end of the bag is sealed using an adhesive sealing, heat sealing, adhesive lamination, extrusion lamination, stitching, ultrasonic energy, pressure, tape, or any combination thereof. In some embodiments the bottom end of the bag is sealed using adhesive-to-adhesive sealing or adhesive-to-bag sealing. In further embodiments the bottom end of the front wall, the bottom end of the first side wall, the bottom end of the rear wall and the bottom end of the second side wall each project the same distance. In still further embodiments at least a portion of a single fold of the bottom end of the bag is sealed to the outer surface of the front wall or the outer surface of the rear wall of the bag. In yet further embodiments at least a portion of a double fold of the bottom end of the bag is sealed to the outer surface of the front wall or the outer surface of the rear wall of the bag.

In other embodiments the top end of the front wall, the top end of the first side wall, the top end of the rear wall and the top end of the second side wall each project the same distance. In certain embodiments at least a portion of the bottom end of the front wall projects further than the bottom end of a portion of the first side wall proximal to the front wall and the bottom end of a portion of the second side wall proximal to the front wall, the bottom end of a portion of the first side wall proximal to the front wall and the bottom end of a portion of the second side wall proximal to the front wall project further than the bottom end of a portion of the first side wall proximal to the back wall and the bottom end of a portion of the second side wall proximal to the back wall, and the bottom end of a portion of the first side wall proximal to the back wall and the bottom end of a portion of the second side wall proximal to the back wall project further than the bottom end of the rear wall. In still other embodiments the portion of the bottom end of the front wall that projects further than the bottom end of the first side wall and the bottom end of the second side wall, and the portion of the bottom end of the first side wall and the bottom end of the second side wall that project further than the bottom end of the rear wall are sealed to the outer surface of the bottom end of the rear wall. In additional embodiments the bottom end of the front wall, the bottom end of the first side wall, the bottom end of the rear wall and the bottom end of the second side wall each project the same distance. In certain embodiments the top end and the bottom end of the bag are sealed, and wherein the bag comprises at least ten pounds by weight of a filling material.

In some embodiments the bag further comprises a third layer comprising a polymer between the first layer and the second layer. In certain embodiments the third layer comprises a woven polymer. In other embodiments the third layer comprises polypropylene, high density polyethylene, low density polyethylene, polyester, or any combination thereof. In further embodiments the third layer comprises a polymeric film. In additional embodiments the third layer comprises polypropylene, polyethylene, polyethylene terephthalate, polyamide, or any combination thereof. In still other embodiments each of the first layer, the second layer and the third layer of the bag comprise a weakened portion.

In still further embodiments, the first layer, second layer, and third layer (if present) may each consist essentially of polypropylene, polyethylene, or a combination of polypropylene and polyethylene. Such embodiments are advantageous because they can be more easily recycled. In such embodiments, other compounds may exist in small amounts in one or more of the layers without affecting the ability to recycle the bag or portions thereof, such as by reheating the same and using it as feedstock for a new bag.

In further embodiments the bag comprises printing on the front wall, the first side wall, the back wall, the second side wall, the first end, the second end, or any combination thereof. In still further embodiments at least portions of the exterior surfaces of each of the front wall and the back wall comprise a plurality of discrete areas further comprising printing thereon. In yet further embodiments a portion of the front wall and a portion of the back wall combine to form a discrete portion of the bag located at or near either the top end or the bottom end, wherein the discrete portion of the bag comprises printing thereon.

These and other objects of the invention will be apparent to those skilled in the art from the following detailed description.

BRIEF DESCRIPTION OF THE DRAWINGS

The following drawings are included to further demonstrate certain aspects and embodiments of the present invention. The invention may be better understood by reference to one or more of these drawings in combination with the detailed description of specific embodiments presented herein.

FIG. 13A shows an outline of a portion of one end of a bag with a step cut end, corresponding to a mirror image of the region marked as "A" in FIG. 11, detailing an alternate embodiment with angled portions between the back panel of the bag and the side wall, between the two sections of the side wall, and between the side wall and the front panel of the bag, and a tab feature at one end of the bag that extends into the seam. FIG. 13B shows an image of the top end of the bag depicted in FIG. 13A upon sealing the seam. FIG. 13C shows an image of the bottom end of the bag depicted in FIG. 13A upon sealing the seam.

FIG. 14A shows an outline of a portion of one end of a bag with a step cut end, corresponding to a mirror image of the region marked as "A" in FIG. 11, detailing an alternate embodiment with a combination of radial (circular) and angled portions between the back panel of the bag and the side wall, between the two sections of the side wall, and between the side wall and the front panel of the bag, and a tab feature at one end of the bag that extends into the seam. FIG. 14B shows an image of the top end of the bag depicted in FIG. 14A upon sealing the seam. FIG. 14C shows an image of the bottom end of the bag depicted in FIG. 14A upon sealing the seam.

DETAILED DESCRIPTION

Figure 1:
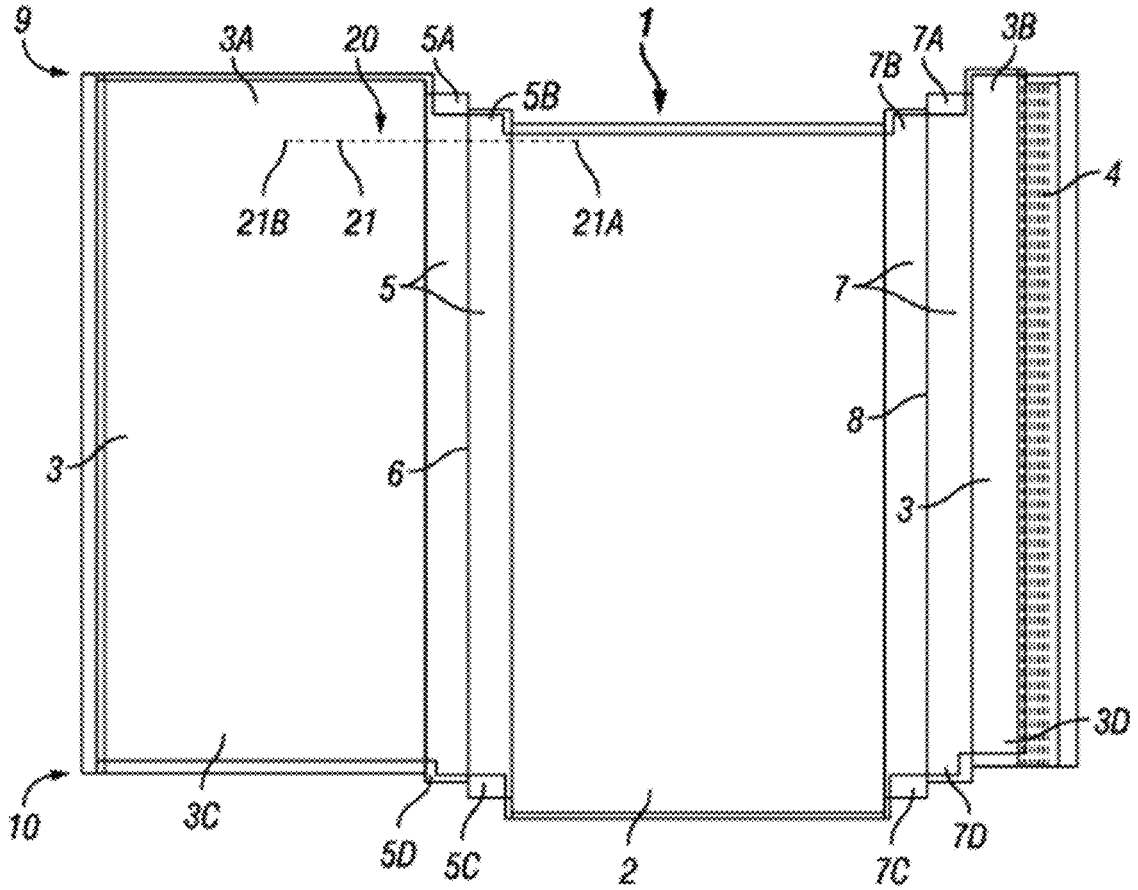
FIG. 1 shows an outline of a step cut bag with a weakened area near the top end of the bag comprising a line of perforations extending from the front panel of the bag across the first side panel of the bag to the back panel of the bag according to one embodiment of the present disclosure.

Referring to FIG. 1, a planar view of an embodiment of a substantially flat sheet of material from which a "step cut" bag 1 is to be formed is shown. Shown on the sheet are front wall 2, rear wall 3, seam 4, first side wall 5 having gusset portion 6, and second side wall 7 having gusset portion 8. As shown in FIG. 1, the bag 1 has a first or top end 9 and a second or bottom end 10, and thus each of the front wall 2, rear wall 3, first side wall 5 and second side wall 7 has a first or top end and a second or bottom end. It will be apparent, however, that the orientation of the bag ends 9 and 10 are unimportant and the "top" and "bottom" references are useful but may change depending upon the orientation from which one views the bag. Bag 1 is considered a "step cut" bag because the front wall 2, the first side wall 5 and the second side wall 7, and the rear wall 3 are cut so that the front wall 2, the first side wall 5 and the second side wall 7, and the rear wall 3 have different lengths on one end (or both ends) of the bag. As shown in FIG. 1, the first side wall 5 and the second side wall 7 are cut to different lengths on either side of the gusset portion 6 and 8, respectively. As shown in FIG. 1 the first end 9 of bag 1 has portions 3 *a* and 3 *b* of the rear wall 3 of the bag that extend further from the body of the bag 1 than do portions 5 *a* and 7 *a* of the first side wall 5 and second side wall 7, respectively, which in turn extend further from the body of the bag 1 than do portions 5 *b* and 7 *b* of the first side wall 5 and second side wall 7, respectively, which in turn extend further from the body of the bag 1 than does the top end of the front wall 2 of the bag 1. In addition, the bottom end of the front wall 2 at the second end 10 of bag 1 extends further from the body of the bag 1 than do portions 5 *c* and 7 *c* of the first side wall 5 and second side wall 7, respectively, which in turn extend further from the body of the bag 1 than do portions 5*d* and 7*d* of the first side wall 5 and second side wall 7, respectively, which in turn extend further from the body of the bag 1 than do portions 3*c* and 3*d* the bottom end of the rear wall 3 of the bag 1. Therefore, in the embodiment shown in FIG. 1 both of the ends of the bag 1 have a "step cut." Also shown is weakened portion 20, which in this embodiment is near the first end 9 of the bag 1 and comprises a plurality of perforations 21 extending from a first end 21*a* on the front wall 2 of the bag 1 across the first side wall 5 of the bag 1 to a second end 21*b* on the rear wall 3 of the bag 1. The weakened area is generally on or near the fold line (not shown) for closing or sealing the first end 9 of the bag 1. This weakened portion can be opened with less force than required to open or tear other portions of the bag 1.

Figure 2:
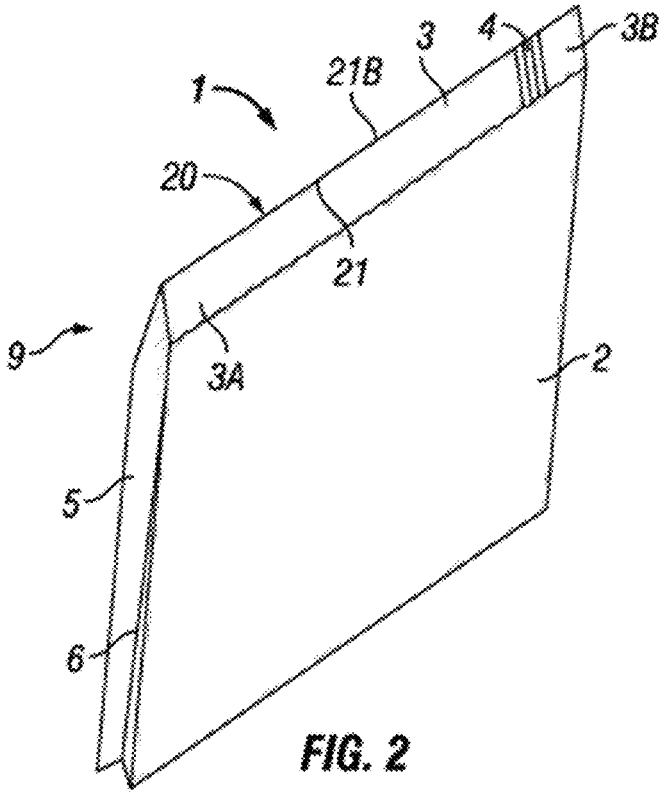
FIG. 2 shows the top portion of the bag of FIG. 1 after closing the top end of the bag.
Figure 3:
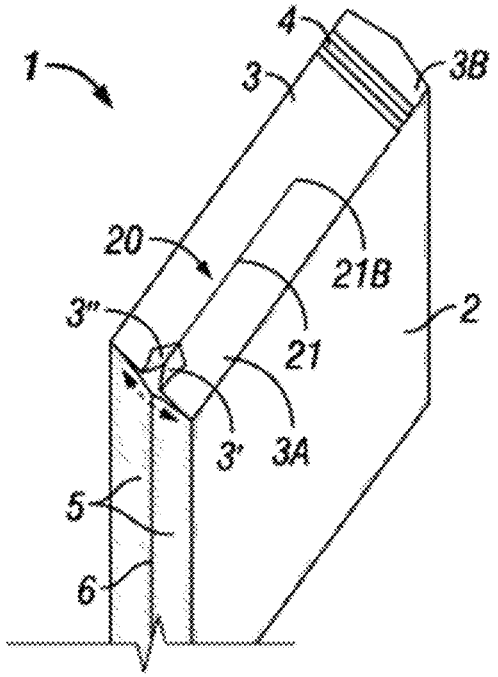
FIG. 3 shows the first step in opening the closed bag from FIG. 2.

Referring to FIG. 2, the upper portion of the bag 1 from FIG. 1 is shown after sealing the first end 9 of the bag 1. Visible in FIG. 2 is front wall 2, back wall 3 having portions 3*a* and 3*b*, seam 4, first side wall 5 having gusset portion 6, and weakened portion 20 comprising a plurality of perforations 21 terminating at second end 21 *b*.

Figure 4:
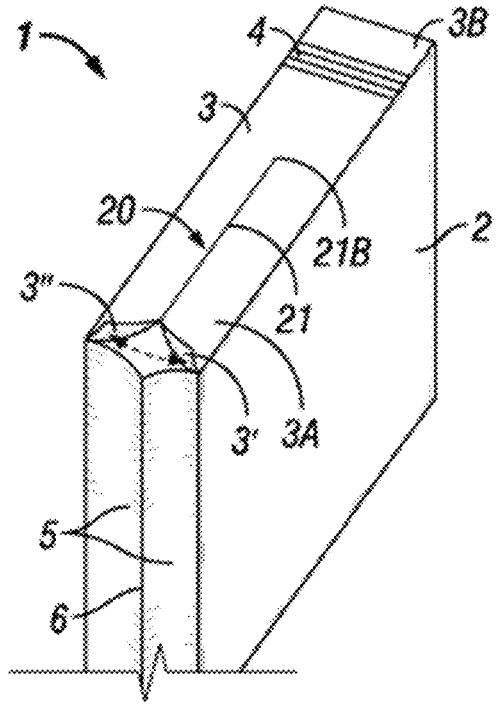
FIG. 4 shows the second step in opening the closed bag from FIG. 2.
Figure 5:
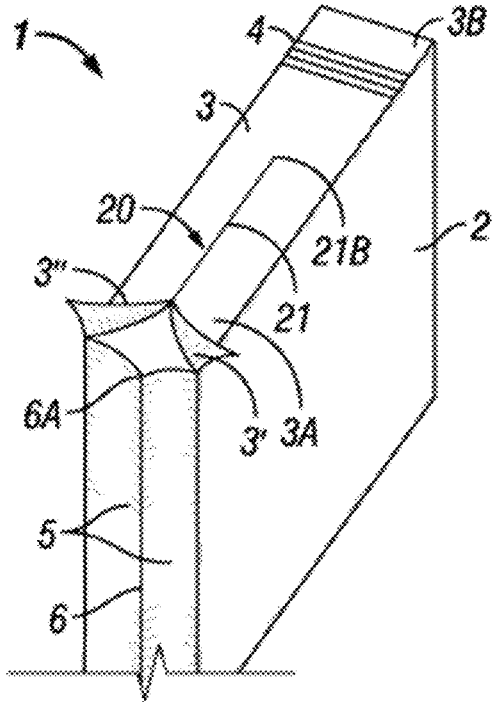
FIG. 5 shows the third step in opening the closed bag from FIG. 2.
Figure 6:
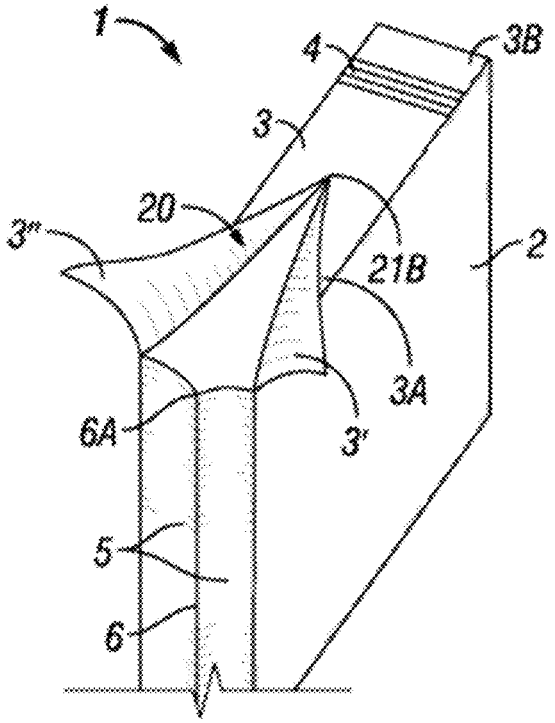
FIG. 6 shows the fourth step in opening the closed bag from FIG. 2.

Bag 1 can be opened as shown in FIG. 3 through FIG. 6. FIG. 3 once again shows the upper portion of the bag 1 from FIG. 2, and visible is front wall 2, back wall 3 having portions 3*a* and 3*b*, seam 4, first side wall 5 having gusset portion 6, and weakened portion 20 comprising a plurality of perforations 21 terminating at second end 21 *b*. Bag 1 is opened by initially pulling on the portions 3' and 3" of the rear wall 3 on both sides of the plurality of perforations 21, which creates a tear in the weakened portion 20 of the bag 1 and begins separating the portions of the first side wall 5 that are separated by the gusset portion 6. In FIG. 4 the portions 3' and 3" of the rear wall 3 on both sides of the plurality of perforations 21 are further pulled apart, resulting in the expansion of the tear in the weakened portion 20 toward the second end 21*b* of the plurality of perforations 21. Additionally visible in FIG. 4 are front wall 2, back wall 3 having portions 3*a* and 3*b*, seam 4, and first side wall 5 having gusset portion 6. In FIG. 5 the portions 3' and 3" of the rear wall 3 on both sides of the plurality of perforations 21 are pulled completely apart, resulting in the expansion of the tear in the weakened portion 20 further toward the second end 21*b* of the plurality of perforations 21 and to the first end 21*a* of the plurality of perforations (not visible in FIG. 5). This results in uncovering the top end 6*a* of the gusset portion 6 of the first side wall 5, which can then be pulled open. Additionally visible in FIG. 5 are front wall 2, back wall 3 having portions 3*a* and 3*b*, and seam 4. In FIG. 6 the plurality of perforations 21 are pulled completely apart, resulting in the expansion of the tear in the weakened portion 20 to the second end 21*b* of the plurality of perforations 21. This results in a large opening in bag 1 that can be used to pour out the contents of the bag 1. Additionally visible in FIG. 6 are front wall 2, back wall 3 having portions 3*a*, 3*b*, 3' and 3", seam 4, first side wall 5 and gusset portion 6 having a top end 6*a*.

Figure 7:
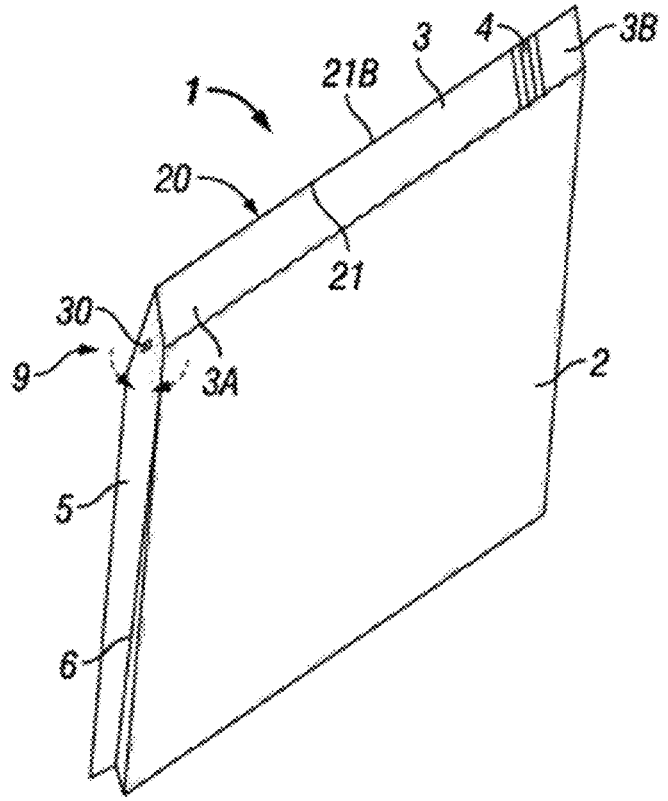
FIG. 7 shows the top portion of the bag of FIG. 1 after closing the top end of the bag and a location for optional application of adhesive to keep the top portion of the gusseted portion of the first side panel closed.

Referring to FIG. 7, the upper portion of the bag 1 from FIG. 1 is shown after sealing the first end 9 of the bag 1, with optional adhesive 30 located near the top end of the first side wall 5, which serves to keep the top end of the first side wall 5 closed (see arrows). Although not visible in FIG. 7, the optional adhesive can also be applied near the top end of the second side wall. Although shown as a spot in FIG. 7, the adhesive can be applied in any manner that results in the closure of the top end of the first side wall 5, for example as a strip that runs from the edge of the intersection of the first side wall 5 and the back wall 3 to the edge of the intersection of the first side wall 5 and the front wall 2. Also visible in FIG. 7 is front wall 2, back wall 3 having portions 3*a* and 3*b*, seam 4, first side wall 5 having gusset portion 6, and weakened portion 20 comprising a plurality of perforations 21 terminating at second end 21 *b*.

Once the bag 1 is sealed at one end, it can be filled with the desired materials. For example, it has been found that a bag 1 with dimensions of 16.5 inches by 6.5 inches by 39.5 inches can durably hold up to about fifty five (55) pounds of material without showing undue stress, undue tearing, undue breakage, undue deformation, or leakage or the like. It is believed that any bulk material can be contained by bag 1, and in certain embodiments the contents can weigh up to 100 pounds or so without undue risk of tearing or damage to bag 1. Once the bag 1 is filled, the second end typically needs to be sealed. The second end of the bag 1 can be sealed in a similar manner as that described above. Alternatively, the bag 1 can have its second end sealed by conventional means such as sewing. Still another approach is to stitch the second end, and then seal the second end in a manner like that described above (not shown). Although not shown, those skilled in the art will understand and appreciate that a second end of bag 1 can be sealed using any conventional technique once bag 1 has been filled with the selected amount of the desired material.

Figure 8:
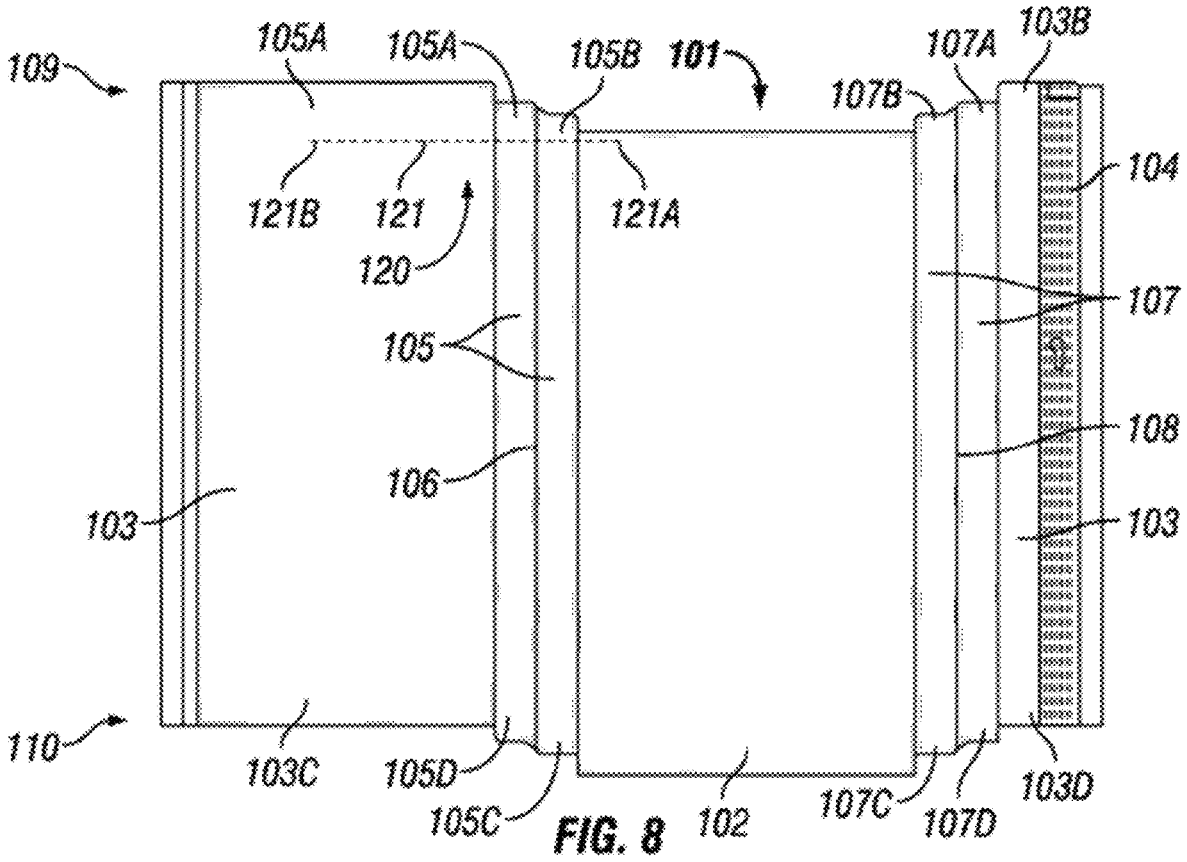
FIG. 8 shows an outline of a step cut bag with a weakened area near the top end of the bag comprising a line of perforations extending from the front panel of the bag across the first side panel of the bag to the back panel of the bag, and angled corners at the top and bottom of the portions of the first and second side panels on either side of the gusset fold, according to one embodiment of the present disclosure.

Referring to FIG. 8, a planar view of an embodiment of a substantially flat sheet of material from which a "step cut" bag 101 is to be formed is shown. Shown on the sheet are front wall 102, rear wall 103, seam 104, first side wall 105 having gusset portion 106, and second side wall 107 having gusset portion 108. As shown in FIG. 8, the bag 101 has a first or top end 109 and a second or bottom end 110, and thus each of the front wall 102, rear wall 103, first side wall 105 and second side wall 107 has a first or top end and a second or bottom end. It will be apparent, however, that the orientation of the bag ends 109 and 110 are unimportant and the "top" and "bottom" references are useful but may change depending upon the orientation from which one views the bag. Bag 101 is considered a "step cut" bag because the front wall 102, the first side wall 105 and the second side wall 107, and the rear wall 103 are cut so that the front wall 102, the first side wall 105 and the second side wall 107, and the rear wall 103 have different lengths on one end (or both ends) of the bag. As shown in FIG. 8, the first side wall 105 and the second side wall 107 are cut to different lengths on either side of the gusset portion 106 and 108, respectively. As shown in FIG. 8 the first end 109 of bag 101 has portions 103*a* and 103*b* of the rear wall 103 of the bag that extend further from the body of the bag 101 than do portions 105*a* and 107*a* of the first side wall 105 and second side wall 107, respectively, which in turn extend further from the body of the bag 101 than do portions 105*b* and 107*b* of the first side wall 105 and second side wall 107, respectively, which in turn extend further from the body of the bag 101 than does the top end of the front wall 102 of the bag 101. In addition, the bottom end of the front wall 102 at the second end 110 of bag 101 extends further from the body of the bag 101 than do portions 105*c* and 107*c* of the first side wall 105 and second side wall 107, respectively, which in turn extend further from the body of the bag 101 than do portions 105*d* and 107*d* of the first side wall 105 and second side wall 107, respectively, which in turn extend further from the body of the bag 101 than do portions 103*c* and 103*d* the bottom end of the rear wall 103 of the bag 101. Therefore, in the embodiment shown in FIG. 8 both of the ends of the bag 101 have a "step cut." In addition, the portions 105*a* and 105*b*, 107*a* and 107*b*, 105*c* and 105*d*, and 107*c* and 107*d* are not separated by a straight line, but rather an angled cut (see circles). Although in FIG. 8 this cut is shown as about 45°, the angle can vary in different embodiments (not shown). This angled cut serves to further prevent leakage of contents out of the bag, or infestation of organisms into the contents of the bag. Also shown is weakened portion 120, which in this embodiment is near the first end 109 of the bag 101 and comprises a plurality of perforations 121 extending from a first end 121*a* on the front wall 102 of the bag 101 across the first side wall 105 of the bag 101 to a second end 121 *b* on the rear wall 103 of the bag 101. The weakened area is generally on or near the fold line (not shown) for closing or sealing the first end 109 of the bag 101. This weakened portion can be opened with less force than required to open or tear other portions of the bag 101.

Figure 9:
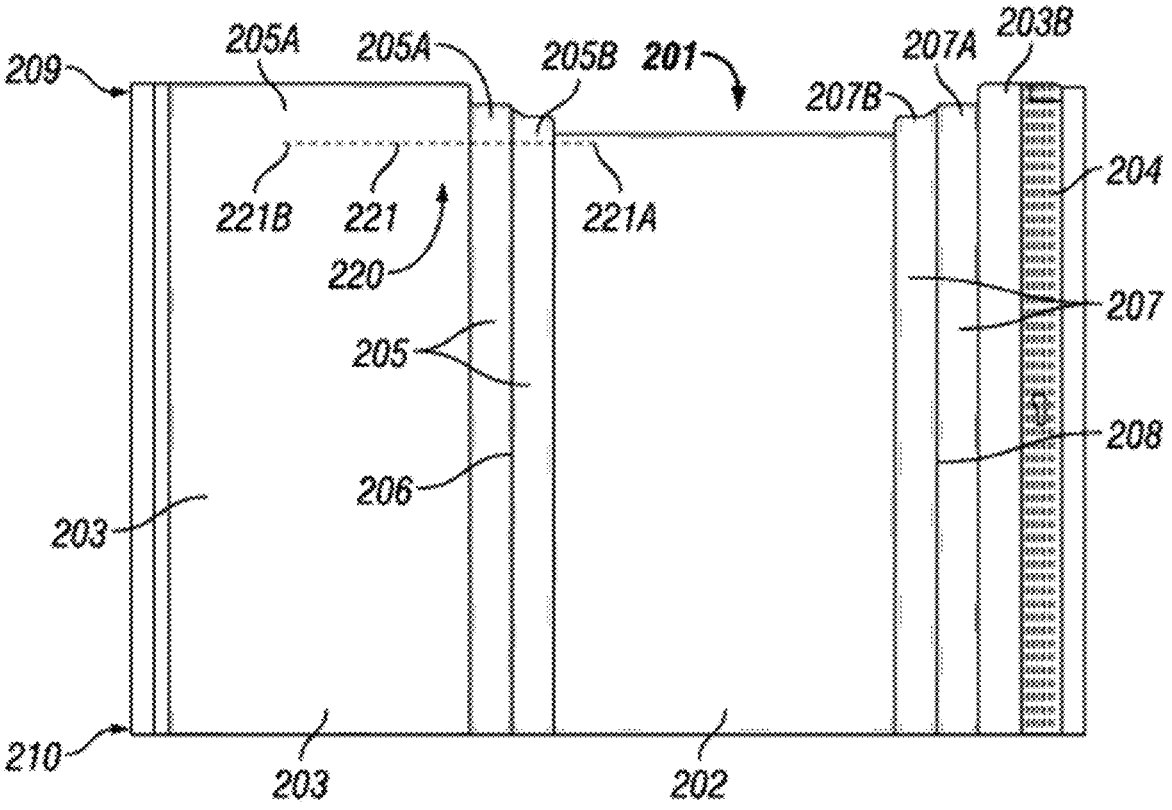
FIG. 9 shows an outline of a bag with a step cut top end and a flush cut bottom end, and a weakened area near the top end of the bag comprising a line of perforations extending from the front panel of the bag across the first side panel of the bag to the back panel of the bag according to one embodiment of the present disclosure.

Referring to FIG. 9, a planar view of an embodiment of a substantially flat sheet of material from which a bag 201 is to be formed is shown. Shown on the sheet are front wall 202, rear wall 203, seam 204, first side wall 205 having gusset portion 206, and second side wall 207 having gusset portion 208. As shown in FIG. 9, the bag 201 has a first or top end 209 and a second or bottom end 210, and thus each of the front wall 202, rear wall 203, first side wall 205 and second side wall 207 has a first or top end and a second or bottom end. It will be apparent, however, that the orientation of the bag ends 209 and 210 are unimportant and the "top" and "bottom" references are useful but may change depending upon the orientation from which one views the bag. The top end 209 of bag 201 is has a "step cut" because the front wall 202, the first side wall 205 and the second side wall 207, and the rear wall 203 are cut so that the front wall 202, the first side wall 205 and the second side wall 207, and the rear wall 203 have different lengths. As shown in FIG. 9, the first side wall 205 and the second side wall 207 are cut to different lengths on either side of the gusset portion 206 and 208, respectively. As shown in FIG. 9 the first end 209 of bag 201 has portions 203*a* and 203*b* of the rear wall 203 of the bag 201 that extend further from the body of the bag 201 than do portions 205*a* and 207*a* of the first side wall 205 and second side wall 207, respectively, which in turn extend further from the body of the bag 201 than do portions 205*b* and 207*b* of the first side wall 205 and second side wall 207, respectively, which in turn extend further from the body of the bag 201 than does the top end of the front wall 202 of the bag 201. In the embodiment shown in FIG. 9, the bottom end of the front wall 202, the first side wall 205, the second side wall 207, and the rear wall 203 at the second end 210 of bag 201 each extend the same distance from the body of the bag 201. Therefore, in the embodiment shown in FIG. 9 the bottom end 210 of the bag 201 has a "flush cut." Although not shown, in certain embodiments the top end of the bag can be flush cut, and the bottom end of the bag can be step cut. Also shown is weakened portion 220, which in this embodiment is near the first end 209 of the bag 201 and comprises a plurality of perforations 221 extending from a first end 221*a* on the front wall 202 of the bag 201 across the first side wall 205 of the bag 201 to a second end 221*b* on the rear wall 203 of the bag 201. The weakened area is generally on or near the fold line (not shown) for closing or sealing the first end 209 of the bag 201. This weakened portion can be opened with less force than required to open or tear other portions of the bag 201.

Figure 10:
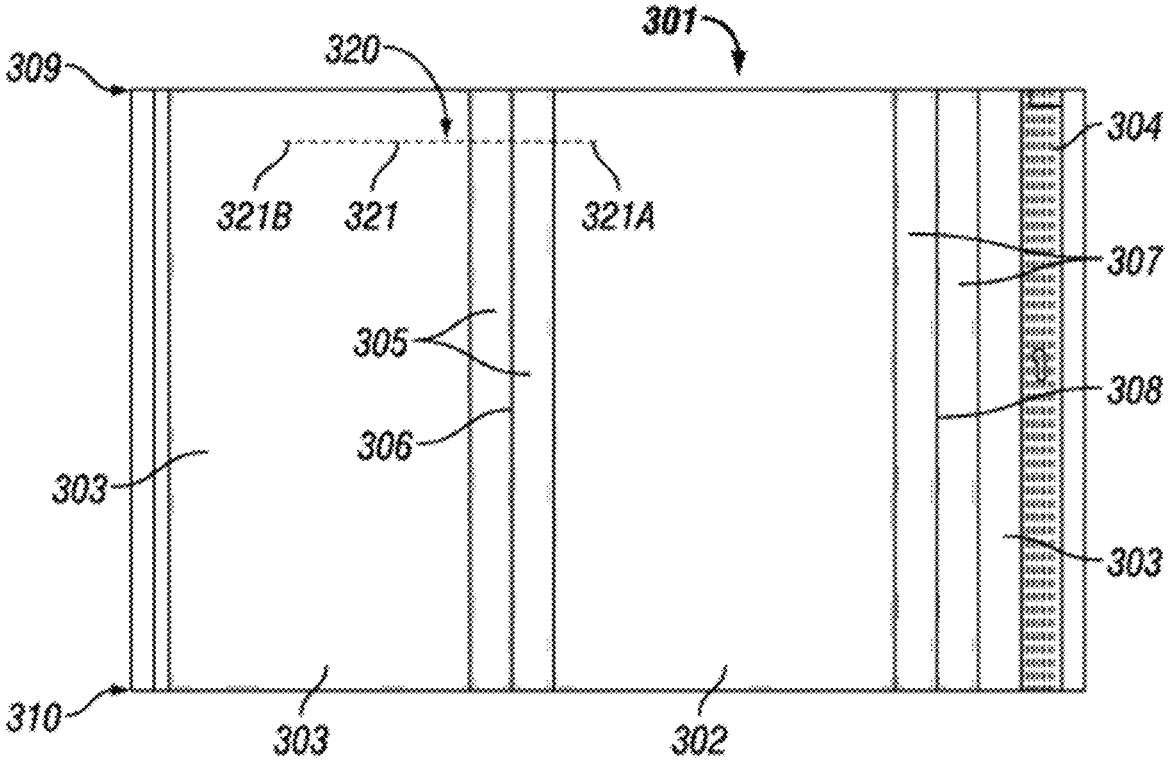
FIG. 10 shows an outline of a bag with a flush cut top end and a flush cut bottom end, and a weakened area near the top end of the bag comprising a line of perforations extending from the front panel of the bag across the first side panel of the bag to the back panel of the bag according to one embodiment of the present disclosure.

Referring to FIG. 10, a planar view of an embodiment of a substantially flat sheet of material from which a flush cut bag 301 is to be formed is shown. Shown on the sheet are front wall 302, rear wall 303, seam 304, first side wall 305 having gusset portion 306, and second side wall 307 having gusset portion 308. As shown in FIG. 10, the bag 301 has a first or top end 309 and a second or bottom end 310, and thus each of the front wall 302, rear wall 303, first side wall 305 and second side wall 307 has a first or top end and a second or bottom end. It will be apparent, however, that the orientation of the bag ends 309 and 310 are unimportant and the "top" and "bottom" references are useful but may change depending upon the orientation from which one views the bag. The top end 309 of bag 301 has a "flush cut" because the front wall 302, the first side wall 305 and the second side wall 307, and the rear wall 303 are cut to the same length. In the embodiment shown in FIG. 10, the bottom end of the front wall 302, the first side wall 305, the second side wall 307, and the rear wall 303 at the second end 310 of bag 301 each extend the same distance from the body of the bag 301. Therefore, in the embodiment shown in FIG. 10 the bottom end 310 of the bag 301 also has a "flush cut." Also shown is weakened portion 320, which in this embodiment is near the first end 309 of the bag 301 and comprises a plurality of perforations 321 extending from a first end 321*a* on the front wall 302 of the bag 301 across the first side wall 305 of the bag 301 to a second end 321*b* on the rear wall 303 of the bag 301. The weakened area is generally on or near the fold line (not shown) for closing or sealing the first end 309 of the bag 301. This weakened portion can be opened with less force than required to open or tear other portions of the bag 301.

Figure 11:
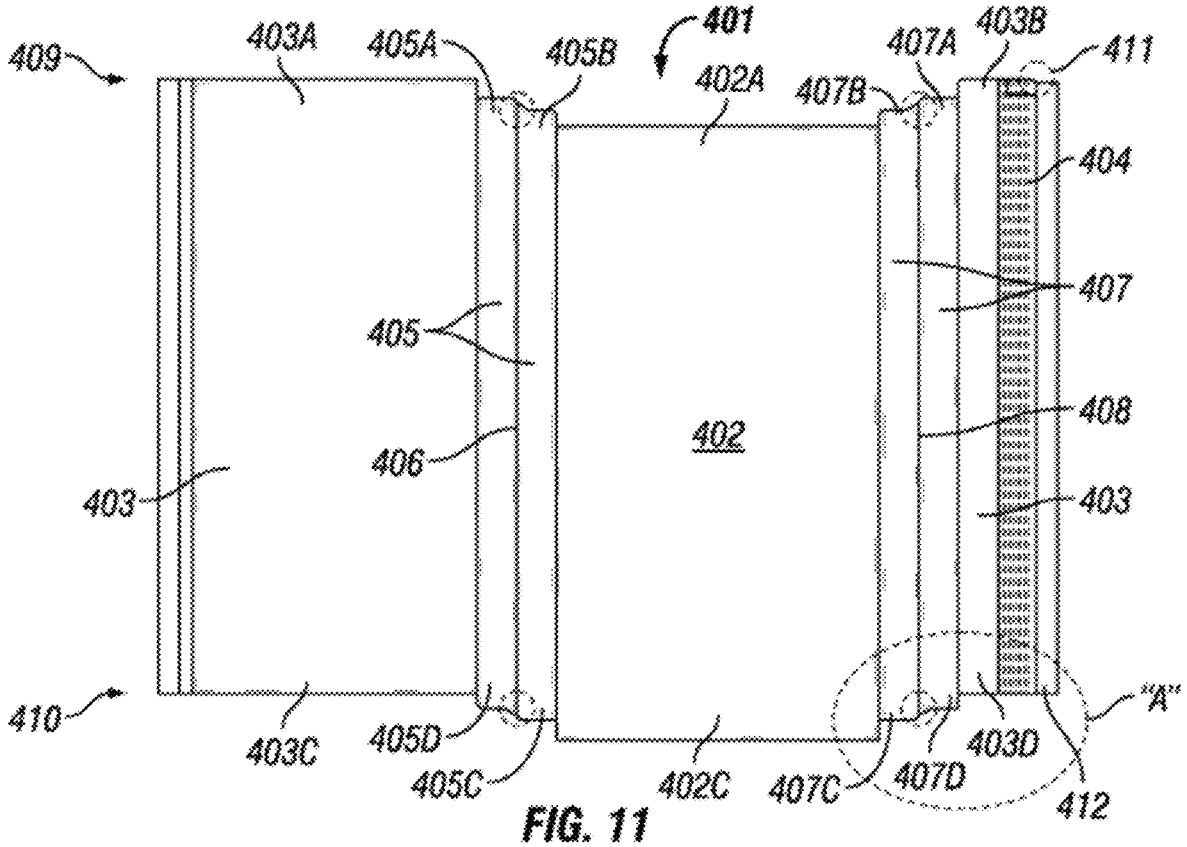
FIG. 11 shows an outline of a bag with a step cut top end and a step cut bottom end, with an angled portion between the two sections of the side wall at both ends of the bag, and a tab at one end of the bag and a cut-out feature at the other end of the bag that extend into the seam.

Referring to FIG. 11, a planar view of an embodiment of a substantially flat sheet of material from which a "step cut" bag 401 is to be formed is shown. Shown on the sheet are front wall 402, rear wall 403, seam 404, first side wall 405 having first gusset portion 406, and second side wall 407 having second gusset portion 408. As shown in FIG. 11, the bag 401 has a first or top end 409 and a second or bottom end 410, and thus each of the front wall 402, rear wall 403, first side wall 405 and second side wall 407 has a first or top end and a second or bottom end. It will be apparent, however, that the orientation of the bag ends 409 and 410 are unimportant and the "top" and "bottom" references are useful but may change depending upon the orientation from which one views the bag. Bag 401 is considered a "step cut" bag because the front wall 402, the first side wall 405 and the second side wall 407, and the rear wall 403 are cut so that the front wall 402, the first side wall 405 and the second side wall 407, and the rear wall 403 have different lengths on both ends of the bag. As shown in FIG. 11, the first side wall 405 and the second side wall 407 are cut to different lengths on either side of the gusset portion 406 and 408, respectively. As shown in FIG. 11 the first end 409 of bag 401 has portions 403*a* and 403*b* of the rear wall 403 of the bag that extend further from the body of the bag 401 than do portions 405*a* and 407*a* of the first side wall 405 and second side wall 407, respectively, which in turn extend further from the body of the bag 401 than do portions 405*b* and 407*b* of the first side wall 405 and second side wall 407, respectively, which in turn extend further from the body of the bag 401 than does the top end of the front wall 402 of the bag 401. In addition, the bottom end of the front wall 402 at the second end 410 of bag 401 extends further from the body of the bag 401 than do portions 405*c* and 407*c* of the first side wall 405 and second side wall 407, respectively, which in turn extend further from the body of the bag 401 than do portions 405*d* and 407*d* of the first side wall 405 and second side wall 407, respectively, which in turn extend further from the body of the bag 401 than do portions 403*c* and 403*d* the bottom end of the rear wall 403 of the bag 401. Therefore, in the embodiment shown in FIG. 11 both of the ends of the bag 401 have a "step cut." However, the skilled artisan will readily appreciate that in other embodiments (not shown), one or both ends of the bag can be a different type of step cut, or another type of cut altogether, for example a flush cut end as described herein. As shown in FIG. 11, the portions 403*a* and 405*a*, 405*b* and 402*a*, 402*a* and 407*b*, 407*a* and 403*b*, 403*c* and 405*d*, 405*c* and 402*c*, 402*c* and 407*c*, and 407*d* and 403*d*, respectively, are separated from one another not by straight lines and right angles but by curved portions or edges, which in FIG. 11 are shown as radial (circular) elements. Although one particular size and shape of radial portion is shown in FIG. 11, for the features between the foregoing portions, those skilled in the art will appreciate that in other embodiments (not shown), these radial portions can be as small or as large as desired. In addition, the portions 405*a* and 405*b*, 407*a* and 407*b*, 405*c* and 405*d*, and 407*c* and 407*d*, respectively, are not defined or separated by a radial portion or edge, but rather an angled portion or edge (see circles). Although in FIG. 11 this angled portion is shown as about 45° with respect to the top end of the front wall, the angle can vary in different embodiments (not shown). These radial and angled portions serve to further prevent breakage, leakage of contents out of the bag, or infestation of organisms into the contents of the bag, by providing extra material at one end of the bag that improves sealing. Further shown in FIG. 11 is cut-out 411 and corresponding tab 412 at opposing ends of the seam 404. Since the bag 401 is formed from a continuous sheet of material, the formation of the cut-out 411 (removal of material) at one end of the bag 401 results in a tab 412 (extra material) at the other end of the bag 401. The cut out 411 and tab 412 extend into the seam 404, and also serve to further prevent breakage, leakage of contents out of the bag, or infestation of organisms into the contents of the bag. This is because since extra material can be present between the seam 404 of the bag and the edge of the rear panel 403*b* of the bag that is not sealed, a hole can be present that can serve as an access point into or out of the sealed bag. But the presence of the cut-out 411 and the tab 412 ensures that the ends of any such hole will be sealed, preventing access into or out of the sealed bag. The cut-out 411 and tab 412 can be any depth/height desired, and can extend further into the seam as desired (not shown). Although in FIG. 11 the cut-out 411 and tab 412 are shown as extending from within the seam 404 to the edge of the rear panel 403*b* of the bag, in other embodiments (not shown) the cut-out and tab can extend from within the seam 404 only a portion of the distance to the edge of the rear panel 403*b* of the bag 401. Furthermore as shown, the tab and cut-out are illustrated as primarily rectangular in shape. It is understood that the shape is not limited to rectangles but can also be configured as an angular or rounded cut-out and matching tab as long as the configuration fits together to form a seal effective to prevent leakage or infestation. Additionally, in other embodiments (not shown), the bag can comprise an easy open or easy access feature, such as the weakened portion near the top of the bag as shown herein above (for example in FIG. 8), or the easy open features detailed in United States Patent Application Publication Number US 2013/0206631 and United States Patent Application Publication Number US 2013/0209002, each of which is incorporated by reference herein in its entirety.

Figure 12:
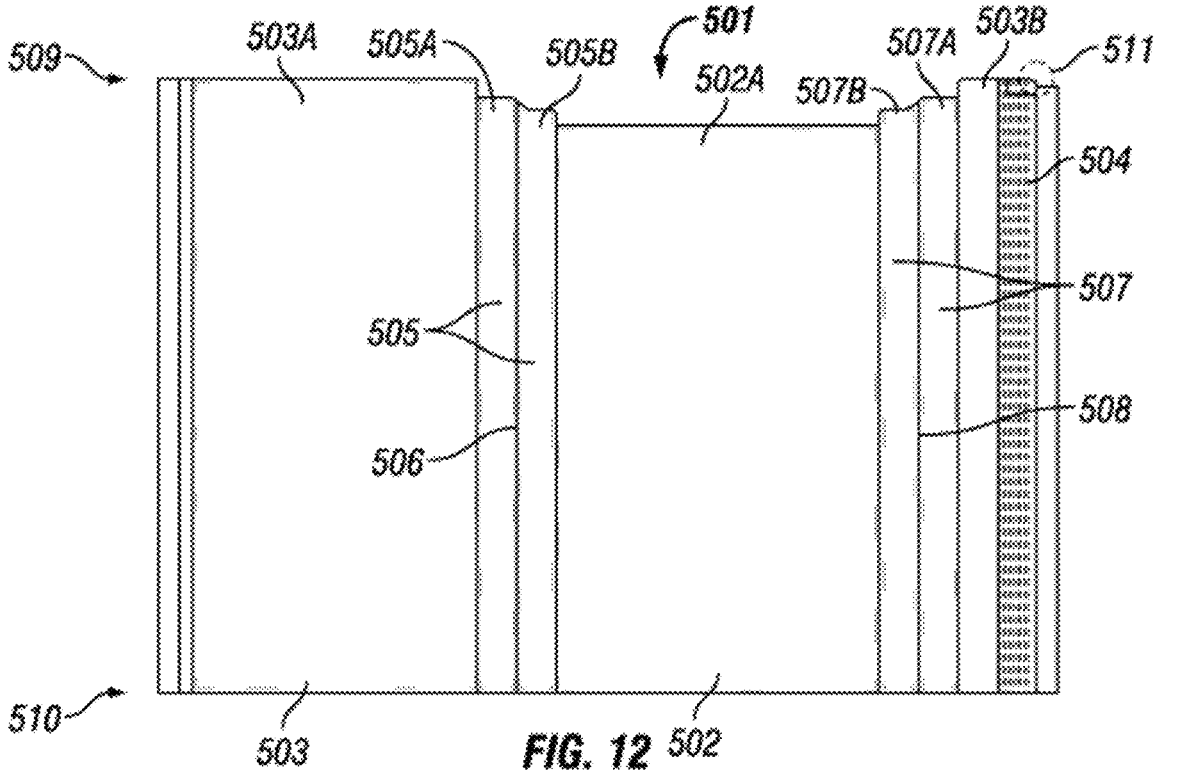
FIG. 12 shows an outline of the top portion of a bag with a step cut top end, with radial (circular) portions between the back panel of the bag and the side wall, between the two sections of the side wall, and between the side wall and the front panel of the bag at the top end of the bag, and a cut-out feature at the top end of the bag that extends into the seam.

Referring to FIG. 12, a planar view of the top portion of an embodiment of a substantially flat sheet of material from which a bag 501 is to be formed is shown. Shown on the sheet are front wall 502, rear wall 503, seam 504, first side wall 505 having first gusset portion 506, and second side wall 507 having second gusset portion 508. As shown in FIG. 12, the bag 501 has a first or top end 509 and a second or bottom end 510 (not visible in FIG. 12), and thus each of the front wall 502, rear wall 503, first side wall 505 and second side wall 507 has a first or top end and a second or bottom end. It will be apparent, however, that the orientation of the bag ends 509 and 510 are unimportant and the "top" and "bottom" references are useful but may change depending upon the orientation from which one views the bag. The top end 509 of bag 501 has a "step cut" because the front wall 502, the first side wall 505 and the second side wall 507, and the rear wall 503 are cut so that the front wall 502, the first side wall 505 and the second side wall 507, and the rear wall 503 have different lengths. As shown in FIG. 12, the first side wall 505 and the second side wall 507 are cut to different lengths on either side of the gusset portion 506 and 508, respectively. As shown in FIG. 12 the first end 509 of bag 501 has portions 503*a* and 503*b* of the rear wall 503 of the bag 501 that extend further from the body of the bag 501 than do portions 505*a* and 507*a* of the first side wall 505 and second side wall 507, respectively, which in turn extend further from the body of the bag 501 than do portions 505*b* and 507*b* of the first side wall 505 and second side wall 507, respectively, which in turn extend further from the body of the bag 501 than does the top end of the front wall 502 of the bag 501. As shown in FIG. 12, the portions 503*a* and 505*a*, 505*a* and 505*b*, 505*b* and 502*a*, 502*a* and 507*b*, 507*b* and 507*a*, and 507*a* and 503*b*, respectively, are separated not by straight lines and right angles but by curved portions or edges, such as radial (circular) portions as shown. Although one particular size and shape of the curved portions is shown in FIG. 12, those skilled in the art will understand that in other embodiments (not shown) these curved edges can be of different shapes (e.g., elliptical, or different segments of a curve, etc.), and can be as small or as large as desired. These curved portions serve to further prevent breakage or leakage of contents out of the bag, or infestation of organisms into the contents of the bag. Further shown in FIG. 12 is cut-out 511 at one end of the seam 504 (corresponding tab 512 at the other end of the seam 504 is not shown in FIG. 12). Since the bag 501 is formed from a continuous sheet of material, formation of the cut-out 511 (removal of material) at one end of the bag 501 results in a tab (extra material; not shown in FIG. 12) at the other end of the bag 501. The cut out 511 and tab (not shown in FIG. 12) extend into the seam 504, and also serve to further prevent breakage, leakage of contents out of the bag, or infestation of organisms into the contents of the bag. The cut-out 511 and tab (not shown) can be any depth/height desired, and can extend further into the seam as desired (not shown). Although in FIG. 12 the cut-out 511 (and corresponding tab, not shown) is shown as extending from within the seam 504 to the edge of the rear panel 503*b* of the bag, in other embodiments (not shown) the cut-out (and tab) can extend from within the seam 504 only a portion of the distance to the edge of the rear panel 503*b* of the bag. Additionally, in other embodiments (not shown), the bag can comprise an easy open or easy access feature, such as the weakened portion near the top of the bag as shown herein above (for example in FIG. 8), or the easy open features detailed in United States Patent Application Publication Number US 2013/0206631 and United States Patent Application Publication Number US 2013/0209002, each of which is incorporated by reference herein in its entirety.

Referring to FIG. 13A, shown is an outline of a portion of one end of a bag 600 with a step cut end, generally corresponding to a mirror image of the region marked as "A" in FIG. 11, detailing an alternate embodiment with angled portions between the front panel 602 of the bag and the first section of the side wall 607', between the first section of the side wall 607' and the second section of the side wall 607", and between the second section of the side wall 607" and the back panel 603 of the bag, respectively, and a feature 613 at one end of the bag that extends into the seam. Since the bag 600 is formed from a continuous sheet of material, the feature 613 forms a cut-out 611 (removal of material; see FIG. 13B) at one end of the bag and a tab 612 (extra material; see FIG. 13C) at the other end of the bag. FIG. 13B shows an image of one end of the bag depicted in FIG. 13A upon sealing the seam 604, showing cut-out 611. FIG. 13C shows an image of the other end of the bag depicted in FIG. 13A upon sealing the seam 604, showing the tab 612.

Referring to FIG. 14A, shown is an outline of a portion of one end of a bag 700 with a step cut end, generally corresponding to a mirror image of the region marked as "A" in FIG. 11, detailing an alternate embodiment with a combination of radial and angled cuts between the front panel 702 of the bag and the first section of the side wall 707', between the first section of the side wall 707' and the second section of the side wall 707", and between the second section of the side wall 707" and the back panel 703 of the bag, respectively, and a feature 713 at one end of the bag 700 that extends into the seam. Since the bag 700 is formed from a continuous sheet of material, the feature 713 forms a cut-out 711 (removal of material; see FIG. 14B) at one end of the bag 700 and a tab 712 (extra material; see FIG. 14C) at the other end of the bag 700. FIG. 14B shows an image of one end of the bag depicted in FIG. 14A upon sealing the seam 704, showing cut-out 711. FIG. 14C shows an image of the other end of the bag depicted in FIG. 14A upon sealing the seam 704, showing the tab 712.

Figures 51A, 51B, 51C:
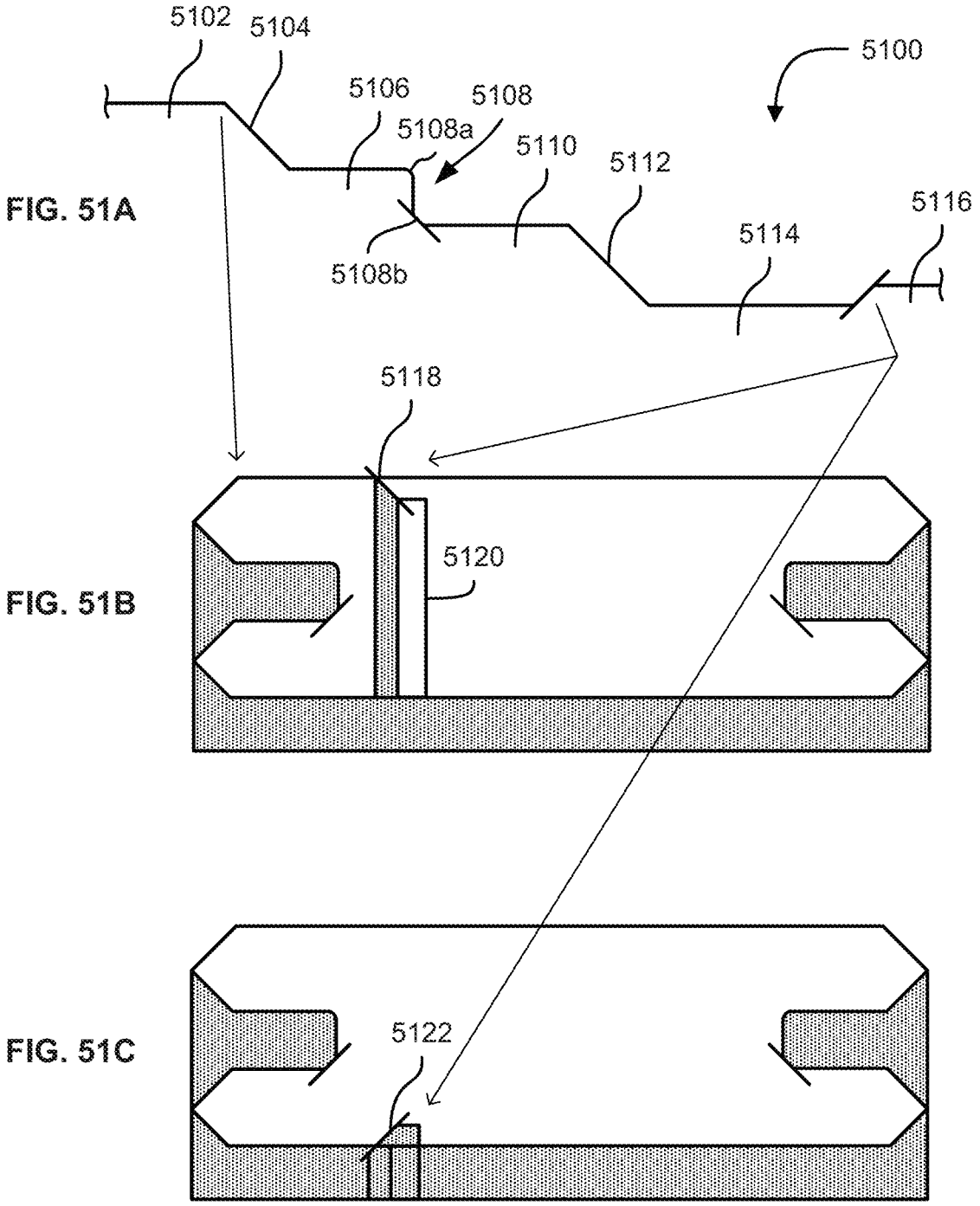
FIG. 51A shows an outline of a portion of one end of a bag with a step cut end, corresponding to a mirror image of the region marked as "A" in FIG. 11, detailing an alternate embodiment with a combination of radial (circular) and angled portions between the back panel of the bag and the side wall, between the two sections of the side wall, and between the side wall and the front panel of the bag, and a tab feature at one end of the bag that extends into the seam.
FIG. 51B shows an image of the top end of the bag depicted in FIG. 51A upon sealing the seam.
FIG. 51C shows an image of the bottom end of the bag depicted in FIG. 51A upon sealing the seam.

Referring to FIG. 51A, shown is an outline of a portion of one end of a bag 5100 with a step cut end, generally corresponding to a mirror image of the region marked as "A" in FIG. 11, detailing an alternate embodiment with a combination of radial and angled cuts between the front panel 5102 of the bag and the first section of the side wall 5106, between the first section of the side wall 5106 and the second section of the side wall 5110, and between the second section of the side wall 5110 and the back panel 5114 of the bag, respectively, and a feature 5116 at one end of the bag 5100 that extends into the seam. Since the bag 5100 is formed from a continuous sheet of material, the feature 5116 forms a cut-out 5118 (removal of material; see FIG. 51B) at one end of the bag 5100 and a tab 5122 (extra material; see FIG. 51C) at the other end of the bag 5100. FIG. 51B shows an image of one end of the bag depicted in FIG. 51A upon sealing the seam 5120, showing cut-out 5118. FIG. 51C shows an image of the other end of the bag depicted in FIG. 51A upon sealing the seam 5120, showing the tab 5122.

The step cut profile shown in FIG. 51A includes angled step cuts of a variety of shapes and angles. A first step cut 5104 adjacent the front panel 5102, includes an angled cut without a separate vertical portion, as shown in FIGS. 14-14 above. The first step cut 5104 is at a particular angle, variable over a large range of angles, for example between ten degrees and eighty degrees with respect to the top edge of front panel 5102. A second step cut 5108 includes a curved cut 5108*a* as well as an angled cut 5108*b*. The curved cut 5108*a* may be a cut having a constant radius, may be elliptical, parabolic, or otherwise curved. The angled cut 5108*b* is positioned below the curved cut 5108*a* and separated by a vertical portion of the second step cut 5108. A third step cut 5112, adjacent the back panel 5114 is shown with a single angled cut, similar to the first step cut 5104. In some examples, the first step cut 5104 and the second step cut 5112 may include angled cuts at different angles, or may be at or about the same angle. Additionally, the length or distance traversed over the step cuts may vary, in addition to a spacing or distance between adjacent step cuts, such as by varying a width of the first section of the side wall 5106 and a width of the second section of the side wall 5110. In some examples additional step cuts may be introduced between the first step cut 5104 and the third step cut 5112. For example, a total of four or more step cuts may be included in the step cut profile. Additional step cuts may be included for purposes of including second, third, or fourth gussets to the side wall, thereby dividing the side wall into an additional third section, fourth section, and other sections as determined by the number and placement of additional gussets. Furthermore, the step cut profile shown in FIG. 51A may be used for one side of the top of the bag 5100. In some examples, the left and right sides of the bag 5100 may include different step cut profiles, for example to accommodate different styles of bags and different opening panels, such as the easy open panels described herein.

Figure 52A:
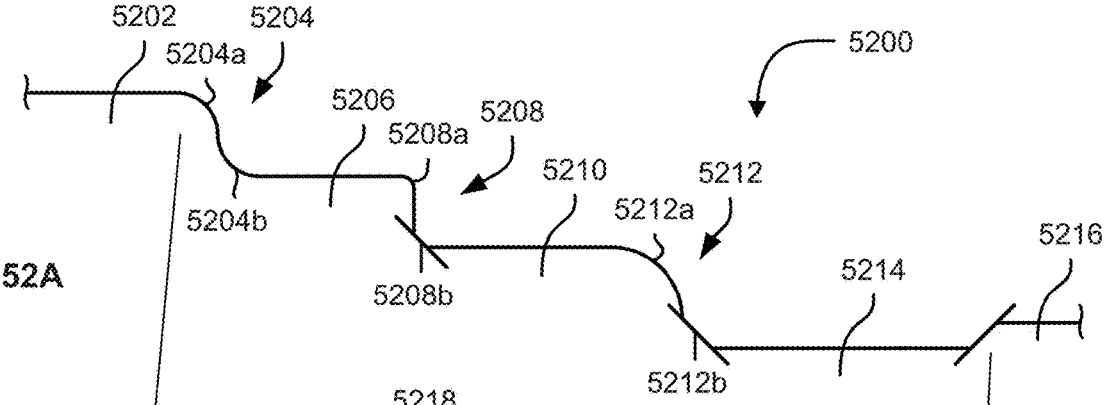
FIG. 52A shows an outline of a portion of one end of a bag with a step cut end, corresponding to a mirror image of the region marked as "A" in FIG. 11, detailing an alternate embodiment with a combination of radial (circular) and angled portions between the back panel of the bag and the side wall, between the two sections of the side wall, and between the side wall and the front panel of the bag, and a tab feature at one end of the bag that extends into the seam.
Figure 52B:
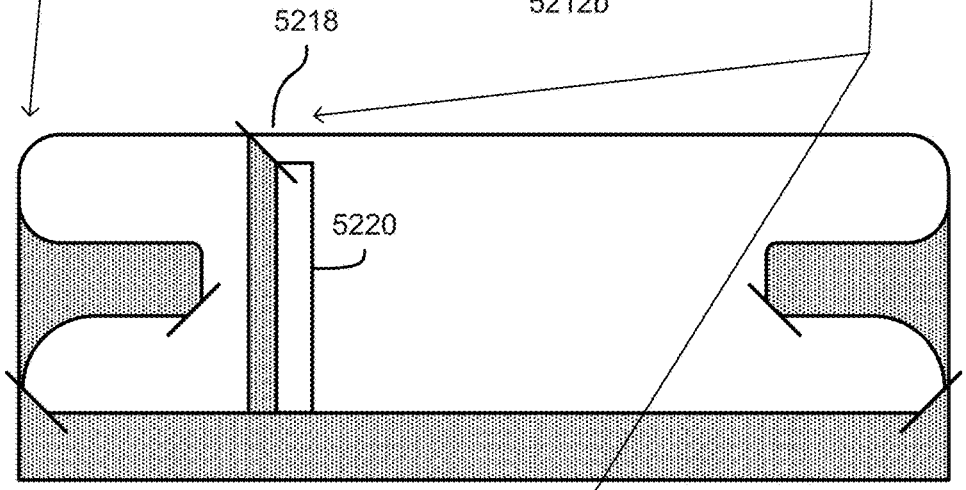
FIG. 52B shows an image of the top end of the bag depicted in FIG. 52A upon sealing the seam.
Figure 52C:
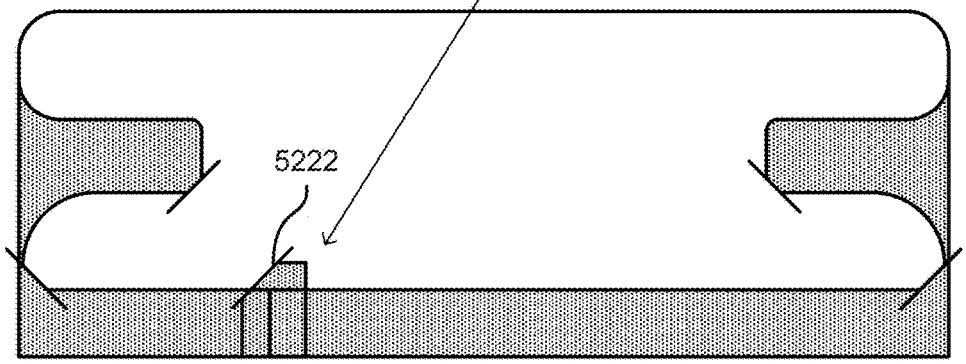
FIG. 52C shows an image of the bottom end of the bag depicted in FIG. 52A upon sealing the seam.

Referring to FIG. 52A, shown is an outline of a portion of one end of a bag 5200 with a step cut end, generally corresponding to a mirror image of the region marked as "A" in FIG. 11, detailing an alternate embodiment with a combination of radial and angled cuts between the front panel 5202 of the bag and the first section of the side wall 5206, between the first section of the side wall 5206 and the second section of the side wall 5210, and between the second section of the side wall 5210 and the back panel 5214 of the bag, respectively, and a feature 5216 at one end of the bag 5200 that extends into the seam. Since the bag 5200 is formed from a continuous sheet of material, the feature 5216 forms a cut-out 5218 (removal of material; see FIG. 52B) at one end of the bag 5200 and a tab 5222 (extra material; see FIG. 52C) at the other end of the bag 5200. FIG. 52B shows an image of one end of the bag depicted in FIG. 52A upon sealing the seam 5220, showing cut-out 5218. FIG. 52C shows an image of the other end of the bag depicted in FIG. 52A upon sealing the seam 5220, showing the tab 5222.

The step cut profile shown in FIG. 52A includes angled and curved step cuts of a variety of shapes and angles. A first step cut 5204 adjacent the front panel 5202, includes a first curved cut 5204*a* and a second curved cut 5204*b* having curves in two different directions, with a curvature in opposite directions. The curvature may be in different directions rather than opposite from one another in some examples. The first step cut 5204 is shown with two circular cuts that meet at a midpoint of the height of the first step cut 5204. In some examples the first step cut 5204 may include a vertical portion, for example when the first curved cut 5204*a* and the second curved cut 5204*b* have a radius of less than half the height of the first step cut 5204. The first curved cut 5204*a* and the second curved cut 5204*b* may each be a cut having a radius, may be elliptical, parabolic, or otherwise curved. A second step cut 5208 includes a curved cut 5208*a* as well as an angled cut 5208*b*. The curved cut 5208*a* is at the top edge of the second step cut 5208 and is shown with a radius smaller than a radius of the cuts of the first step cut 5204. The angled cut 5208*b* is positioned below the curved cut 5208*a* and separated by a vertical portion of the second step cut 5208. A third step cut 5212, adjacent the back panel 5214 is shown with a curved cut 5212*a* and an angled cut 5212*b*, similar to the second step cut 5208, but is shown with the curved cut 5212*a* having a larger radius than the radius of the curved cut 5208*a* of the second step cut 5208. Similar to the embodiment described above with respect to FIG. 51, the length or distance traversed over the step cuts may vary, in addition to a spacing or distance between adjacent step cuts, such as by varying a width of the first section of the side wall 5206 and a width of the second section of the side wall 5210. In some examples additional step cuts may be introduced between the first step cut 5204 and the third step cut 5212. For example, a total of four or more step cuts may be included in the step cut profile. The introduction of additional step cuts may reduce a height of each step cut. In some examples, the heights of the step cuts may vary, for example with the first step cut 5204 at a first height and the second step cut 5208 at a second height, different from the first height. Additional step cuts may be included for purposes of including second, third, or fourth gussets to the side wall, thereby dividing the side wall into an additional third section, fourth section, and other sections as determined by the number and placement of additional gussets. Additional combinations of angled and curved cuts are envisioned, other than the specific embodiment shown and described with respect to FIGS. 52A-C and are intended to be covered by this description.

Figure 53A:
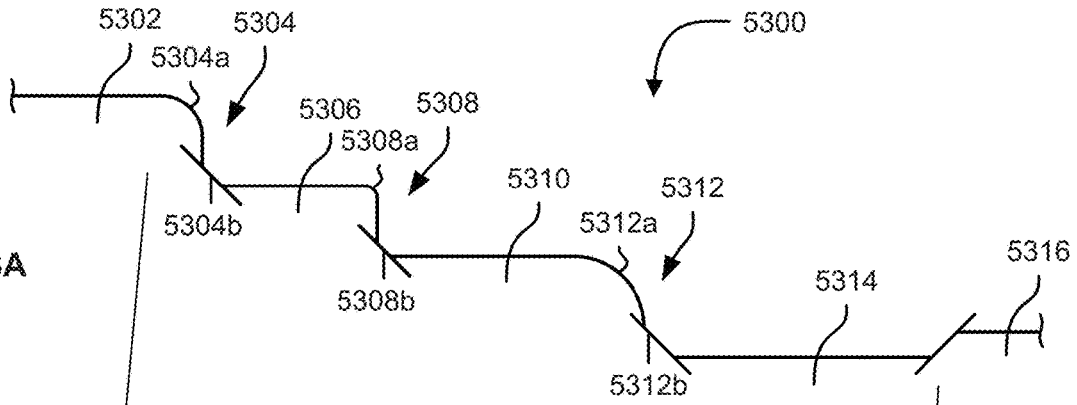
FIG. 53A shows an outline of a portion of one end of a bag with a step cut end, corresponding to a mirror image of the region marked as "A" in FIG. 11, detailing an alternate embodiment with a combination of radial (circular) and angled portions between the back panel of the bag and the side wall, between the two sections of the side wall, and between the side wall and the front panel of the bag, and a tab feature at one end of the bag that extends into the seam.
Figure 53B:
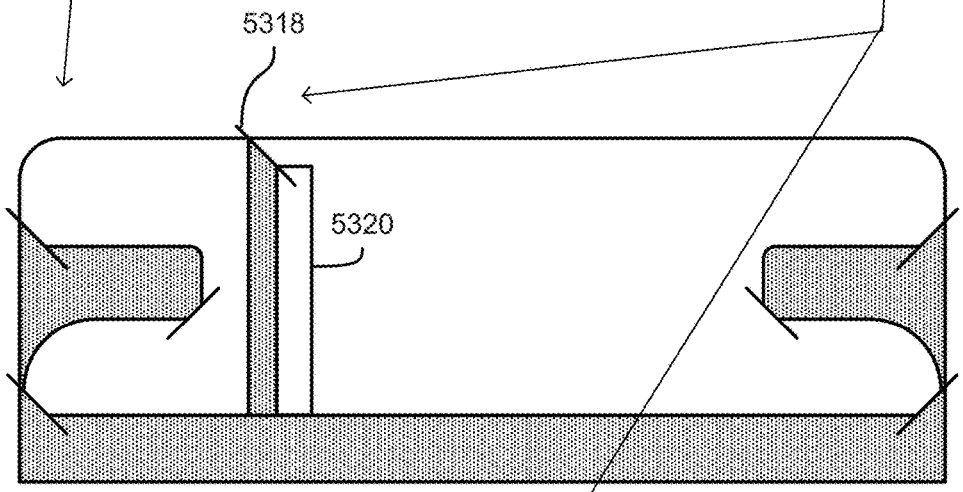
FIG. 53B shows an image of the top end of the bag depicted in FIG. 53A upon sealing the seam.
Figure 53C:
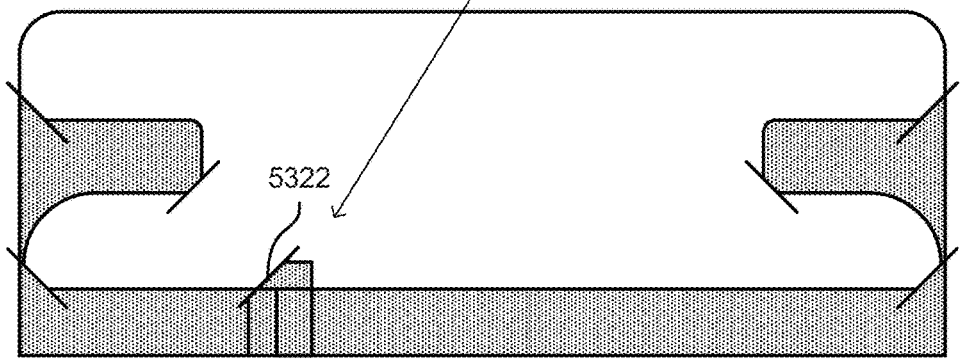
FIG. 53C shows an image of the bottom end of the bag depicted in FIG. 53A upon sealing the seam.

Referring to FIG. 53A, shown is an outline of a portion of one end of a bag 5300 with a step cut end, generally corresponding to a mirror image of the region marked as "A" in FIG. 11, detailing an alternate embodiment with a combination of radial and angled cuts between the front panel 5302 of the bag and the first section of the side wall 5306, between the first section of the side wall 5306 and the second section of the side wall 5310, and between the second section of the side wall 5310 and the back panel 5314 of the bag, respectively, and a feature 5316 at one end of the bag 5300 that extends into the seam. Since the bag 5300 is formed from a continuous sheet of material, the feature 5316 forms a cut-out 5318 (removal of material; see FIG. 53B) at one end of the bag 5300 and a tab 5322 (extra material; see FIG. 53C) at the other end of the bag 5300. FIG. 53B shows an image of one end of the bag depicted in FIG. 53A upon sealing the seam 5320, showing cut-out 5318. FIG. 53C shows an image of the other end of the bag depicted in FIG. 53A upon sealing the seam 5320, showing the tab 5322.

The step cut profile shown in FIG. 53A includes angled step cuts of a variety of shapes and angles. A first step cut 5304 adjacent the front panel 5302, includes an curved cut 5304*a* as well as an angled cut 5304*b*. In some examples the first step cut 5304 may include a vertical portion, for example when the curved portion 5304*a* and the angled portion 5304*b* do not traverse the entire height of the first step cut 5304. The curved cut 5304*a* may be a cut having a radius, may be elliptical, parabolic, or otherwise curved. A second step cut 5308 includes a curved cut 5308*a* as well as an angled cut 5308*b*. The curved cut 5308*a* is at the top edge of the second step cut 5308 and is shown with a radius smaller than a radius of the cuts of the first step cut 5304. The angled cut 5308*b* is positioned below the curved cut 5308*a* and separated by a vertical portion of the second step cut 5308. A third step cut 5312, adjacent the back panel 5314 is shown with a curved cut 5312*a* and an angled cut 5312*b*, similar to the second step cut 5308 and the first step cut 5304, but is shown with the curved cut 5312*a* having a larger radius than the radius of the curved cut 5308*a* of the second step cut 5308 and the radius of the curved cut 5304*a* of the first step cut 5304. The third step cut 5312 additionally may not include a straight vertical portion, but may, for example transition from the curved portion 5312*a* directly into the angled portion 5312*b*. In some examples, the angled cut 5312*b* may be above the curved cut 5312*a*, such that the top edge of the third step cut 5312 has the angled cut 5312*b* and the bottom of the third step cut 5312 includes the curved cut 5312*a*. Similar to the embodiment described above with respect to FIGS. 51-52, the length or distance traversed over the step cuts may vary, in addition to a spacing or distance between adjacent step cuts, such as by varying a width of the first section of the side wall 5306 and a width of the second section of the side wall 5310. In some examples additional step cuts may be introduced between the first step cut 5304 and the third step cut 5312. For example, a total of four or more step cuts may be included in the step cut profile. The introduction of additional step cuts may reduce a height of each step cut. In some examples, the heights of the step cuts may vary, for example with the first step cut 5304 at a first height and the second step cut 5308 at a second height, different from the first height. Additional step cuts may be included for purposes of including second, third, or fourth gussets to the side wall, thereby dividing the side wall into an additional third section, fourth section, and other sections as determined by the number and placement of additional gussets. Additional combinations of angled and curved cuts are envisioned, other than the specific embodiment shown and described with respect to FIGS. 53A-C and are intended to be covered by this description.

Each of the step cut profiles shown in FIGS. 1, 8, 9, 11-14, 51-53, and other such step cut profiles may be cut through the use of a laser. The laser may be guided by a computer numerical control (CNC) machine pre-programmed to cut the step cut profile. The step cut profiles can also be formed by punching, cutting, or by another suitable technique known to those in with skill in the art.

The step cut profile of the bag is cut while the substrate is in a flat configuration and subsequently folded and sealed to form the bag from the substrate. For example, with reference to FIG. 12 as an illustrative example, creases may be formed in the substrate at each of the step cuts of the top or bottom edges. The creases may, for example extend vertically from the top to the bottom of the bag and may be tangential to the step cut profile or may extend from a lower edge of each step cut profile. The creases form the first side wall 505 and the second side wall 507 and divide each side wall into a front side wall and a rear side wall. A crease between the front side wall and the rear side wall, may form the first gusset 506. The gussets provide expansion to the bags when assembled. With reference to the step cut profiles and assembled views shown in FIGS. 13-14 and 51-53, the seam on the front panel or back panel is used to seal couple opposite edges of the bag together to form a tube-like shape. Subsequently, the top and bottom profiles are folded, for example as shown and described with respect to FIGS. 1-6 and 31-36.

Figure 15A:
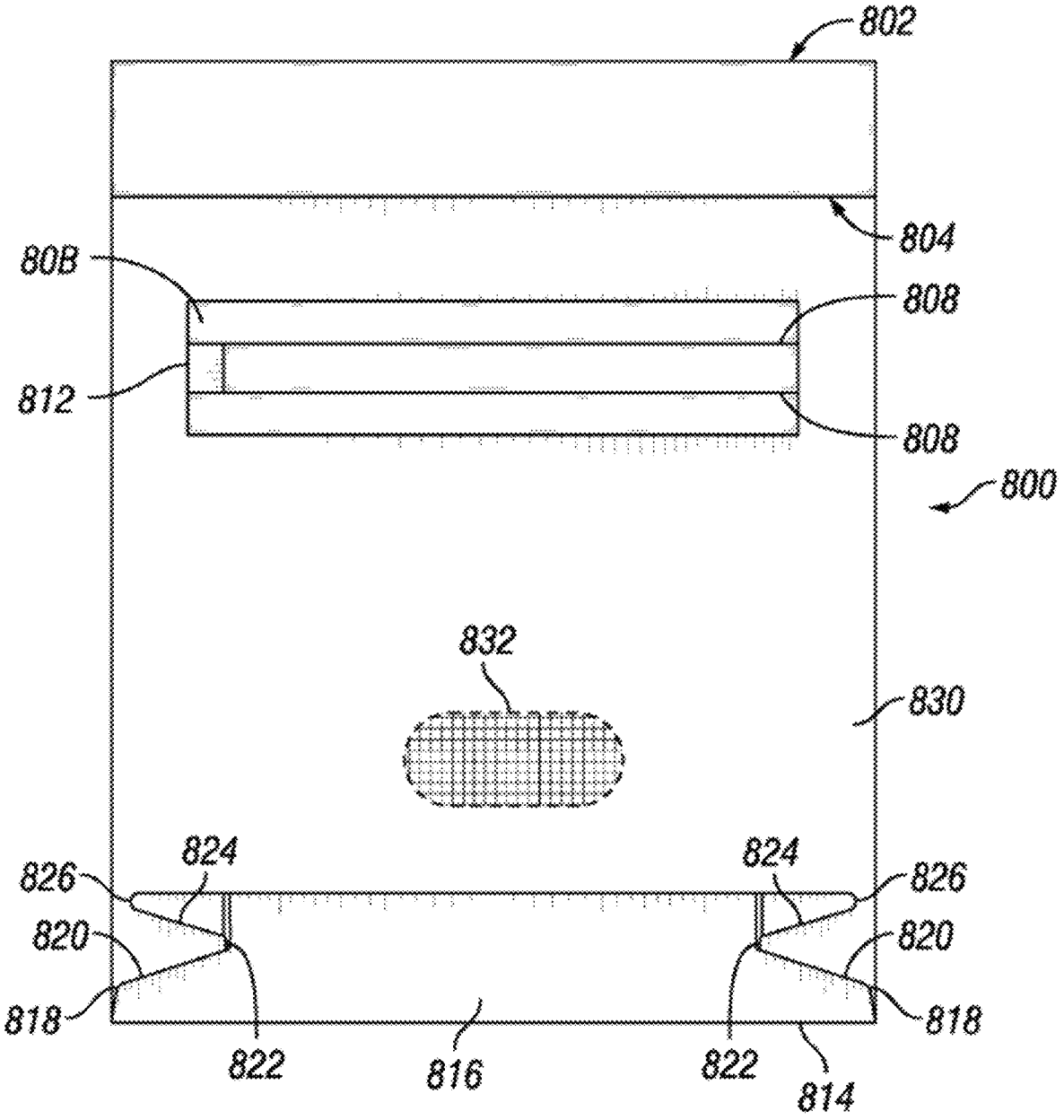
FIG. 15A is a depiction of a bag with a sealing tape covering an easy open feature.
Figure 15B:
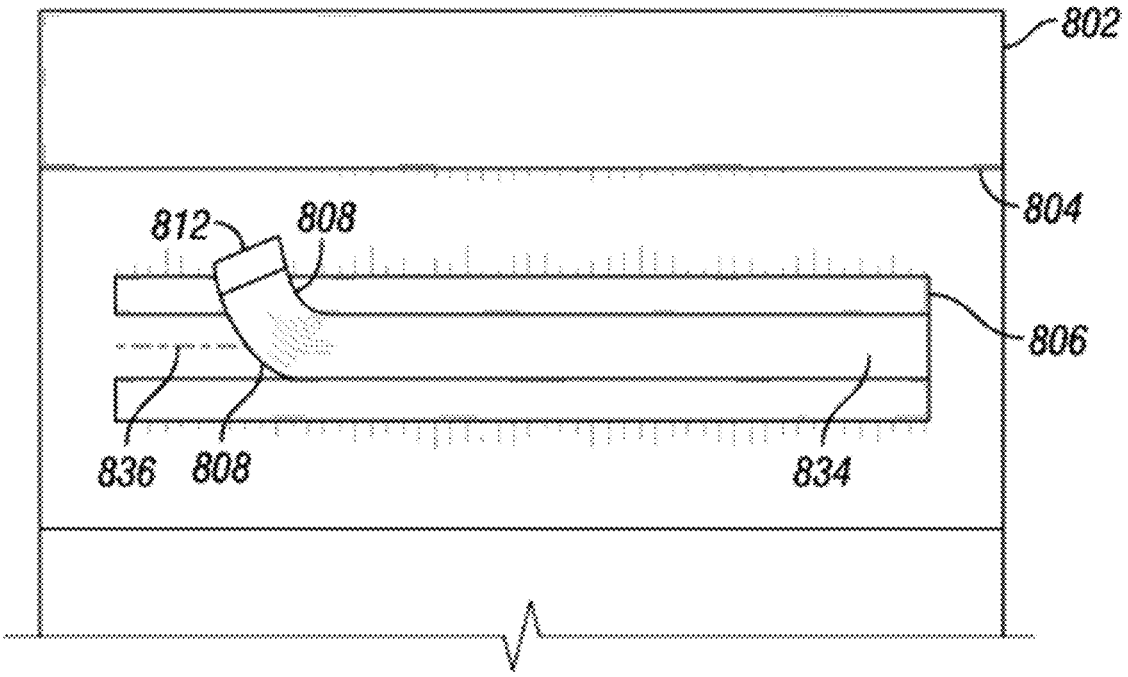
FIG. 15B is a depiction of the bag of claim 15A with the sealing tape over the easy open feature partially opened along the lines of the two strings.
Figure 15C:
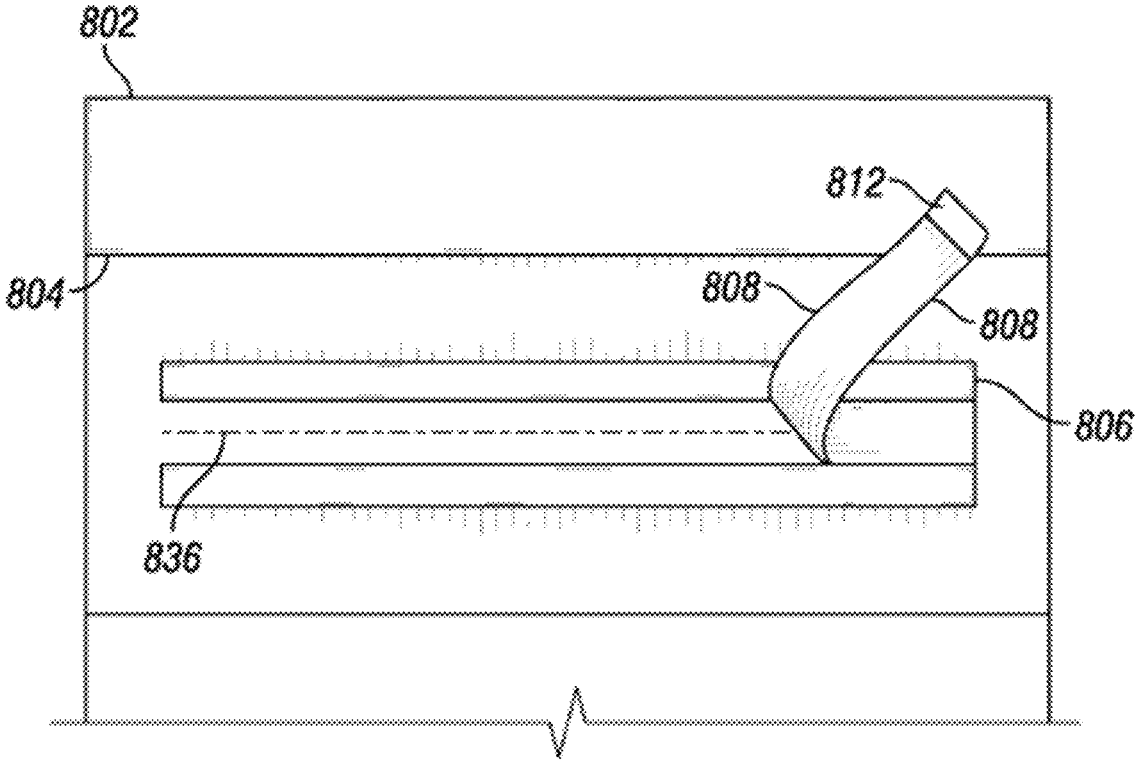
FIG. 15C is a depiction of the bag of claim 15B with the easy open feature almost completely uncovered.

A partial view of a bag with an easy open feature is shown in FIG. 15A-C. In FIG. 15A, bag 800 is an example of a bag with the disclosed sealing tape covered weakened area. The top or bottom end 802 is sealed in FIG. 15A by folding the top over to a seal line 804 and bonding to seal the opening. A cut out in the surface of the bag is shown to reveal the inner, woven polymer layer of a multi-layered bag as described herein, in which laminated bags can be composed of two or more layers including a woven polymer layer. In certain embodiments, the woven polymer layer includes woven strips of polypropylene, high density polyethylene, low density polyethylene, polyester, or combinations of any thereof. The polymer strips are understood to be flat, planar strips woven into a sheet by crossed strips referred to as warps and wefts, or woofs. In certain embodiments the strips are about ⅛ to ¼ inch wide flat strips. A second layer can include polypropylene, polyethylene, polyethylene terephthalate, polyamide, or any combination thereof, or it can include oriented polypropylene, biaxially-oriented polypropylene, oriented polyethylene, biaxially-oriented polyethylene, oriented polyethylene terephthalate, biaxially-oriented polyethylene terephthalate, oriented polyamide, biaxially-oriented polyamide, coated paper or any combination thereof, and can include a printed area thereon. In some examples, the second layer, and the first layer described herein, may consist essentially of any combination of one or more of the materials described above.

An easy open feature includes a sealing tape 806 covering a weakened area (visible in FIGS. 15B and 15C). The sealing tape includes two strings 808 affixed to the bottom or embedded in the sealing tape and running the length of the scaling tape and a tab 812 at one end. The tab area is not affixed to the surface of the bag, and in certain embodiments is free of adhesive and in certain embodiments is free of adhesive at least on the bottom surface. As seen in FIG. 15A, the unsealed end 814 of the bag is step cut as described herein wherein the junctions 818 between the back wall 816, the back 820 and front side walls 824 at the gusset fold lines 822, and the junction 826 of the front side wall with the front wall 830 are curves, non-right angles or combinations of curves and non-right angles.

FIG. 15B is a view of the bag of FIG. 15A in which the sealing tape has been partially raised in preparation for opening the bag by pulling up on the tab 812 separating the center section of the tape 834 along the line of the strings 808 and exposing the weakened area 836 in the front wall 830 of the bag. FIG. 15C shows a bag in which the center section of the sealing tape is further removed, exposing more of the weakened area. In the embodiment shown the weakened area is a line of perforations. When the center portion of the sealing tape is removed, the bag can be easily opened by pushing or running a finger along the line of perforations. The easy open feature that is composed of a line of perforations or cuts 836 is visible below the area where the tape has been lifted off the surface of the bag. In FIG. 15C the tape has been further removed revealing more of the weakened area 836.

Figure 16C:
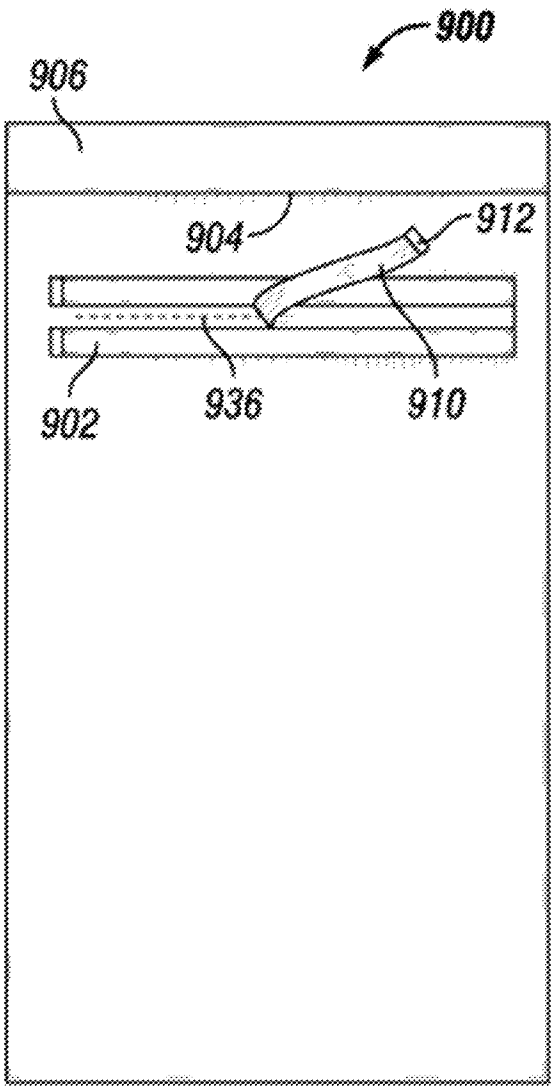
FIG. 16A-C are depictions of a bag with a sealing tape and a narrower strip of tape adhered to the top of the sealing tape in a closed (A) state, with the tab piece raised (B) and further opened (C).
Figure 16B:
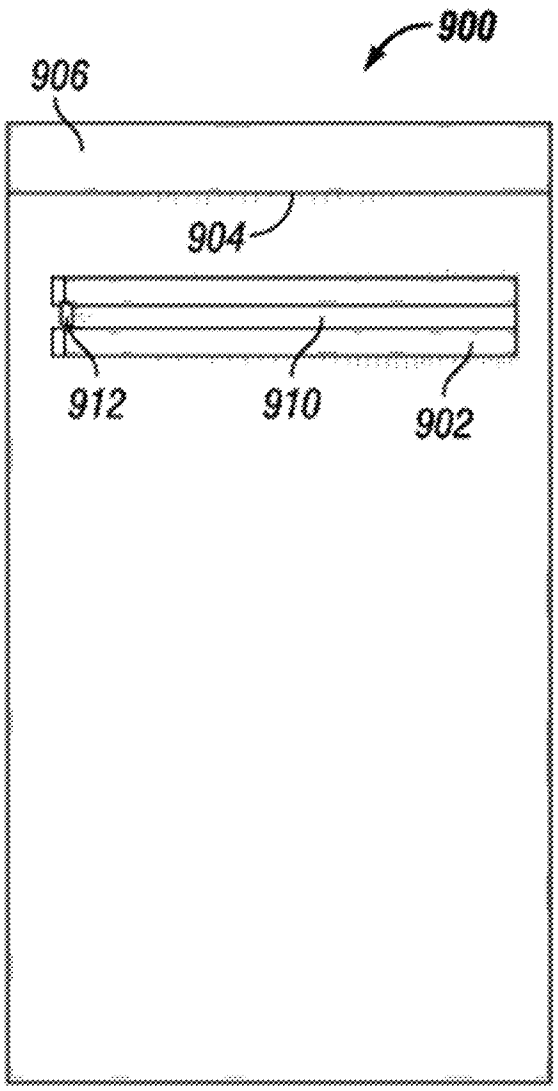
Figure 16A:
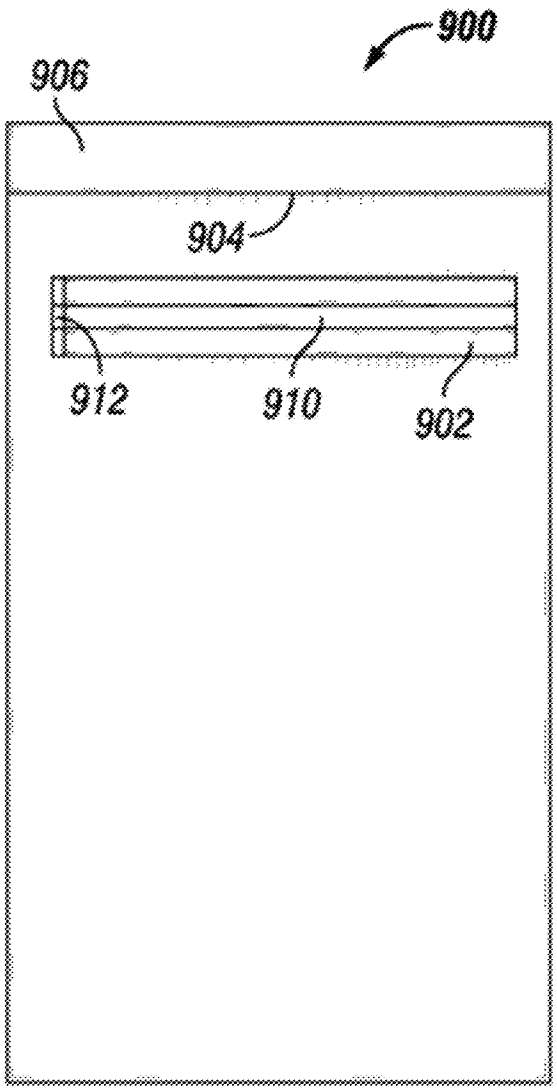

A partial view of a bag with an easy open feature is shown in FIG. 16A-C. In FIG. 16A, bag 900 is an example of a bag with a sealing tape covered weakened area. The top or bottom end, 906 which is nearer to the easy open feature, is sealed in FIG. 16A by folding the top over to a seal line 904 and bonding to seal the opening. An easy open feature includes a sealing tape 902 covering a weakened area. The sealing tape includes a narrower strip of tape 910 affixed to the surface of the bag or to the bottom or top surface of the sealing tape and running the length of the sealing tape. The sealing tape includes a tab 912 at one end. The tab area is not affixed to the surface of the bag, and in certain embodiments is free of adhesive and in certain embodiments is free of adhesive at least on the bottom surface. FIG. 16B is a view of the bag of FIG. 16A in which the narrower strip of tape 910 down the center of the sealing tape 902 has been lifted by the tab end in which the tab 912 is shown not to be adhered to the surface of the bag. FIG. 16C is a view of the bag in which the tape has been lifted by the tab end to partially reveal the weakened area 914 in the surface of the bag below the tape.

Figure 17A:
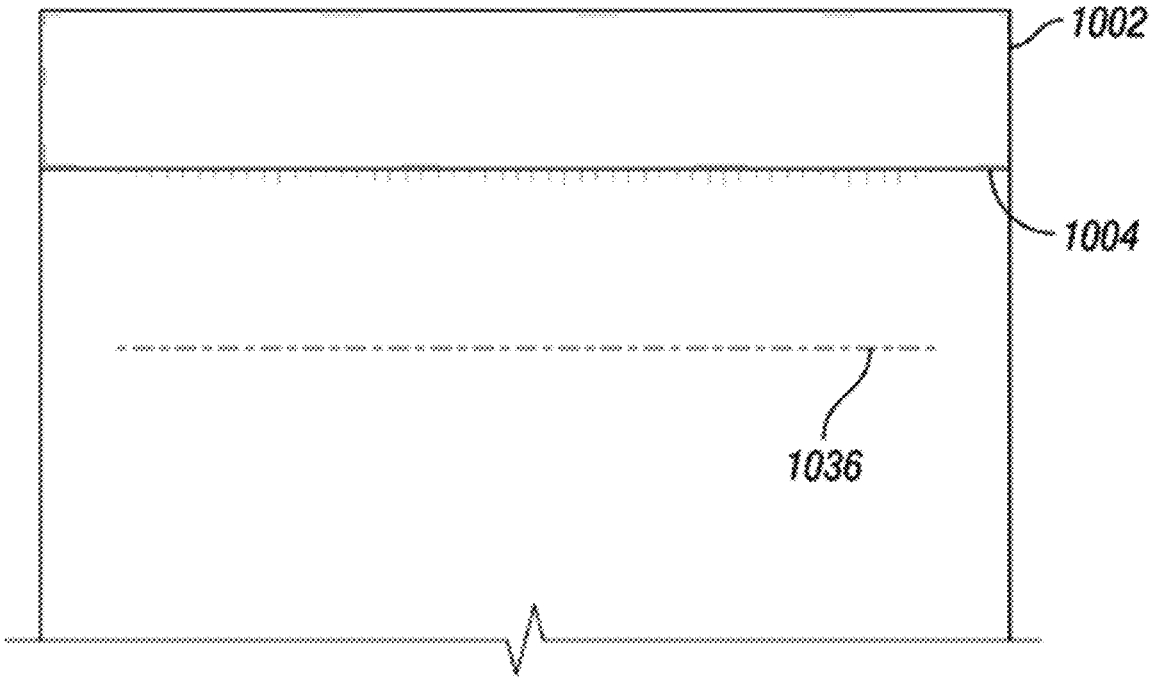
FIG. 17A is a depiction of a bag of the disclosure with an easy open feature.
Figure 17B:
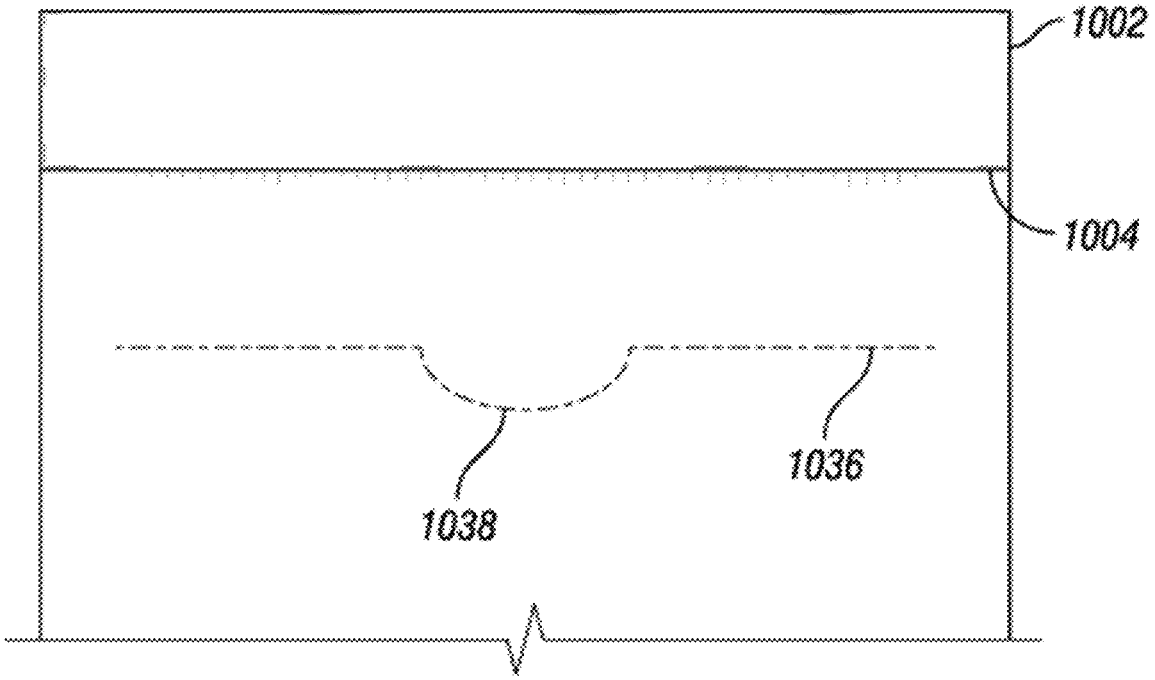
FIG. 17B is a depiction of a bag of the disclosure with an easy open feature includes a thumb tab.

FIGS. 17A and 17B are partial views of a bag with an easy open feature as described for the bags shown in FIGS. 15A-C and/or 16A-C in which the sealing tape has not been applied. The weakened area shown in FIG. 17A is a line of perforations 1036 extending across the face of the front or rear wall of the bag in a line substantially parallel to the sealed top or bottom edge 1002 of the front or back wall of the bag. The bag is sealed by folding over the edge to a seal line 1004 and bonding the folded portion to the face of the front or back wall to seal the bag. The bag shown in FIG. 17B is similar, including a top edge 1002 and seal line 1004. In the embodiment shown in FIG. 17B, the weakened area 1036 includes a curve near the center of the weakened area that serves as a thumb tab 1038. It is understood that a weakened area can include alternate configurations of perforations or cuts, including but not limited to 2 rows of cuts or perforations, either in parallel or crossing to form an "X", or cuts or perforations that extend from the center of the weakened area in a downward or upward direction relative to the closest end of the bag.

In certain embodiments of the disclosure, the disclosed bags can be laminated woven sacks or bags. In certain embodiments the bags are composed of two or more laminated layers including an inner layer comprised of woven polymer strips. Polymer strips can be extruded polyethylene or polypropylene cut into flat strips of about ⅛ to ¼ inch in width and woven to produce a continuous woven sheet that is then cut into individual bag blanks. The woven layer can be laminated to a polymer film such as a polyester or polypropylene film, and the two layers can be laminated by a third polyethylene or polypropylene film that laminates the first two layers. The second layer of polymer film can also include graphics printed thereon including reverse printed graphics in order to provide an attractive display for commercial purposes. There are certain advantages to providing all three layers in the same polymer such as polypropylene or polyethylene, in that such bags are more easily recycled, for example. For example, a bag having its walls comprise a laminate which has two or three (or more) layers, wherein each of the bag wall layers comprises or consists essentially of the same polymer (such as polypropylene or polyethylene), may not use an adhesive material and thus is a non-adhesive laminate, is easy to recycle. In some examples, polyethylene bags, or bags that consist essentially of polyethylene may include up to ten percent polypropylene without interfering with the recyclability of the polyethylene, and polypropylene up to that threshold may be introduced for various purposes without compromising the recyclability. Moreover, any scrap or unusable bags resulting from manufacturing can be recycled as well.

The woven strips create a bag with the requisite strength to hold large amounts of material under stress and are typically not used in smaller bags, holding ten pounds or less because of the increased cost and complexity of producing heavy duty bags. An inner layer of woven flat polymer strips is shown in FIG. 15A as inset 832.

It should be understood that the perforations may include or may be replaced with cuts which are longer, and may include cuts in various shapes in addition to the thumb tab, and the bags of the present disclosure may have both cuts and perforations. In addition, the cuts and/or perforations may extend entirely through all layers of the bag wall, or may extend through one or more of the bag wall and not through one or more other layers. For example, the perforations may extend through one or more outer film layers and partially but not entirely through the woven layer. In addition, it is noted that the cuts and/or perforations may include one or more cuts and/or perforations which extend through all three bag layers and others which do not, and may include cuts and/or perforations which extend deeper through one or more layers than other cuts and/or perforations. It is further noted that the cuts and/or perforations may vary in size and/or in shape, such that, for example, one or more cuts or perforations are greater in length and/or width (and/or depth) than one or more other cuts and/or perforations.

The sealing tape and/or fibers may comprise polymers, such as polypropylene, polyethylene, or combinations thereof, and can include woven polymers or woven polymer strips. A bag may include two, three, or possibly more layers, as well as the tape and fibers, which may all comprise a single material composition, thus making it much easier to recycle a bag or scrap for manufacturing purposes and also to minimize the costs of the bag. For example, the bag wall layers (whether two, three, four, or more layers) may comprise a non-adhesive laminate which is made of a single polymer (such as polyethylene or polypropylene), with the strings and tape also made of the same material or combination thereof as the bag wall layers. In one embodiment, the strings may themselves comprise a braided or woven string with one or more separate fibers or strings braided together (or woven together) to provide greater strength.

In still another embodiment (not shown), a sealing tape and substantially parallel strings may be added to the interior surface of the bag wall. In such an embodiment, a pull tab is provided which extends from the tape and from the exterior surface of the bag wall, or a pull tab can be added to the tape. In such an embodiment, a customer can pull the pull tab and the tape may pull the bag wall defined by the cuts and/or perforations (i.e., the weakened area of the bag wall) with the tape, thus providing an opening for access to the bag contents.

Figure 18:
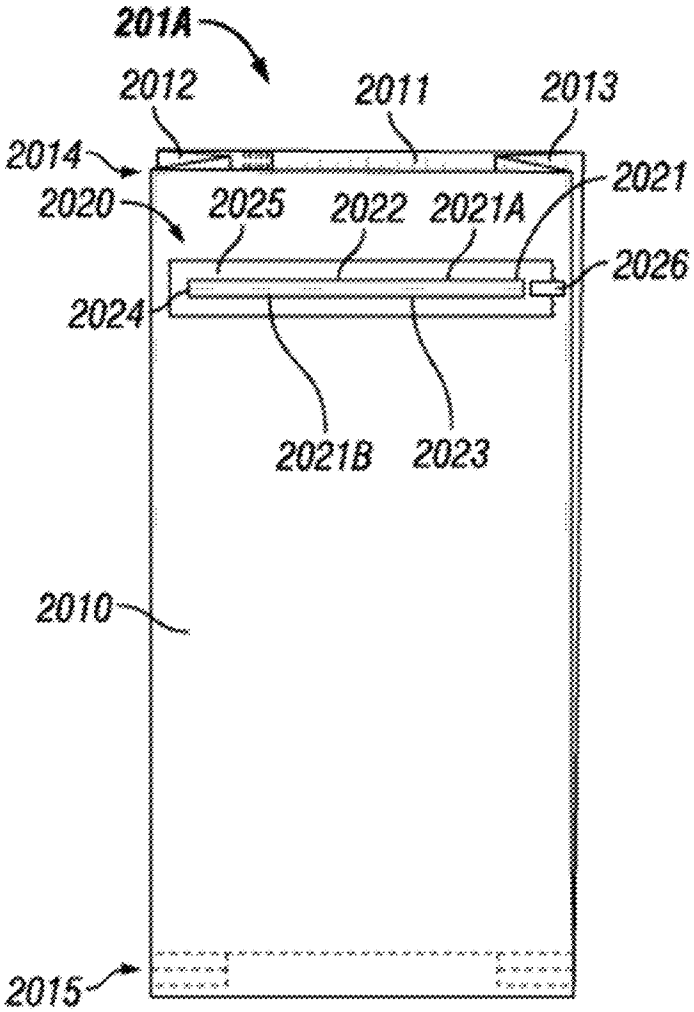
FIG. 18 shows a flush cut bag with an easy open feature comprising a square cut through the bag located near the top end of the bag according to one embodiment of the present disclosure.

Referring to FIG. 18, the front side view of an embodiment of a "flush cut" bag 2001*a* is shown. Bag 2001*a* has a front wall 2010, a back wall 2011, a first side wall 2012, a second side wall 2013, a top end 2014, and a bottom end 2015. It is noted, however, that the orientation of the bag ends 2014 and 2015 may be relative, while the "top" and "bottom" references may change depending on the orientation that the bag is viewed. Bag 2001*a* is considered a "flush cut" bag because the front wall 2010 and the back wall 2011 are cut so that the ends of the front wall 2010 and the back wall 2011 are essentially "flush" with one another; they have substantially the same length. Bag 2001*a* also comprises an easy open feature 2020 near the top end 2014 of the bag 2001*a*, which in this embodiment comprises a full cut 2021 in a rectangular shape having a first end 2021*a* and a second end 2021*b* through the front wall 2010 of bag 2001*a*, a first row of perforations 2022 extending from the first end 2021*a* of the cut 2021, a second row of perforations 2023 extending from the second end 2021*b* of the cut 2021, an optional third row of perforations 2024 connecting the end of the first row of perforations 2022 and the second row of perforations 2023, tape 2025 covering the cut and the rows of perforations, and a pull tab 2026 attached to the tape 2025. Although in this embodiment the easy open feature 2020 is located near the top end 2014 of the bag 2001*a* and the pull tab is located close to the second side wall 2013, it is noted that the easy open feature 2020 could also be in the opposite orientation, with the pull tab located closer to the first side wall 2012, reside in either orientation near the bottom end 2015 of the front wall 2010 of bag 2001*a*, or reside in either orientation near the top end 2014 or bottom end 2015 on the back wall 2011 of the bag 2001*a*. The full cut 2021 can be formed by punching, cutting, or through the use of a laser, or by another suitable technique. The easy open feature 2020 (in this embodiment the cut 2021 and/or first 2022 or second 2023 row of perforations) provides a portion of bag 2001*a* that is weakened. This weakened portion can be opened with less force than applied to open or tear other portions of the bag 2001*a*.

Bag 2001*a* can be opened by pulling the pull tab 2026, which removes the tape 2025 and the portion of bag 2001*a* defined by the cut 2021 and the first, second, and third row of perforations 2022, 2023, and 2024, respectively. Although not shown in this embodiment, it is noted that the full cut 2021 can be larger or smaller, and can extend to a greater or lesser extent, and the first and second rows of perforations 2022 and 2023, respectfully, can extend any distance from the first end and second end, respectively, of the cut toward the opposite side wall of the bag, for example 50%, 75%, 90% or about 100% of the distance from the ends of the cut to the opposite side of the bag. In addition, although not shown in this embodiment, the tape 2025 can cover less than the full extent of the first and second rows of perforations, whatever distance the rows of perforations extend across the front wall of the bag, and in certain embodiments covers only the full cut portion of the easy open feature 2020. Additionally, the pull tab 2026 can comprise black and white and/or color printing (not shown), for example a coupon (not shown), and can also be used to reclose the bag.

Figure 19:
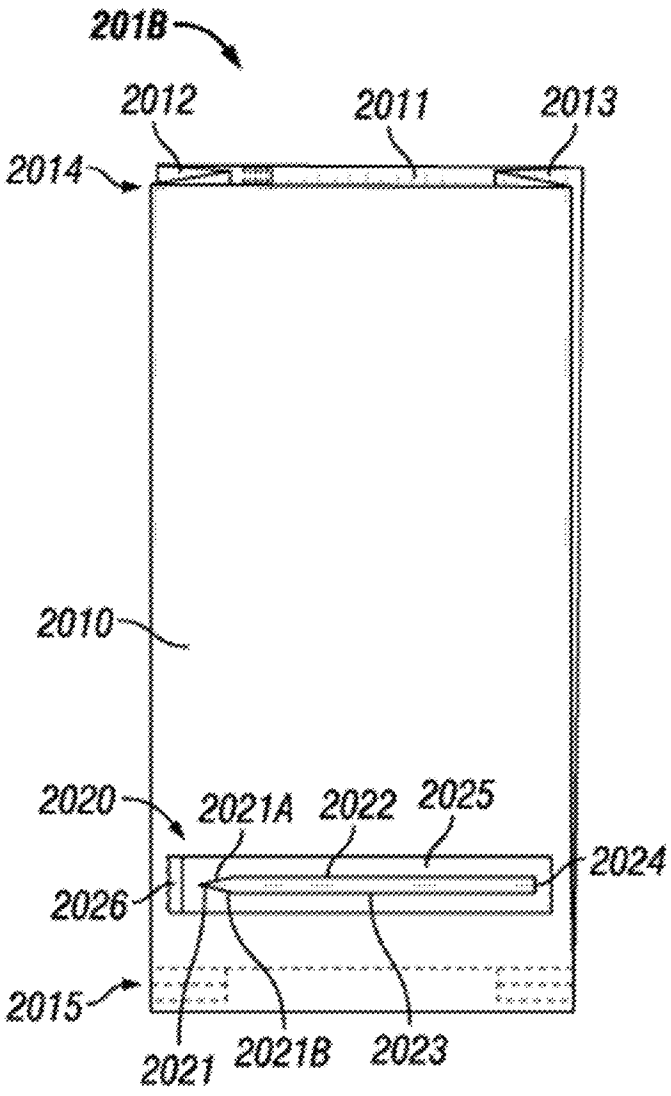
FIG. 19 shows a flush cut bag with an easy open feature comprising a carat cut through the bag located near the top end of the bag according to one embodiment of the present disclosure.

Referring to FIG. 19, the front side view of another embodiment of a flush cut bag 2001*b* is shown. Bag 2001*b* also has a front wall 2010, a back wall 2011, a first side wall 2012, a second side wall 2013, a top end 2014, and a bottom end 2015. Bag 2001*b* also comprises an easy open feature 2020, which in this embodiment is near the bottom end 2015 of the bag 2001*b* and comprises a full cut 2021 in a triangular or carat shape having a first end 2021*a* and a second end 2021*b* through the front wall 2010 of bag 2001*b*, a first row of perforations 2022 extending from the first end 2021*a* of the cut 2021, a second row of perforations 2023 extending from the second end 2021*b* of the cut 2021, an optional third row of perforations 2024 connecting the end of the first row of perforations 2022 and the second row of perforations 2023, tape 2025 covering the cut and the rows of perforations, and a pull tab 2026 attached to the tape 2025.

Figure 20:
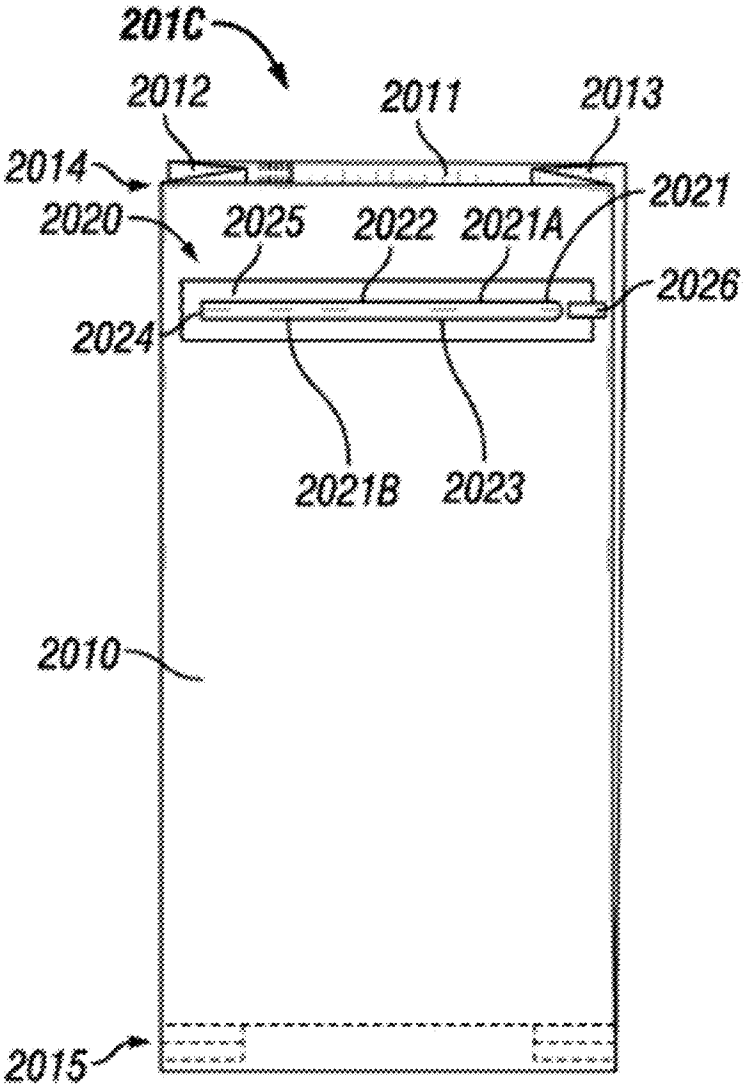
FIG. 20 shows a flush cut bag with an easy open feature comprising a semi-circular cut through the bag located near the top end of the bag according to one embodiment of the present disclosure.

Referring to FIG. 20, the front side view of yet another embodiment of a flush cut bag 2001*c* is shown. Bag 2001*e* also has a front wall 2010, a back wall 2011, a first side wall 2012, a second side wall 2013, a top end 2014, and a bottom end 2015. Bag 2001*e* also comprises an easy open feature 2020, which in this embodiment is near the top end 2014 of the bag 2001*c* and comprises a full cut 2021 in a semicircular shape having a first end 2021*a* and a second end

2021*b* through the front wall 2010 of bag 2001*c*, a first row of perforations 2022 extending from the first end 2021*a* of the cut 2021, a second row of perforations 2023 extending from the second end 2021*b* of the cut 2021, an optional third row of perforations 2024 connecting the end of the first row of perforations 2022 and the second row of perforations 2023, tape 2025 covering the cut and the rows of perforations, and a pull tab 2026 attached to the tape 2025.

Figure 21:
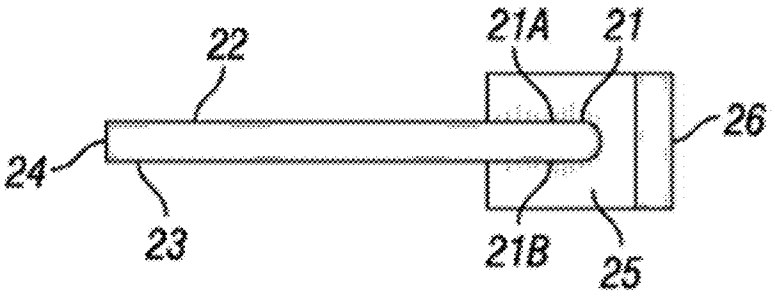
FIG. 21 shows a pull tab comprising a promotional coupon according to one embodiment of the present disclosure.

Referring to FIG. 21, an alternate embodiment of tape 2025 and pull tab 2026 is shown, where tape 2025 covers the full cut 2021 in a semi-circular shape having a first end 2021*a* and a second end 2021*b*, but does not cover the full extent of the first row of perforations 2022 and the second row of perforations 2023, and does not cover the third row of perforations 2024. In this embodiment, the pull tab 2026 includes instructions to open the bag, but can also comprise black and white and/or color printing (not shown), for example a promotional coupon (not shown).

Figure 22:
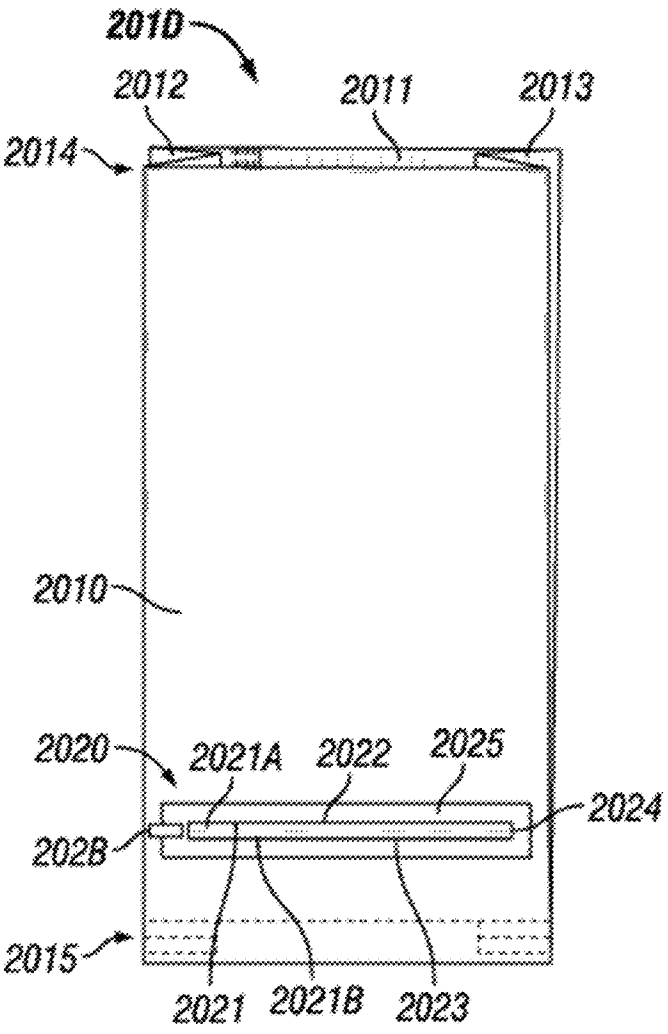
FIG. 22 shows a flush cut bag with an easy open feature comprising a square cut through the bag located near the bottom end of the bag according to one embodiment of the present disclosure.

Referring to FIG. 22, the front side view of still another embodiment of a flush cut bag 2001*d* is shown. Bag 2001*d* also has a front wall 2010, a back wall 2011, a first side wall 2012, a second side wall 2013, a top end 2014, and a bottom end 2015. Bag 2001*d* also comprises an easy open feature 2020, which in this embodiment is near the bottom end 2015 of the bag 2001*d* and comprises a full cut 2021 in a rectangular shape having a first end 2021*a* and a second end 2021*b* through the front wall 2010 of bag 2001*d*, a first row of perforations 2022 extending from the first end 2021*a* of the cut 2021, a second row of perforations 2023 extending from the second end 2021*b* of the cut 2021, an optional third row of perforations 2024 connecting the end of the first row of perforations 2022 and the second row of perforations 2023, tape 2025 covering the cut and the rows of perforations, and a pull tab 2026 attached to the tape 2025.

Figure 23:
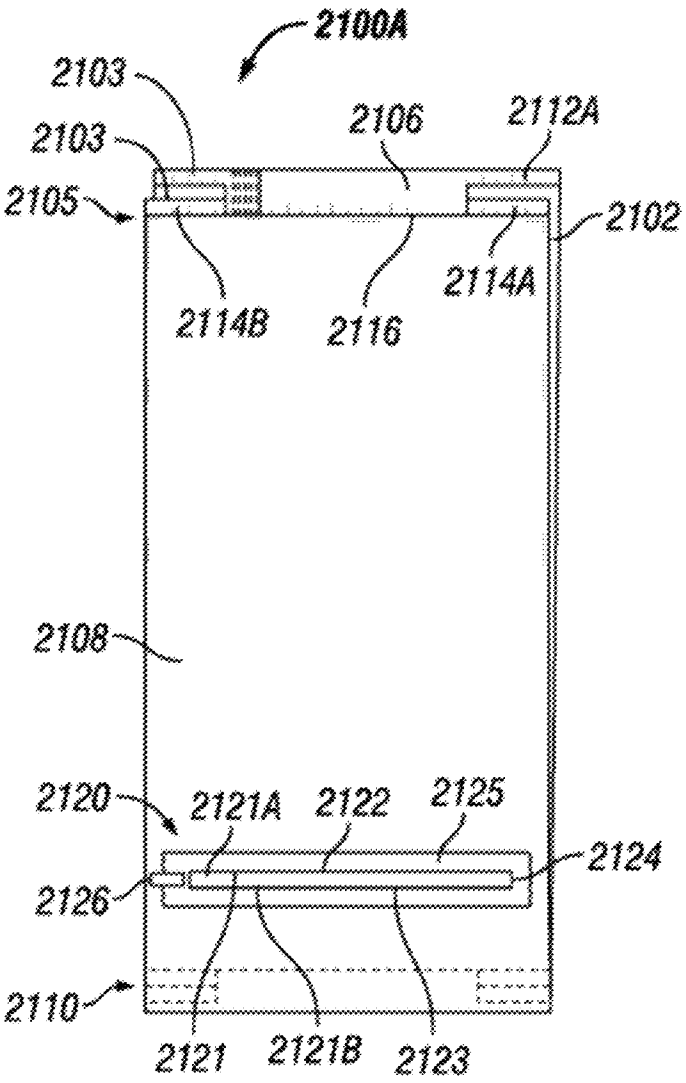
FIG. 23 shows a pinch cut bag with an easy open feature comprising a square cut through the bag located near the bottom end of the bag according to one embodiment of the present disclosure.

Referring to FIG. 23, the front side view of one embodiment of a "pinch cut" bag 2100*a* is shown. As shown in FIG. 23, the bag 2100*a* has a first or top end 2105 and a second or bottom end 2110. Once again, it is noted, however, that the orientation of the bag ends 2105 and 2110 may be relative, while the "top" and "bottom" references may change depending on the orientation that the bag is viewed. Bag 2100*a* is considered a "pinch cut" bag because one of the front wall 2108 or the back wall 2106 are cut so that one of the ends of the front wall 2108 or the back wall 2106 is longer than the other; they have different lengths. In the embodiment shown in FIG. 23 both of the ends of the bag 2100*a* have a "pinch cut." The bag 2100*a* has a front wall or surface 2108 with top end 2116, a rear wall or surface 2106, and two side walls 2102 and 2103. It is noted that conventional techniques can be used to provide side gussets in the bag 2100*a* for each of sides 2102 and 2103 during this forming process. The first end 2105 of bag 2100*a* has portions 2112*a* and 2112*b* of the rear wall or surface 2108 of the bag that extend further from the body of the bag 2100*a* than do portions 2114*a* and 2114*b* of the material of bag 2100*a* forming the side gussets for sides 2102 and 2103. In addition, the portions 2114*a* and 2114*b* of the side gussets extend further from the body of the bag 2100*a* than the top end 2116 of the front wall 2108 of the bag 2100*a*. As shown in FIG. 23, the front wall 2108 of the bag 2100*a* has an end portion 2116 at the first end 2105 of the bag that does not extend as far from the body of the bag 2100*a* as the end portions 2114*a* and 2114*b* of the side gussets or the end portions 2112*a* and 2112*b* of the rear wall of the first end 2105 of the bag 2100*a*. Bag 2100*a* also comprises an easy open feature 2120 near the top end 2105 of the bag 2100*a*, which in this embodiment comprises a full cut 2121 in a rectangular shape having a first end 2121*a* and a second end 2121*b* through the front wall 2108 of bag 2100*a*, a first row of perforations 2122 extending from the first end 2121*a* of the cut 2121, a second row of perforations 2123 extending from the second end 2121*b* of the cut 2121, an optional third row of perforations 2124 connecting the end of the first row of perforations 2122 and the second row of perforations 2123, tape 2125 covering the cut and the rows of perforations, and a pull tab 2126 attached to the tape 2125.

Figure 24:
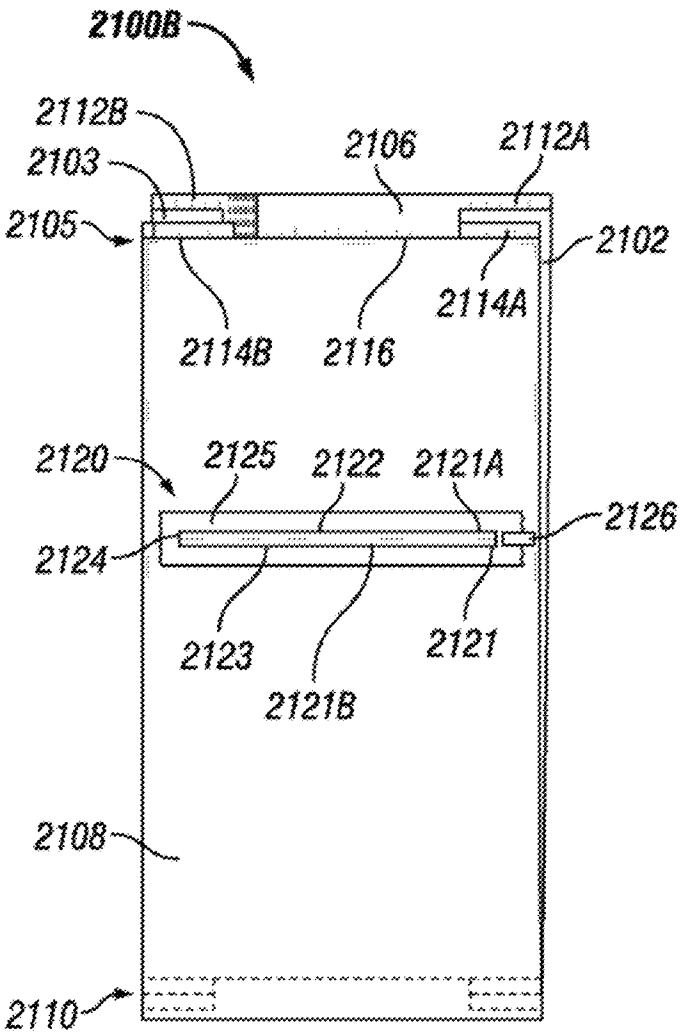
FIG. 24 shows a pinch cut bag with an easy open feature comprising a square cut through the bag located near the top end of the bag according to one embodiment of the present disclosure.

Referring to FIG. 24, the front side view of another embodiment of a pinch cut bag 2100*b* is shown. As shown in FIG. 24, the bag 2100*b* has a first or top end 2105 and a second or bottom end 2110. The bag 2100*b* has a front wall or surface 2108 with top end 2116, a rear wall or surface 2106, and two side walls 2102 and 2103. The first end 2105 of bag 2100*b* has portions 2112*a* and 2112*b* of the rear wall or surface 2108 of the bag that extend further from the body of the bag 2100*b* than do portions 2114*a* and 2114*b* of the material of bag 2100 forming the side gussets for sides 2102 and 2103. In addition, the portions 2114*a* and 2114*b* of the side gussets extend further from the body of the bag 2100*b* than the top end 2116 of the front wall 2108 of the bag 2100 *b*. As shown in FIG. 24, the front wall 2108 of the bag 2100*b* has an end portion 2116 at the first end 2105 of the bag that does not extend as far from the body of the bag 2100*b* as the end portions 2114*a* and 2114*b* of the side gussets or the end portions 2112*a* and 2112*b* of the rear wall of the first end 2105 of the bag 2100 *b*. Bag 2100*b* also comprises an easy open feature 2120, which in this embodiment is near the bottom end 2110 of the bag 2100*b* and comprises a full cut 2121 in a rectangular shape having a first end 2121*a* and a second end 2121*b* through the front wall 2108 of bag 2100*b*, a first row of perforations 2122 extending from the first end 2121*a* of the cut 2121, a second row of perforations 2123 extending from the second end 2121*b* of the cut 2121, an optional third row of perforations 2124 connecting the end of the first row of perforations 2122 and the second row of perforations 2123, tape 2125 covering the cut and the rows of perforations, and a pull tab 2126 attached to the tape 2125.

Figure 25:
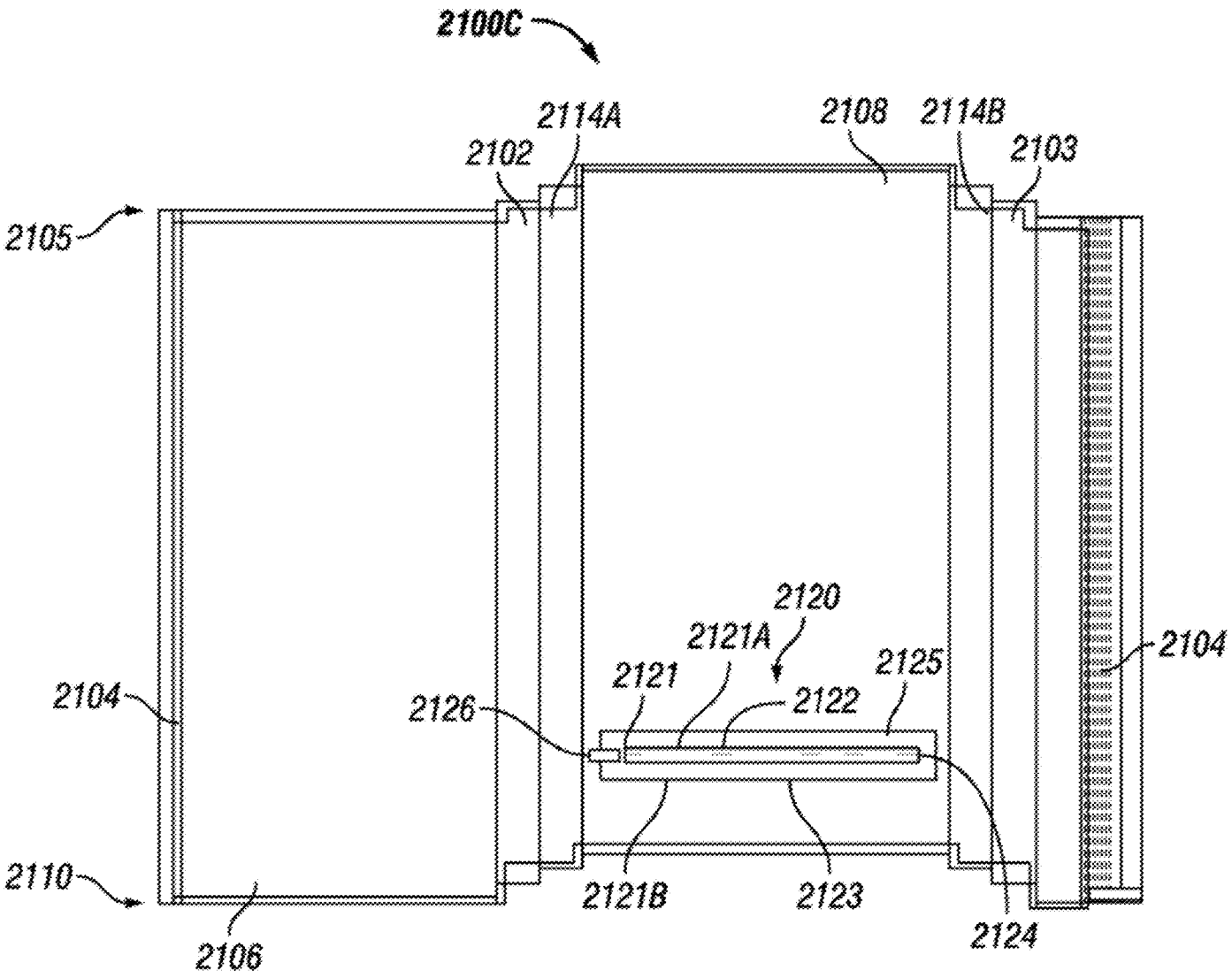
FIG. 25 shows an outline of a pinch cut bag with an easy open feature comprising a square cut through the bag located near the bottom end of the front panel of the bag according to one embodiment of the present disclosure.

Referring to FIG. 25, a planar view of an embodiment of a substantially flat sheet of material from which a bag 2100*c* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the bottom end 2110 of the front wall 2108 of the bag 2100*c* and comprises a full cut 2121 in a rectangular shape having a first end 2121*a* and a second end 2121*b* through the front wall 2108 of bag 2100*c*, a first row of perforations 2122 extending from the first end 2121*a* of the cut 2121 across the front wall 2108 of bag 2100*a*, a second row of perforations 2123 extending from the second end 2121*b* of the cut 2121 across the front wall 2108 of bag 2100*c*, an optional third row of perforations 2124 connecting the end of the first row of perforations 2122 and the second row of perforations 2123, tape 2125 covering the cut 2121 and the rows of perforations, and a pull tab 2126 attached to the tape 2125.

Figure 26:
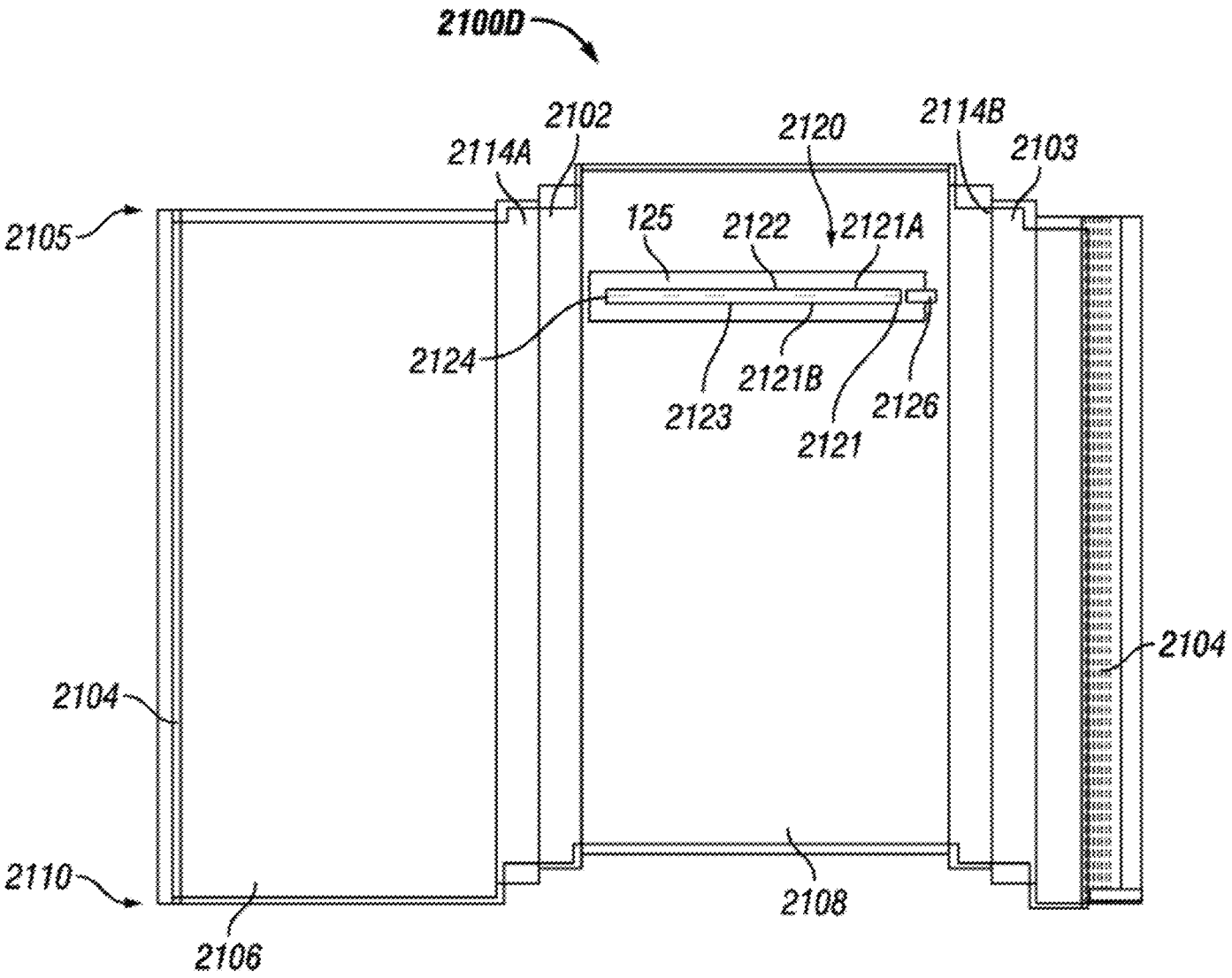
FIG. 26 shows an outline of a pinch cut bag with an easy open feature comprising a square cut through the bag located near the top end of the front panel of the bag according to one embodiment of the present disclosure.

Referring to FIG. 26, a planar view of another embodiment of a substantially flat sheet of material from which a bag 2100*d* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the top end 2105 of the front wall 2108 of the bag

2100*d* and comprises a full cut 2121 in a rectangular shape having a first end 2121*a* and a second end 2121*b* through the front wall 2108 of bag 2100*d*, a first row of perforations 2122 extending from the first end 2121*a* of the cut 2121 across the front wall 2108 of bag 2100*d*, a second row of perforations 2123 extending from the second end 2121*b* of the cut across the front wall 2108 of bag 2100*d*, an optional third row of perforations 2124 connecting the end of the first row of perforations 2122 and the second row of perforations 2123, tape 2125 covering the cut 2121 and the rows of perforations, and a pull tab 2126 attached to the tape 2125.

Figure 27:
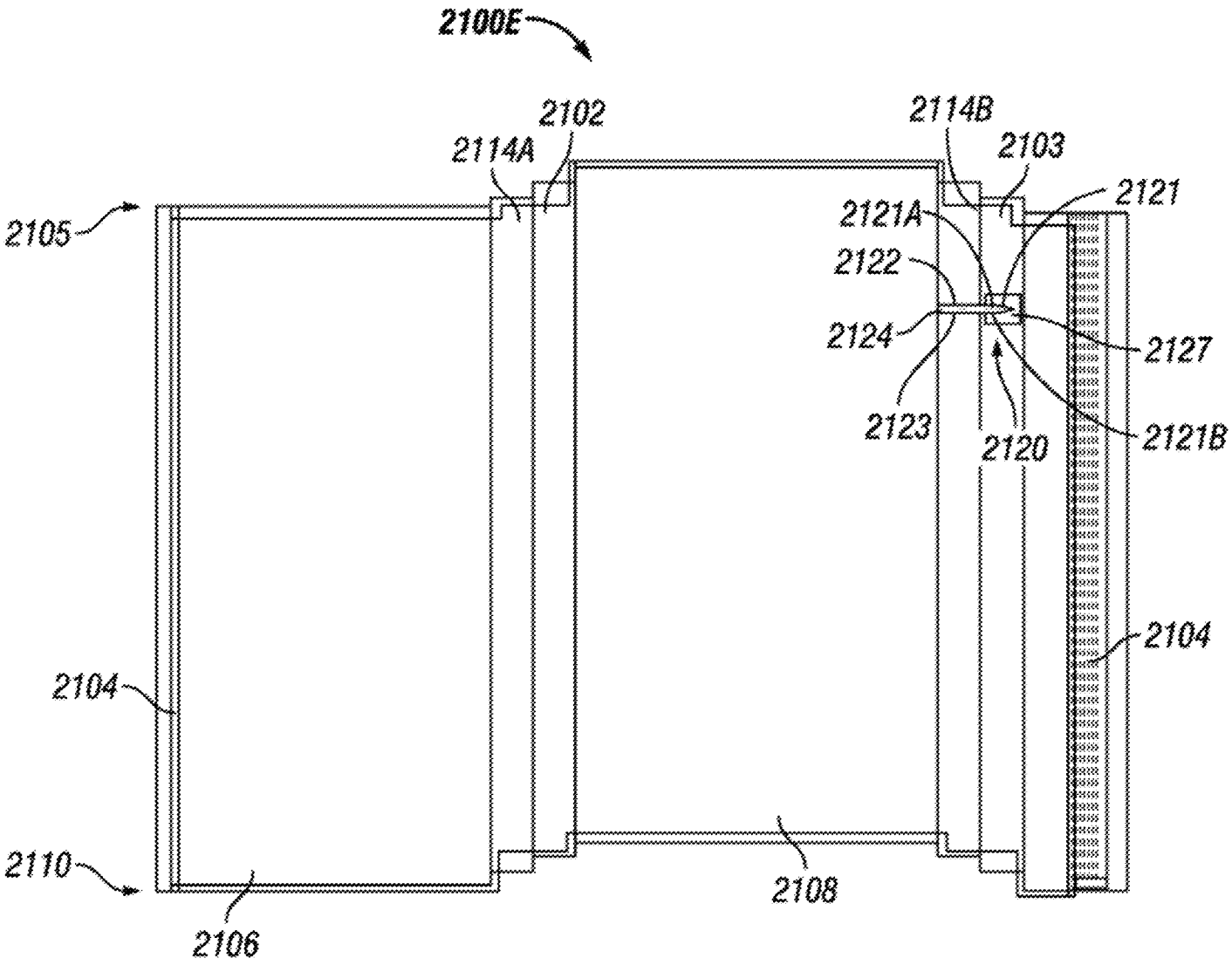
FIG. 27 shows an outline of a pinch cut bag with an easy open feature comprising a carat cut through the bag located near the top end of a side panel of the bag and extending through the side panel according to one embodiment of the present disclosure.

Referring to FIG. 27, a planar view of another embodiment of a substantially flat sheet of material from which a bag 2100*e* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the top end 2105 of the second side 2103 of the bag 2100*e* and comprises a full cut 2121 in a carat shape having a first end 2121*a* and a second end 2121*b* through the second side 2103 of bag 2100*e*, a first row of perforations 2122 extending from the first end 2121*a* of the cut 2121 across the second side 2103 of bag 2100*e*, a second row of perforations 2123 extending from the second end 2121*b* of the cut 2121 across the second side 2103 of bag 2100*e*, an optional third row of perforations 2124 connecting the end of the first row of perforations 2122 and the second row of perforations 2123, and a pull tape 2127 covering the cut 2121 and a small portion of the first row of perforations 2122 and second row of perforations 2123.

Figure 28:
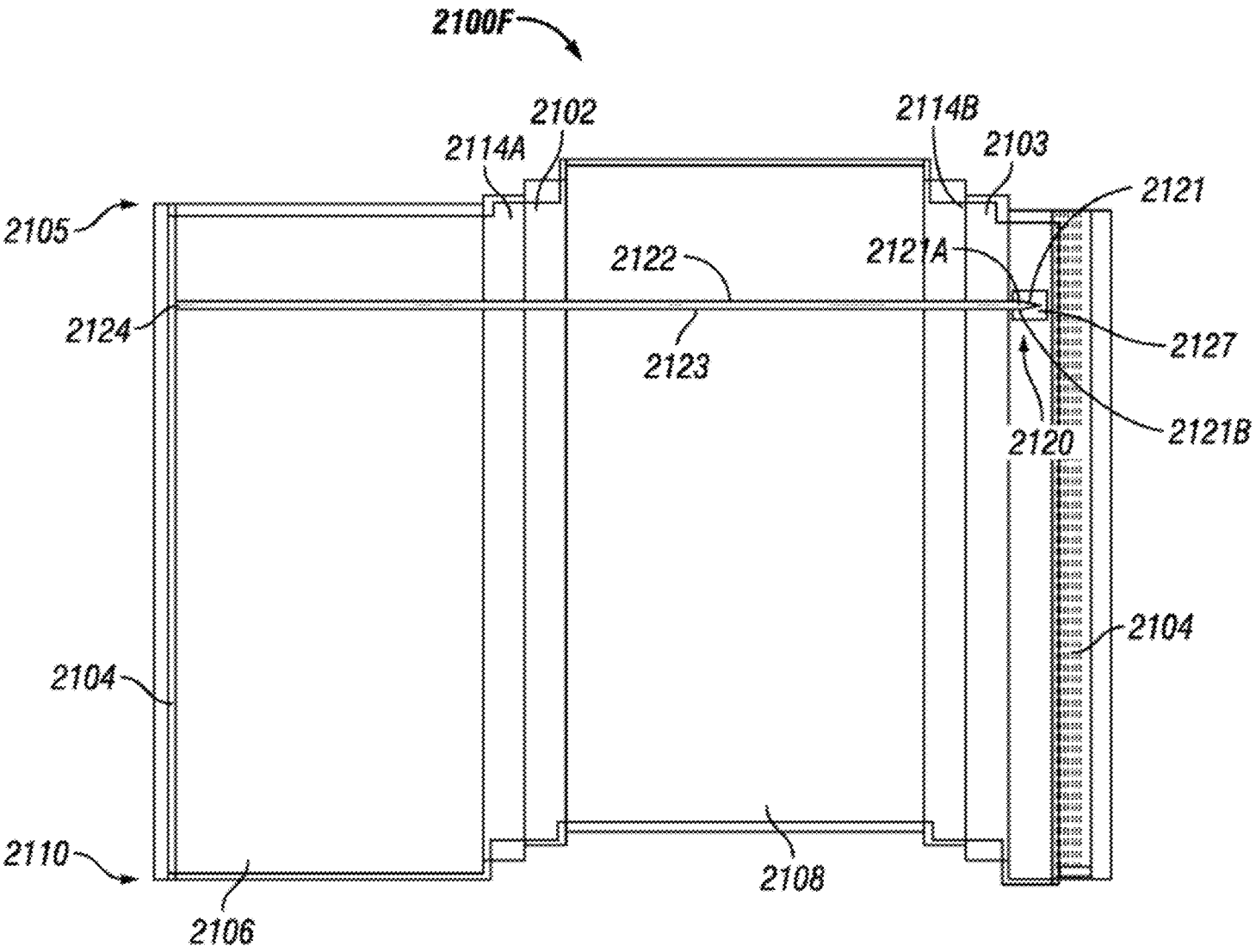
FIG. 28 shows an outline of a pinch cut bag with an easy open feature comprising a carat cut through the bag located near the top end of a side panel of the bag and extending across the entire length of the bag according to one embodiment of the present disclosure.

Referring to FIG. 28, a planar view of another embodiment of a substantially flat sheet of material from which a bag 2100*f* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the top end 2105 of the second side 2103 of the bag 2100*f* and comprises a full cut 2121 in a carat shape having a first end 2121*a* and a second end 2121*b* through the second side 2103 of bag 2100*f* a first row of perforations 2122 extending from the first end 2121*a* of the cut 2121 across the second side 2103, front wall 2108, first side 2102 and rear wall 2104 of bag 2100*f* a second row of perforations 2123 extending from the second end 2121*b* of the cut 2121 across the second side 2103, front wall 2108, first side 2102 and rear wall 2104 of bag 2100*f* an optional third row of perforations 2124 connecting the end of the first row of perforations 2122 and the second row of perforations 2123, and a pull tape 2127 covering the cut 2121 and a small portion of the first row of perforations 2122 and second row of perforations 2123.

Figure 29:
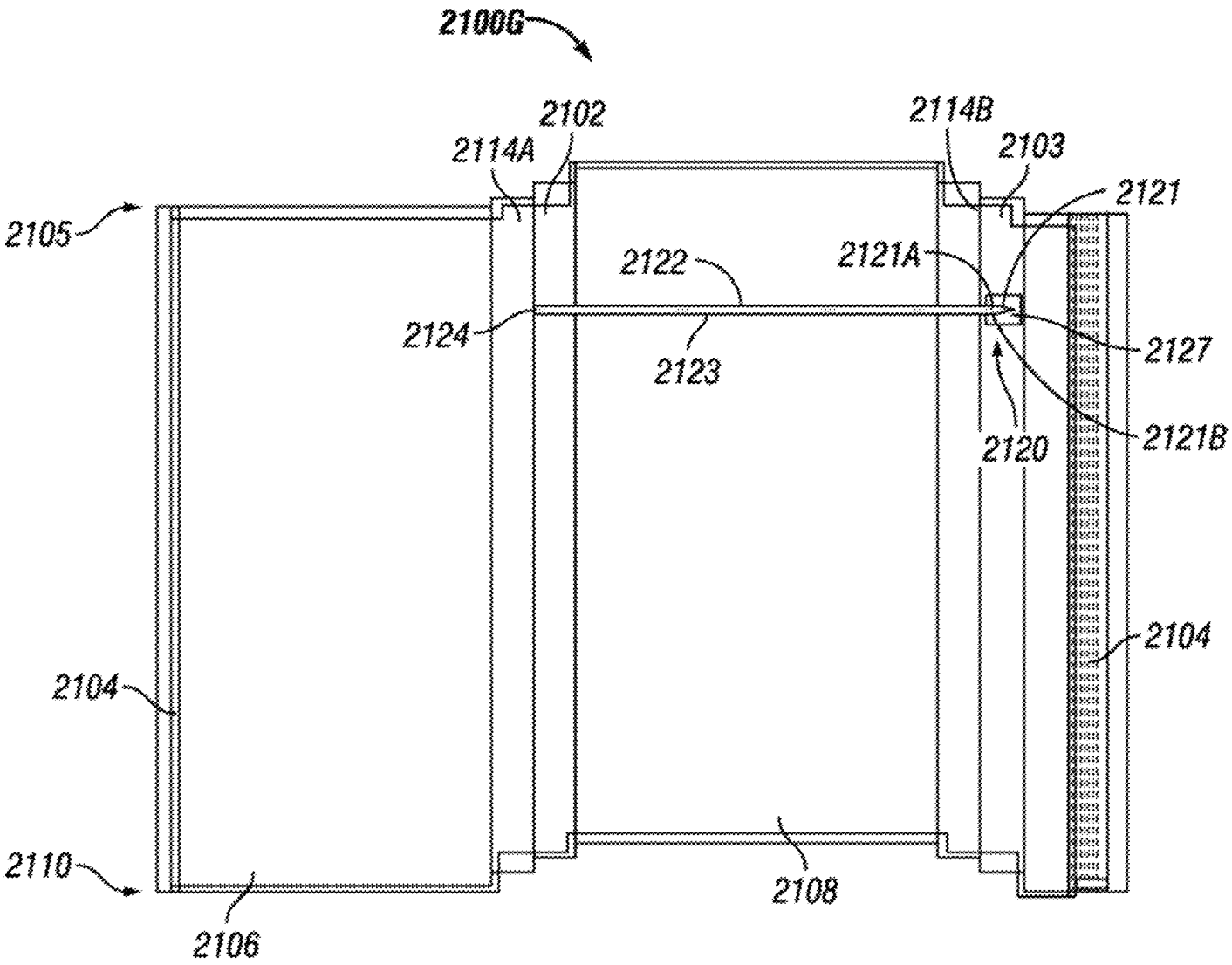
FIG. 29 shows an outline of a pinch cut bag with an easy open feature comprising a carat cut through the bag located near the top end of a side panel of the bag and extending across the side panel and the front panel of the bag according to one embodiment of the present disclosure.

Referring to FIG. 29, a planar view of another embodiment of a substantially flat sheet of material from which a bag 2100*g* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the top end 2105 of the second side 2103 of the bag 2100*g* and comprises a full cut 2121 in a carat shape having a first end 2121*a* and a second end 2121*b* through the second side 2103 of bag 2100*g*, a first row of perforations 2122 extending from the first end 2121*a* of the cut 2121 across the second side 2103, front wall 2108 and into the first side 2102 of bag 2100*g*, a second row of perforations 2123 extending from the second end 2121*b* of the cut 2121 across the second side 2103, front wall 2108 and into the first side 2102 of bag 2100*g*, an optional third row of perforations 2124 connecting the end of the first row of perforations 2122 and the second row of perforations 2123, and a pull tape 2127 covering the cut 2121 and a small portion of the first row of perforations 2122 and second row of perforations 2123.

Figure 30:
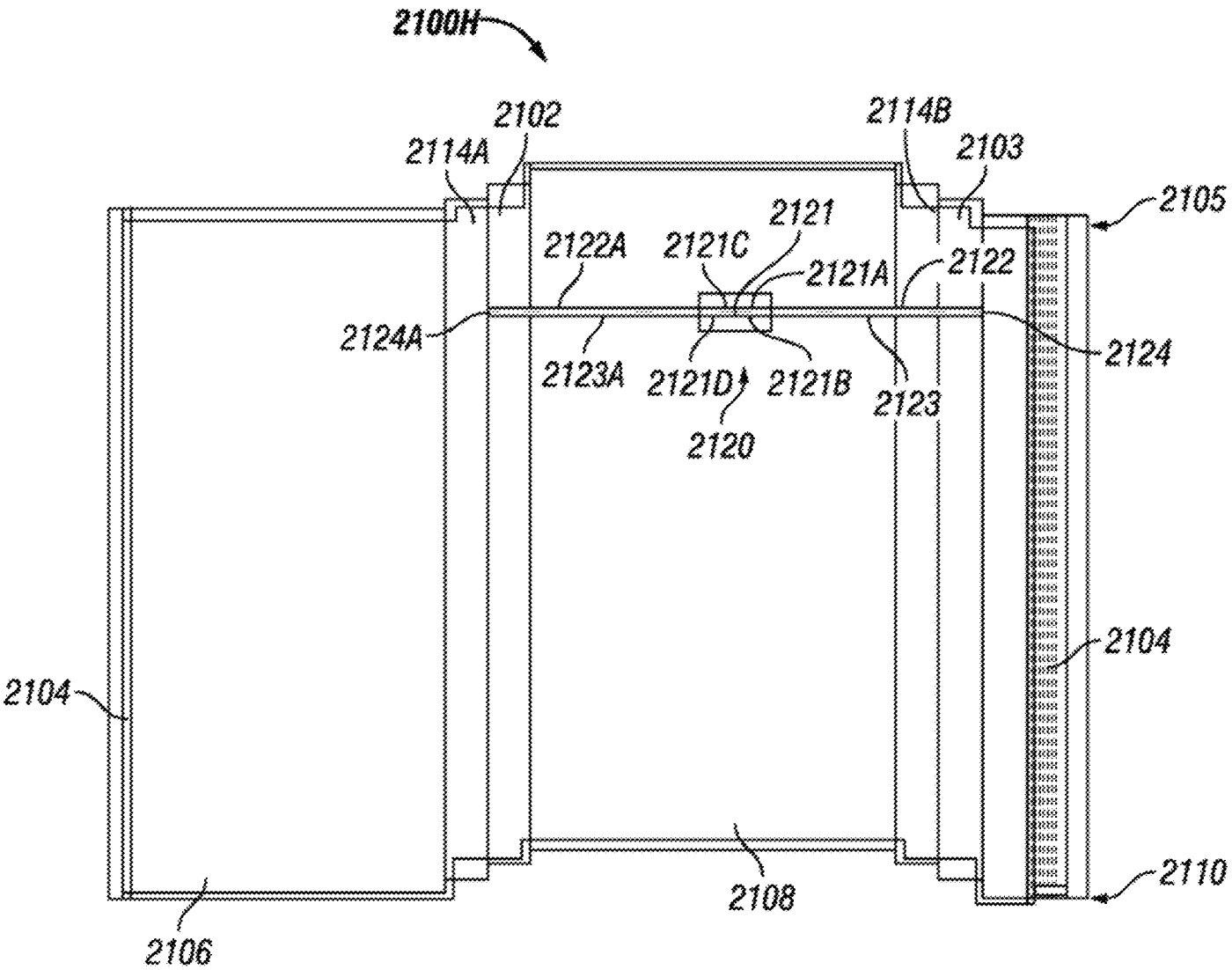
FIG. 30 shows an outline of a pinch cut bag with an easy open feature comprising a bidirectional square cut through the bag located near the top end of the front panel of the bag and extending into both side panels according to one embodiment of the present disclosure.

Referring to FIG. 30, a planar view of another embodiment of a substantially flat sheet of material from which a bag 2100*h* is to be formed is shown. Shown on the sheet are front wall 2108, rear wall 2106, first side 2102 having gusset portion 2114*a*, second side 2103 having gusset portion 2114*b*, seam 2104, top end 2105 and bottom end 2110. Also shown is easy open feature 2120, which in this embodiment is near the top end 2105 of the front wall 2108 of the bag 2100*h* and comprises a bidirectional full cut 2121 in a square shape having a first end 2121*a*, a second end 2121*b*, a third end 2121*c* and a fourth end 2121*d* through the front wall 2108 of bag 2100, a first row of perforations 2122 extending from the first end 2121*a* of the cut 2121 across the front wall 2108 and into the first side 2102 of bag 2100*h*, a second row of perforations 2123 extending from the second end 2121*b* of the cut 2121 across the front wall 2108 and into the first side 2102 of bag 2100, an optional third row of perforations 2124 connecting the end of the first row of perforations 2122 and the second row of perforations 2123, a fourth row of perforations 2122*a* extending from the third end 2121*c* of the cut 2121 across the front wall 2108 and into the second side 2103 of bag 2100*h*, a fifth row of perforations 2123*a* extending from the fourth end 2121*d* of the cut 2121 across the front wall 2108 and into the second side 2103 of bag 2100*h*, an optional sixth row of perforations 2124*a* connecting the end of the fourth row of perforations 2122*a* and the fifth row of perforations 2123*a*, and a pull tape 2127 covering the cut 2121 and a small portion of the first row of perforations 2122, second row of perforations 2123, fourth row of perforations 2122*a* and fifth row of perforations 2123*a*.

Figure 31:
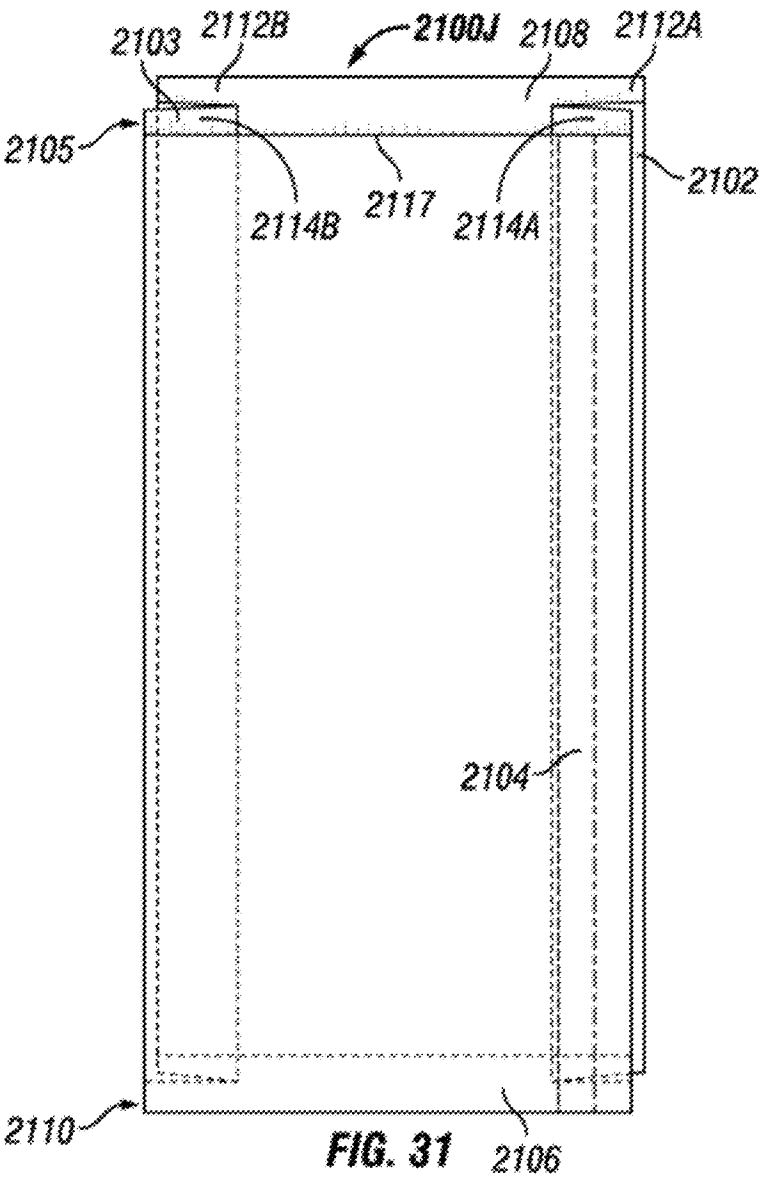
FIG. 31 shows a back side view of a pinch cut bag according to one embodiment of the present disclosure.

Referring to FIG. 31, the back side view of yet another embodiment of a pinch cut bag 2100*j* is shown. As shown in FIG. 31, the bag 2100*j* has a first end 2105 and a second end 2110. It is useful to think of first and second ends 2105 and 2110 as the top and bottom ends of the bag 2100*j*, respectively. The bag 2100*j* has a front wall or surface 1208, a rear wall or surface 2106, and two side walls 2102 and 2103. The bag 2100*j* also has a seam 2104 on the back side, or rear wall or surface. The seam 2104 may be made when the bag 2100 is formed using conventional methods. Using such conventional methods, a material from which a bag 2100*j* is to be formed (such materials are discussed in detail below) is provided in a substantially flat sheet (see FIG. 25 through FIG. 30). The sheet is then directed and formed so that a portion of one side of the sheet is disposed on top of the other side of the sheet, such as in forming a tube. The overlapping portion is then secured and sealed together, forming the seam 2104. It is noted that conventional techniques can be used to provide side gussets in the bag 2100*j* for each of sides 2102 and 2103 during this forming process.

The bottom (as shown in FIG. 31) of the first end 2105 of bag 2100*j* has portions 2112*a* and 2112*b* of the front wall 2108 or surface of the bag that extend further from the body of the bag 2100*j* than do portions 2114*a* and 2114*b* of the material of bag 2100J forming the side gussets for sides 2102 and 2103. In addition, the portions 2114*a* and 2114*b* of the side gussets extend further from the body of the bag 2100*j* than the top end 2117 of the rear wall 2106 of the bag 2100*j*. As shown in FIG. 31, the rear wall of the bag 2100*j* has a top end 2117 that does not extend as far from the body of the bag 2100*j* as the end portions 2114*a* and 2114*b* of the side gussets or the end portions 2112*a* and 2112*b* of the front wall 2108 of the bag 2100*j*.

Figure 32:
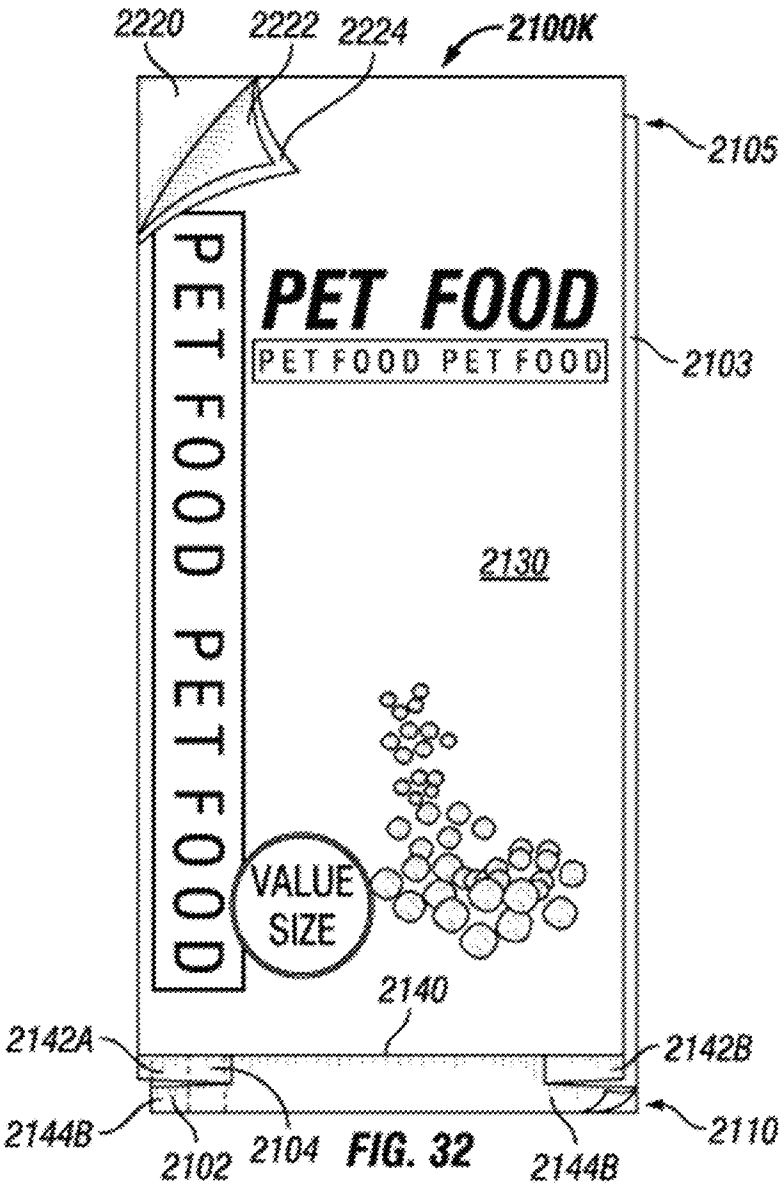
FIG. 32 shows a front side view of a printed pinch cut bag with an easy open feature comprising a square cut through the bag located near the top end of the bag according to one embodiment of the present disclosure.

Now referring to FIG. 32, a top side view of bag 2100*k* is provided. For ease of reference, the same numerals are used in the Figures to denote the same features of bag 2100*k*. As shown in FIG. 32, the bag 2100*k* comprises multiple layers of materials 2220, 2222 and 2224. The first layer 2220 is preferably a woven polymeric material, such as polypropylene, polyester, high-density polyethylene, or polyethylene. The woven plastic layer 2220 can be made of woven strips of plastic made of film to provide great strength from relatively lightweight materials, and can also be stretched to provide greater strength.

Still referring to FIG. 32, the layer 2222 is a coating or a lamination, preferably a polypropylene film. Layer 2224 is preferably an oriented polypropylene film with reverse printing. The layer 2224 can comprise reverse printing of various labels, advertising, warnings, and other information as may be desired, such as the cover 2130 shown in FIG. 32. Although not shown, it is noted that the top side, back side, and sides 2102 and 2103 of the bag 2100 may all contain such pictures, patterns, or information as may be desired. It is noted that the reverse printing of layer 2224 can be achieved with conventional techniques, and with various conventional plastic films. An advantage of printing the bottom portion of the front and/or back panels is the provision of information that remains visible when the bag is on a display shelf in a store.

Still referring to FIG. 32, the bottom side (as shown in FIG. 32) of the bag 2100*k* extends outward from the body of the bag 2100*k* at the second end 2110 of the bag 2100*k*. As shown in FIG. 32, the top side of the bag 2100*k* has an end portion 2140 extending along the width of the bag 2100*k*. The side gussets of the sides 2102 and 2103 of the bag 2100*k* each have portions 2142*a* and 2142*b* which extend further towards the second end 2110 of the bag 2100*k* than the end portion 2140 of the top side of bag 2100*k*. In addition, the bottom side of the bag 2100*k* has an end portion 2110 that extends further from the end portions 2142*a* and 2142*b* of the side gussets. The end portion 2110 of the bag 2100*k* includes portions 2144*a* and 2144 *b*. As shown in FIG. 32, the second end portion of the bottom side of the bag 2100*k* extends along the entire width of the bag 2100*k*. Also shown is seam 2104.

Still referring to FIG. 32, the exposed end portions 2144*a* and 2144*b* of the bottom side of the bag 2100*k* can be coated with a durable adhesive. The adhesive can be applied to selective surface areas, such as portions 2144*a* and 2144*b*, or can be applied in a line extending across the bottom side of the bag 2100*k* along the second end portion 2110, including portions 2144*a* and 2144 *b*. After the adhesive is applied, preferably the sides 2102 and 2103 of the bag 2100, together with the bottom side of the bag 2100*k* are folded so that at least a portion of the interior surface of the bottom side of the bag 2100*k* extends over the top surface of the top side of the bag 2100*k*. In some cased, the portions 2142*a* and 2142*b* of the side gussets may be folded over and attached to the top surface of the top side of the bag 2100*k*, as well as portions 2144*a* and 2144*b* of the second end 2110 of the bottom side of the bag 2100*k*. The coating then seals the second end 2110 of the bag 2100*k* together. The first end 2105 of the bag 2100*k* can be sealed in a similar fashion if desired. Alternatively, the first end 2105 or second end 2110 of the bag 2100*k* can be sealed using a hot melt technique or another suitable technique.

Figure 33:
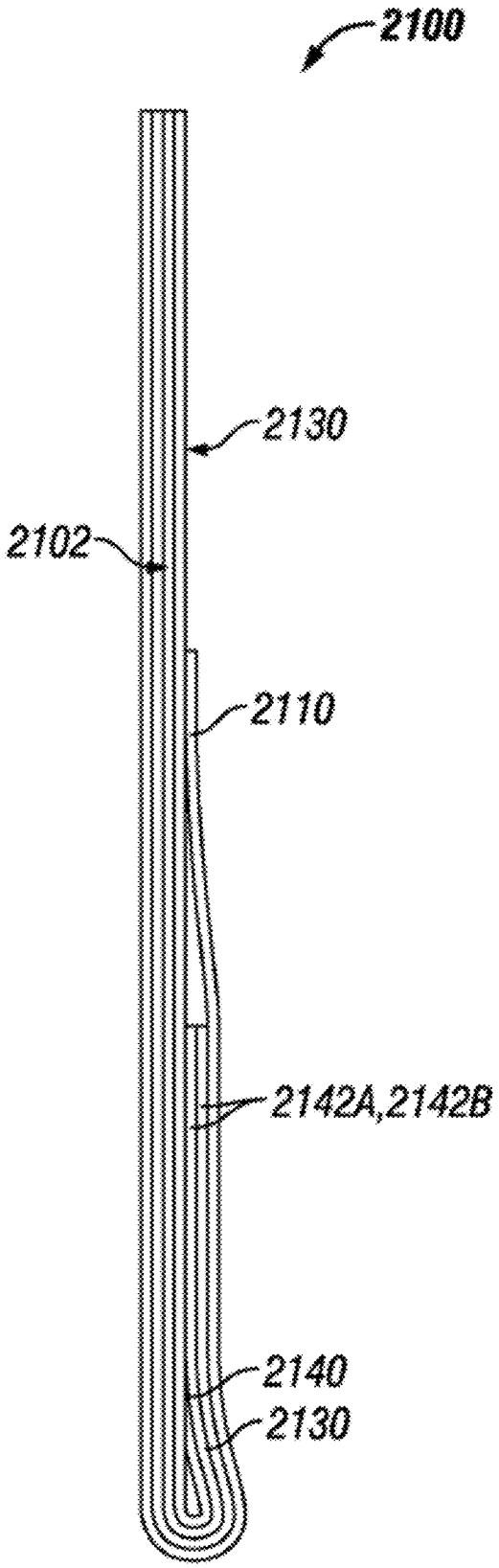
FIG. 33 shows a cross-sectional view of a top end or bottom end portion of a pinch cut bag according to one embodiment of the present disclosure.

Referring now to FIG. 33, a detailed cross-sectional view of an end portion of the bag 2100 is provided. As shown in FIG. 33, at least a portion of the front side 2130 of bag 2100 is now covered by the lowest edge portion 2110 of the back side of bag 2100, the extending portions 2142*a*, 2142*b* of side 2102 of the bag 2100, as well as a portion of the front side 2130 of bag 2100 including end portion 2140. Once these portions are folded over, heat and pressure can be applied as appropriate to obtain and ensure that the bottom end 2110 of bag 2100 is durably sealed, such as with a conventional heat sealable adhesive.

Once the bag 2100 is sealed at one end, it can be filled with the desired materials. It has been found that a bag 2100 with a height of 41 inches and a width of 28 inches can durably hold at least about fifty (50) pounds of material without showing undue stress, tearing, breakage or the like. It is believed that any bulk material can be contained by bag 2100, and the contents can weigh up to 100 pounds or so without undue risk of tearing or damage to bag 2100. Once the bag 2100 is filled, the second end typically may be sealed. The second end of the bag 2100 can be sealed in a similar manner as that described above for the bottom end 2110. Alternatively, the bag 2100 can have its second end sealed by conventional means such as sewing. Still another approach is to seal the second end in a manner like that described for the bottom end 2110 of the bag 2100, and then stitching one of the two ends (not shown). Although not shown, it is noted that a second end of bag 2100 can be sealed with conventional techniques once bag 2100 has been filled with the selected amount of the desired material.

Figure 34:
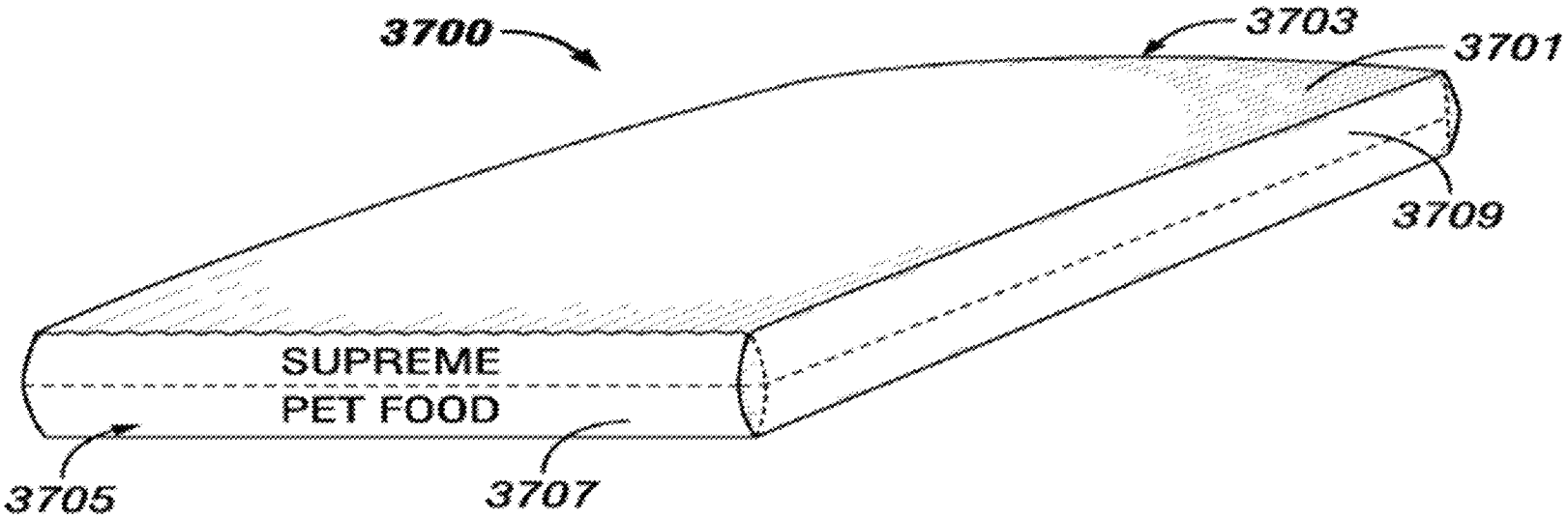
FIG. 34 shows an isometric view of a pinch cut bag according to one embodiment of the present disclosure.

Referring now to FIG. 34, an isometric view of bag 2100*b* is provided. As shown in FIG. 34, the bag 3700 includes a front panel 3701, a first side panel with gussets 3709, a second side panel with gussets (not visible in FIG. 34), a top end 3703, and a bottom end 3705. The bag 3700 is a pinch cut bag like those described previously, with both a pinch cut top end 3703 and a pinch cut bottom end 3705. The bag 3700 preferably has a weakened area (not shown in FIG. 34) or other easy open feature on at least one surface (not shown in FIG. 34). As shown in FIG. 34, the bag 3700 has been filled and sealed and contains one or more materials. Although the contents of the bag 3700 may be food, animal food, other bulk items, the contents may also contain liquids or mixtures. It is noted that the bag 3700, once formed in accordance with the present disclosure, may be filled and then either the top end 3703 or the bottom end 3705 or both may be sealed as described previously. As shown in FIG. 34, the bag 3700, once filled, presents a bottom panel 3707 on the bottom end 3705 thereof and a top panel on the top end thereof (not visible in FIG. 34). The bag 3700 may be stacked on top of similar or different bags, such as at a grocery store, pet store, or other display location, such that panel 3707 is easily visible to a consumer. As shown in FIG. 34 the front panel 3701, the first side panel 3709 and the bottom panel 3707 includes printing (and can also include graphics), and it is noted that the top panel, the rear panel, and the second side panel of bag 3700, which are not visible in FIG. 34, can also include graphics and/or printing. Thus bag 3700 has six discrete areas for printing and/or graphics, each formed by a discrete surface area of the bag 3700. Additionally, the printing and/or graphics can extend across more than one panel, or any combination of the six panels (not shown). The panel 3707 may include graphics and/or printing so that a consumer is able to quickly, readily and easily identify the brand of the contents in the bag, such as the brand name for the pet food therein if the bag 3700 contains pet food. Alternatively, or in addition, the printing or graphics on the panel 3707 may contain information such as price, composition, expiration date, and the like. In another embodiment, the panel 3707 may contain printing or graphics that provide a coupon or other price discount or other offer, either on the contents of the bag 3700 or some other product.

Figure 35:
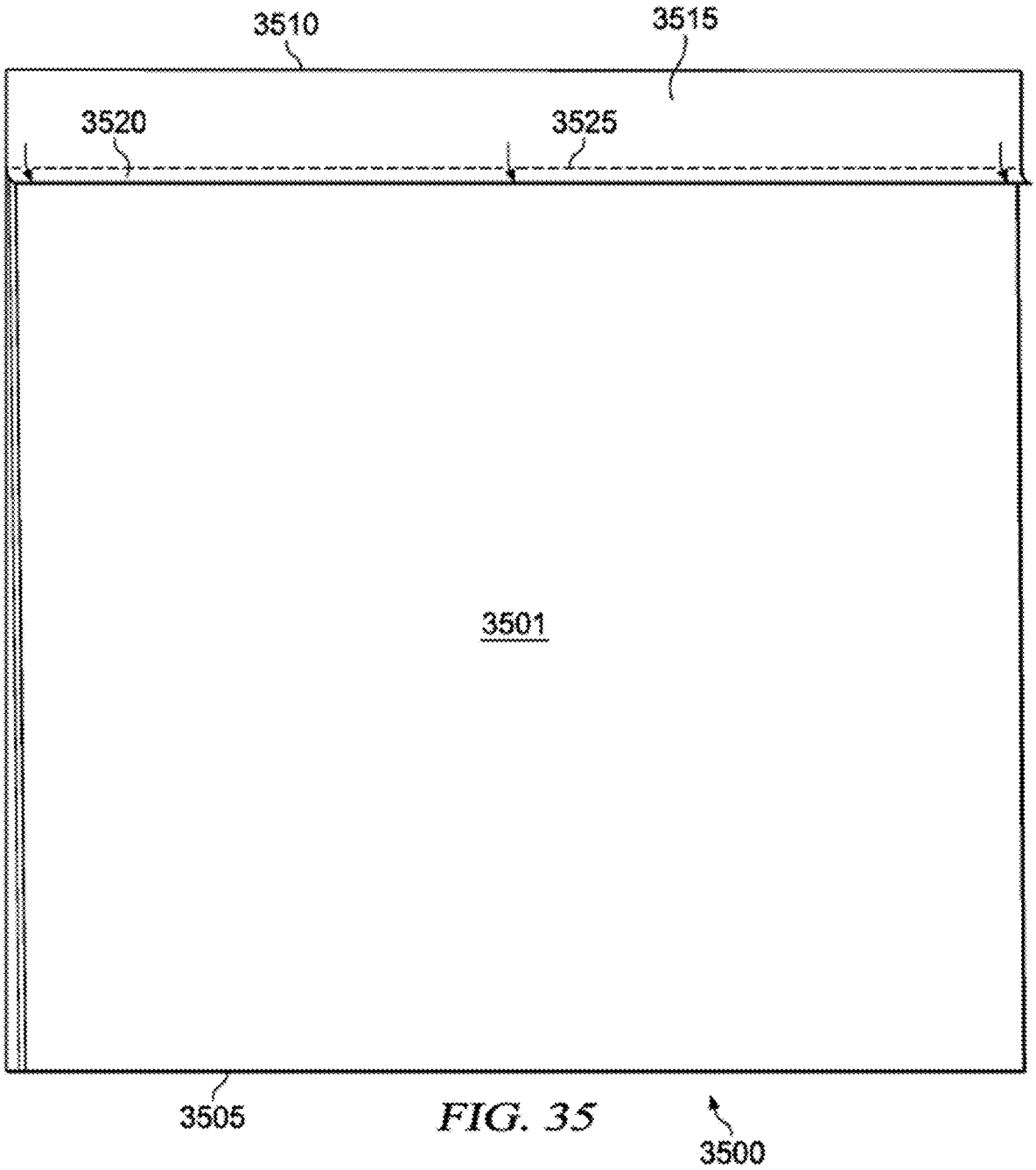
FIG. 35 shows a front view of a portion of a wall of a bag folded over and to create a flap and attached to the opposite face of the bag.
Figure 36:
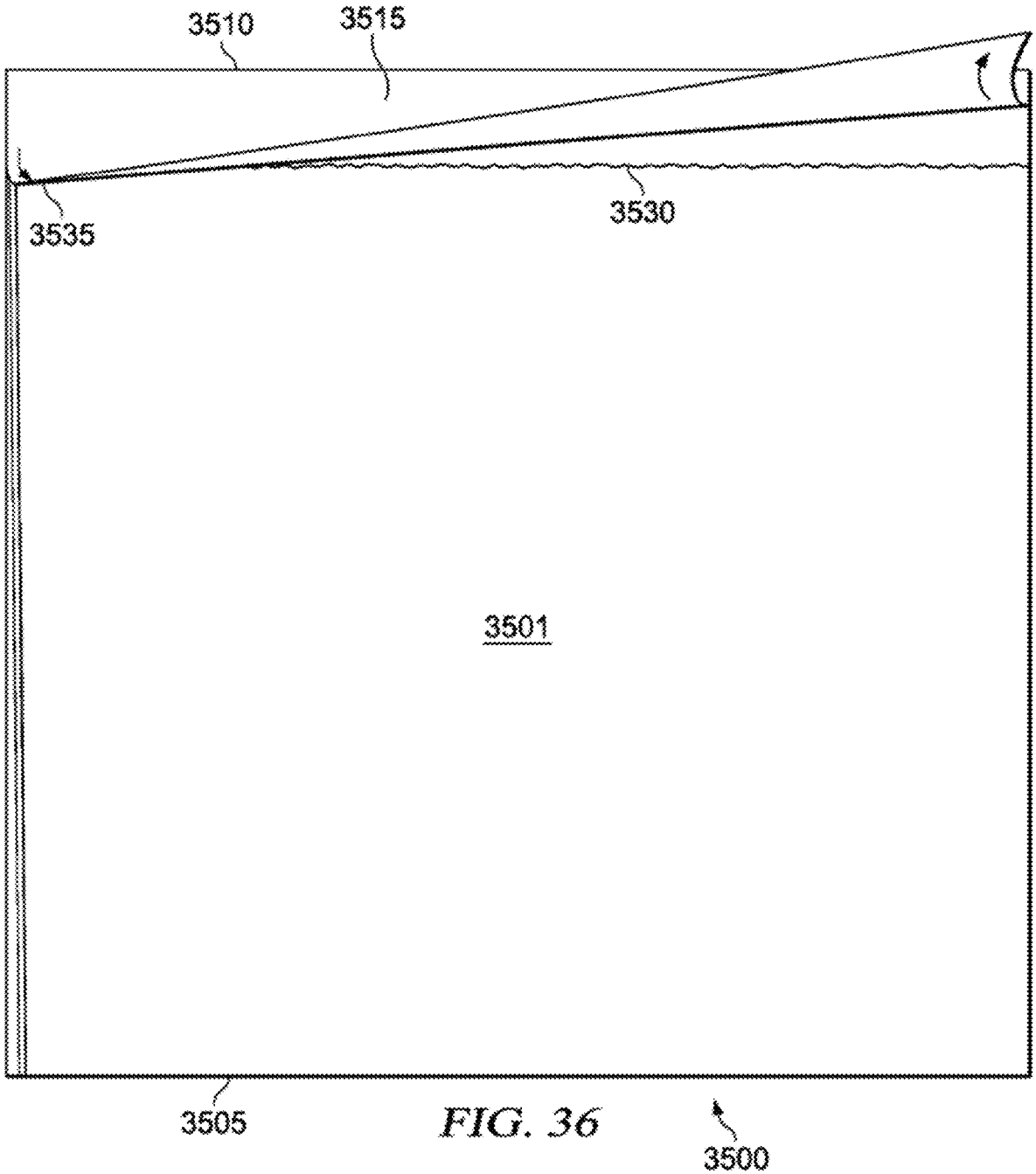
FIG. 36 shows a front view of a bag partially opened by peeling a portion of an overlay portion of the flap.

In one embodiment of the present disclosure, a bag is provided that has a peelable, easy open feature. Such as bag is illustrated in FIGS. 35 and 36. The bag has a front or first wall and an opposing back or second wall. The bag may have side walls, and the side walls may have gussets, all as described above in connection with the various embodiments described, or the bag may instead comprise a laminated bag, such as a bag having two or more laminated layers, or any other type of consumer goods packaging. In the following description, a laminated, woven bag is described as a specific example of a bag, but is provided only as an example. In the example of a woven bag as a particular embodiment, the bag has a top or first end, and a bottom or second end, with the first end of the back wall extending beyond the first end of the front wall. This extension of the top end of the back wall beyond the top end of the front wall may be anywhere from a fraction of an inch to four inches, six inches, eight inches, ten inches, or more, as may be desired. Each of the bag walls has an exterior surface and an interior surface. The bag walls may have a woven polymeric layer and one or more polymeric film layers, such as any of those described above in connection with the various bags described herein. The bag wall layers may comprise any one or more materials, including any type of polymer, polypropylene, polyethylene, high density or low density polyethylene, polyester, nylon, polyethylene terephthalate, polyester, polyamide, oriented polypropylene, biaxially-oriented polypropylene, oriented polyethylene, biaxially-oriented polyethylene, oriented polyester, biaxially-oriented polyester, nylon, oriented or biaxially-oriented nylon, oriented polyethylene terephthalate, biaxially-oriented polyethylene terephthalate, oriented polyamide, biaxially-oriented polyamide, coated paper, or any combination thereof. In some examples, the first layer may consist essentially of polypropylene, high density polyethylene, low density polyethylene, polyester, and combinations thereof. In some examples, the second layer may consist essentially of polypropylene, polyethylene, polyethylene terephthalate, polyamide, or any combination thereof or paper.

A portion of the exterior surface of the front bag wall, the interior surface of the back bag wall, or both, may be treated to provide a preferential peelable, easy open area as described in more detail below. The treated portion of the surface(s) of the front and/or back bag wall(s) may be treated with a polyamide ink, a urethane-based ink, a nitrocellulose ink, or a combination of any of the foregoing, and may be treated in a particular pattern, such as a rectangular area, an elliptical area, a triangular area, or the like. It should be appreciated that the interior of the back wall and/or the exterior of the front wall may be treated with two or more inks or a combination of one or more inks and one or more treatments. For example, a first portion of the overlay portion can be treated with a first type of ink or subject to a first treatment, and a second portion of the overlay portion can be treated with a second, different ink and/or subject to a second, different treatment. Depending on the material selected for one or more of the bag layers, one or more different inks or treatments may be selected to provide the desired sealing strength control at the desired locations of the bag. For example, a polyamide resin or polyamide-based ink may provide less scaling strength than a nitrocellulose- or polyurethane-based ink or resin.

The treated portion of the surface(s) of the front and/or back bag wall(s) is determined so that it is preferably proximal the top end of the front bag wall, such as within the top one, two, or three inches from the top end of the front bag wall when the back bag wall is folded over the top end of the bag and brought into contact with a portion of the exterior surface proximal the top end of the front bag wall. The treated portion may extend all or partially across the width of the front and/or back bag walls. For example, if it is desired to control the sealing strength so that the seal is stronger on the left hand side of the bag (as shown in FIGS. 35 and 36) than the right hand side, more ink may be used on the right hand side of the bag wall and/or no ink may be used on the left hand side. Alternatively, the ink may be applied to an area that extends across 10%, 20%, 30%, 50%, or 100% of the bag's width from one side.

Once the front and/or back bag wall(s) have been treated, and a portion of the extending portion of the back bag wall has been folded over and brought into contact with a portion of the front bag wall proximal the top end of the bag, the overlaying portions of the front and back bag walls may be sealed, such as by applying heat and/or pressure in desired amounts for a desired time period, or by any of the sealing techniques described above in connection with any of the other embodiments described herein. This sealing may be done by passing the overlaying portions of the front and bag walls past a nozzle blowing heated air at or above a predetermined temperature or within a predetermined temperature range, or by applying heated clamps to opposing exterior surfaces of the overlaying portion of the front and bag walls, with the clamps applying a predetermined amount of pressure and at a predetermined temperature or above or within a predetermined temperature range. It is noted that the front and back bag walls may be sealed without the use of an adhesive, or, as described above, one or more adhesives may be used to seal the bag end.

In addition, the sealing of the overlaying portions of the front and back bag walls may be done selectively, such that a portion of the back bag wall is not sealed to the front bag wall and forms a flap. The flap may extend along the width of the bag wall, or may extend for only a portion of the width of the bag wall. The flap and sealing of the front and back bag walls as described provides an easy open feature such that a consumer can grip the flap, such as at one side of the bag, and pull the flap upwards and/or away from the front wall of the bag. Because the strength of the seal has been controlled at the overlay portion of the front and back bag walls as desired, the consumer should be able to open the bag without a knife or for scissors. The flap may include one or more pull tabs to assist the consumer in gripping and pulling the flap, and may include printing and/or graphics to instruct and assist the consumer in how to open the bag.

Referring now to FIGS. 35 and 36, an example of one type of bag with a peelable, easy open feature of this type is illustrated. In FIG. 35, a bag 3500 with a peelable, easy open feature is shown. The bag 3500 has a front wall 3501 and an opposing back wall (not shown), which are joined by side walls. The bag 3500 further has a top end 3510 and a bottom end 3505. The bottom end 3505 can be of any type, including a stepped-cut bag, a pinch bag, a pouch bag, or other type, and can be sealed using any of the sealing techniques described herein, or may include a peelable, easy open feature or other type of easy open feature. As illustrated in FIG. 35, a portion 3515 of the back wall is folded over and forms the top end 3510 of the bag 3500. At least a portion of the portion 3515 located above the line 3525 is sealed to the front wall 3501 of the bag 3500. In this particular illustration, the interior surface of the portion 3515 of the back wall is sealed to the exterior surface of the front bag wall. It is noted that the extending portion of the back wall can be double-folded if desired so that an exterior surface of the back bag wall is scaled to the exterior surface of the front wall. It can be seen that a flap 3520 of the end of the back bag wall is not sealed to the front bag wall below the line 3525. This flap 3520 can be gripped by a consumer and pulled to open the bag 3500 easily.

Referring now to FIG. 36, the exemplary bag 3500 is shown with a portion of the top end 3510 opened on the right hand side of the bag. The top end 3530 of the front wall 3501 of the bag 3500 is shown. It can be seen in FIG. 36 that the left-handed portion 3535 of the top end of the back wall is still sealed to the exterior surface of the front wall 3501. It should be appreciated that a consumer can grip the flap 3520 (as shown in FIG. 35) at the right-hand side of the bag and pull upwards and/or away from the bag front wall 3501 to open the bag 3500. It should also be appreciated that the selective treatment of a portion or portions of the front and/or back bag walls as described herein allow for a controlled sealing area proximal the top end of the bag 3500, such as to create one or more areas in which the front and back bag walls are sealed with a stronger seal than other areas, and/or one or more areas in which the front and back bag walls are sealed with a seal which is more easily separated, all without the use of an adhesive (although, as noted, an adhesive may be used to seal the top end of the bag 3500 if desired). By selectively controlling the area(s) treated with one or more inks, and by controlling the heat, pressure, and/or duration of the application of heat and pressure to selected areas of the overlaying portions of the front and back bag walls, a selective and more precise control of the location of the seal between the front and back bag walls as well as the local strength of such seals, may be attained. The local strength of the seal may vary, but yet provides sufficient strength to pass the applicable drop test, peel test, and the like and provides a strong, durable seal. In some examples, the layers and construction of the bag are such that the bags as described herein must pass a drop test wherein the bag is filled with up to twenty to eighty pounds of material and dropped at a height of two to ten feet without bursting a seam or tearing the bag.

Referring now to FIGS. 37 through 48, various different examples of easy open features are shown. The views in FIGS. 37 through 48 show a wall of the bag that includes an easy open feature in a vertical orientation and a corresponding diagonal orientation. It is noted that various different types of orientations of the easy open feature are contemplated herein.

Figures 37, 38:
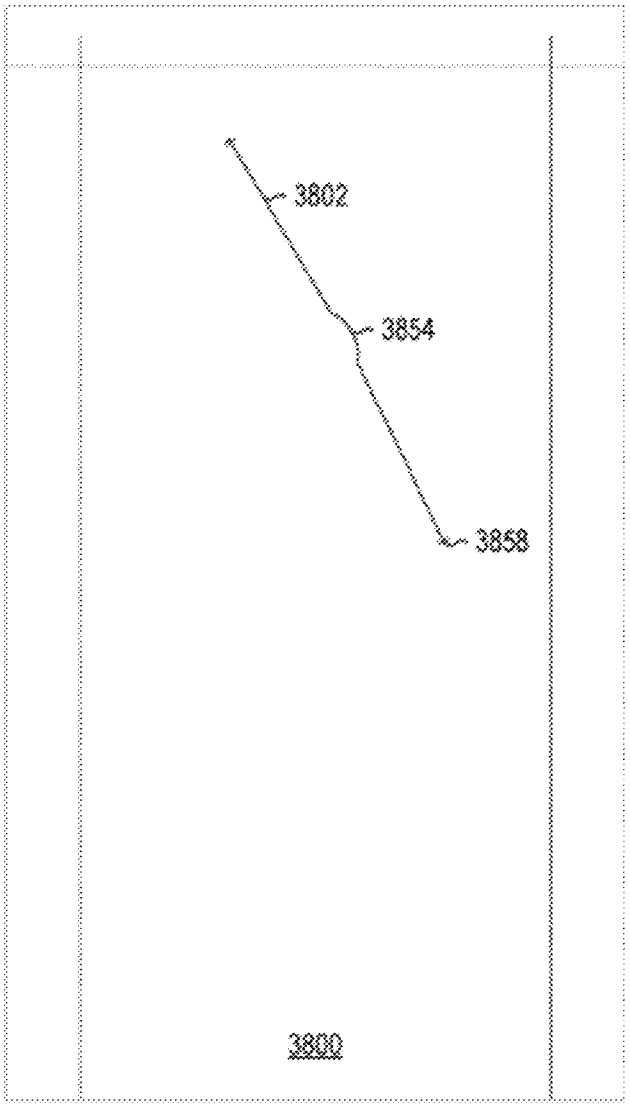
FIG. 37 is a depiction of a bag with an easy open feature that is oriented vertically.
FIG. 38 is a depiction of a bag with an easy open feature that is oriented diagonally.

In FIG. 37*a* view of a bag 3750 with an easy open feature 3752 is shown. As shown, easy open feature 3752 is intended to represent a weakened line, such as at least one cut or perforation, as discussed previously, that includes a curved portion 3754 centrally located that may function as a tab for opening bag 3750. By pressing on curved portion 3754, a preferential tear may occur at easy open feature 3752 to enable opening of bag 3750. Easy open feature 3752 also includes end curves 3758 at each respective end that enable the opening to form small flaps and prevent tearing while the contents of bag 3750 are poured out. Accordingly, easy open feature 3752 may be used with or without a sealing tape that covers easy open feature 3752. It is further noted that a depth of easy open feature 3752 may vary in different embodiments. For example, easy open feature 3752 may include cuts, including perforations, that penetrate all layers of bag 3750, in some embodiments. In various embodiments, easy open feature 3752 may include cuts or perforations through or partially through selected one or more layers of bag 3750, but without cuts or perforations in at least one layer of bag 3750, for example. In other embodiments, various types of weakening methods may be used to form easy open feature 3752, such as, but not limited to, at least one of heat, pressure, punctual force, and cutting (including perforating). Easy open feature 3752 is shown oriented substantially vertically with respect to bag 3750 in FIG. 37, as indicated by arrow 3756, which points upward in the vertical direction with respect to bag 3750. Although shown vertically oriented, easy open feature 3752 may also be oriented within an angular range of about 80° to 100° with respect to the top edge or the bottom edge of bag 3750.

Similarly, a bag 3800 shown in FIG. 38 includes an easy open feature 3802. As shown, easy open feature 3802 is intended to represent a weakened line, such as a cut or a perforation, as discussed previously, that includes a curved portion 3854 centrally located that may function as a tab for opening bag 3800, as well as end curves 3858. Easy open feature 3802 is substantially similar to easy open feature 3752 in FIG. 37, but easy open feature 3802 is oriented diagonally with respect to bag 3800 in FIG. 38. It is noted that bag 3800 in FIG. 38 is shown alongside bag 3750 in FIG. 37 in the same orientation with respect to arrow 3754. As shown, easy open feature 3802 is oriented at about a 45° angle with respect to the top edge (or the bottom edge) of bag 3800. Easy open feature 3802 can be oriented within an angular range of about 30° to 60° with respect to the top edge or the bottom edge and still be diagonally oriented.

Figure 39:
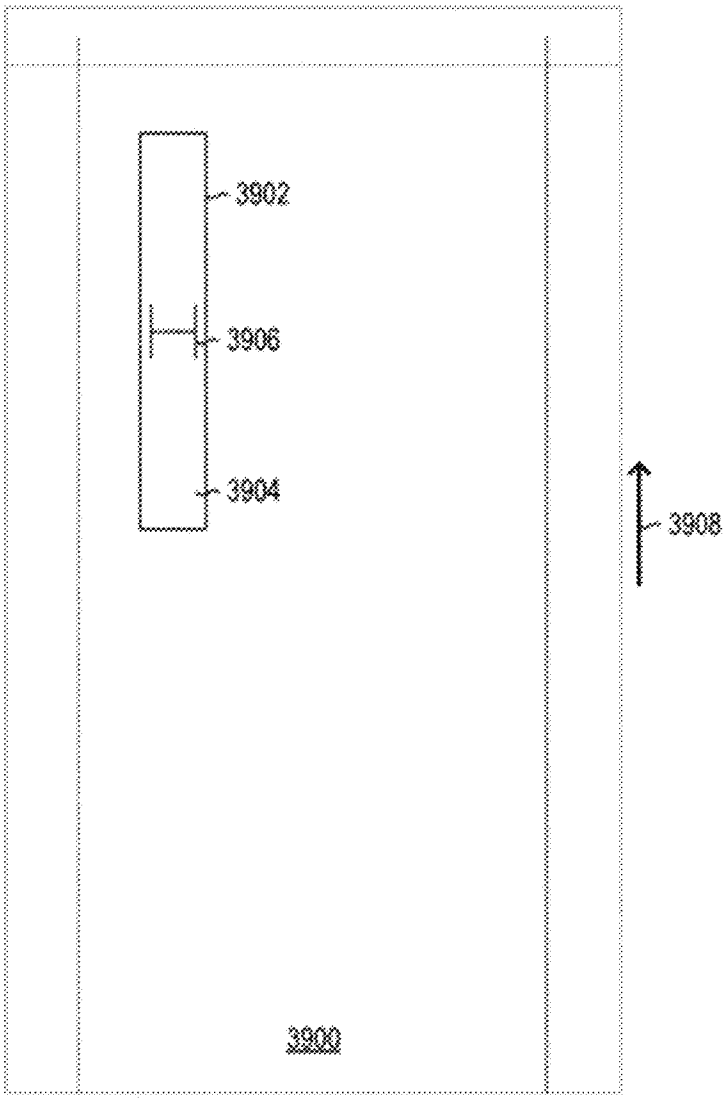
FIG. 39 is a depiction of a bag with an easy open feature that is oriented vertically.

In FIG. 39*a* view of a bag 3900 with an easy open feature 3902 is shown. As shown, easy open feature 3902 is intended to represent a portion of tape 3904 that covers a cut or opening (not visible) made into the bag wall of bag 3900. Within tape 3904, an H-shaped weakened line 3906, such as a cut or a perforation, as discussed previously, is centrally located and may function as a tab for opening tape 3904. By pressing on H-shaped weakened line 3906, tape 3904 may be released by puncturing the cut or perforation, and may enable tape 3904 to be at least partially pulled to enable opening of bag 3900. In other embodiments, various types of weakening methods may be used to form H-shaped weakened line 3906 in easy open feature 3902, such as, but not limited to, at least one of heat, pressure, force, and cutting (including perforating). Easy open feature 3902 is shown oriented substantially vertically with respect to bag 3900 in FIG. 39, as indicated by arrow 3908, which points upward in the vertical direction with respect to bag 3900. Although shown vertically oriented, easy open feature 3902 may also be oriented within an angular range of about 80° to 100° with respect to the top edge or the bottom edge of bag 3900.

Figure 40:
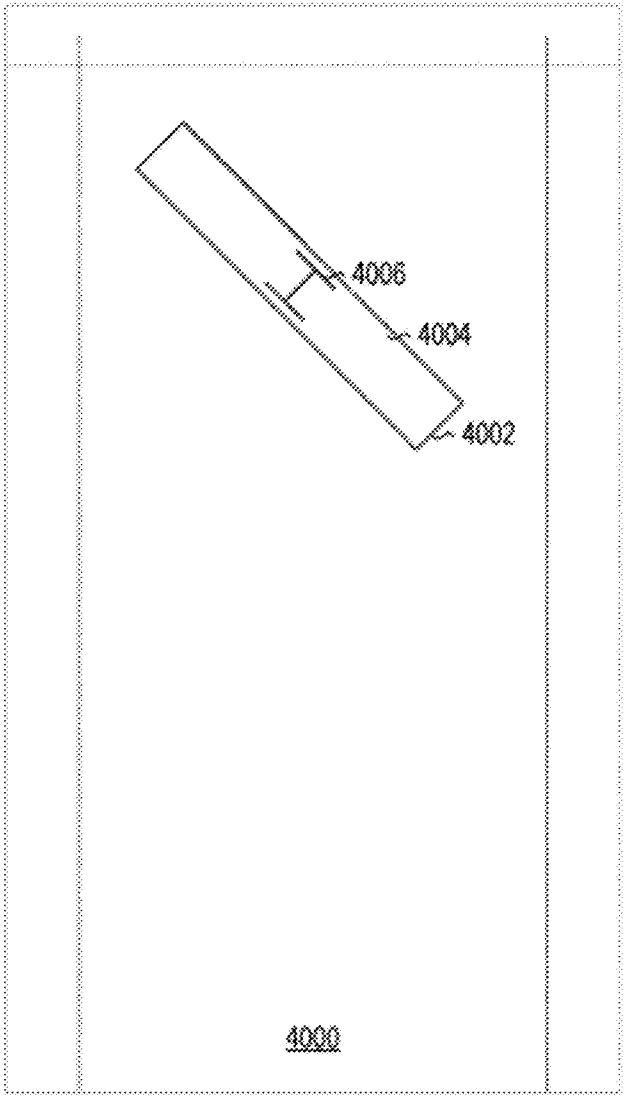
FIG. 40 is a depiction of a bag with an easy open feature that is oriented diagonally.

Similarly, a bag 4000 shown in FIG. 40 includes an easy open feature 4002. As shown, easy open feature 4002 that is substantially similar to easy open feature 3902 in FIG. 39. Accordingly, easy open feature 4002 includes a portion of tape 4004 and an H-shaped weakened line 4006, such as a cut or a perforation, as discussed previously. Easy open feature 4002 is substantially similar to easy open feature 3902 in FIG. 39, but easy open feature 4002 is oriented diagonally with respect to bag 4000 in FIG. 40. It is noted that bag 4000 in FIG. 40 is shown alongside bag 3900 in FIG. 39 in the same orientation with respect to arrow 3908. As shown, easy open feature 3902 is oriented at about a 45° angle with respect to the top edge (or the bottom edge) of bag 3900. Easy open feature 3902 can be oriented within an angular range of about 30° to 60° with respect to the top edge or the bottom edge and still be diagonally oriented.

Figure 41:
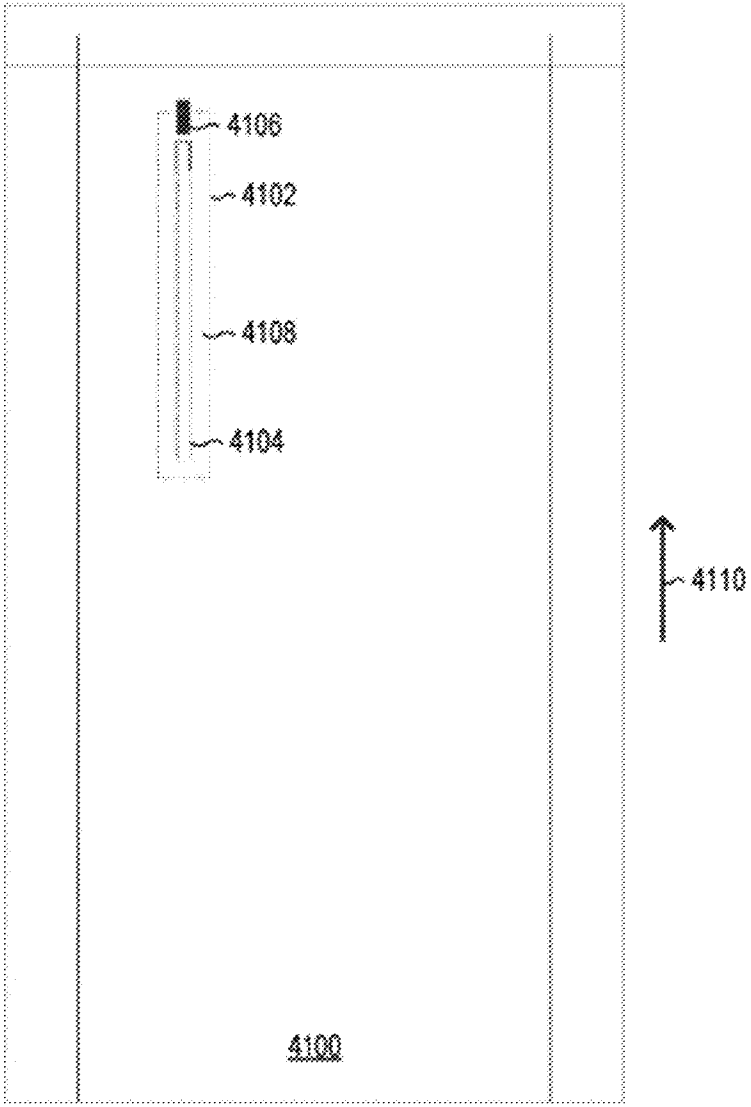
FIG. 41 is a depiction of a bag with an easy open feature that is oriented vertically.

In FIG. 41*a* view of a bag 4100 with an easy open feature 4102 is shown. As shown, easy open feature 4102 is intended to represent a portion of tape 4108 that covers an opening 4104 formed into the bag wall of bag 4100. Along with tape 4108 is a release tab 4106 that may function as a tab for releasing tape 4108 in order to expose opening 4104 to open bag 4100. Opening 4104 is shown as a cut entirely through the wall of bag 4100 in a rectangular shape. It is noted that various shapes may be used for opening 4104 in different embodiments. Release tab 4106 may be attached to at least one side of tape 4108 and may accordingly enable tape 4108 to be at least partially pulled to enable opening of bag 4100. In other embodiments, various types of release tabs 4106 or tape releasing features may be included in easy open feature 4102. It is noted that a force used to pull release tab 4106 may be lower than a force used to open a seal of the walls of bag 4100, such as seals formed at the ends of bag 4100 upon filling and sealing bag 4100. Easy open feature 4102 is shown oriented substantially vertically with respect to bag 4100 in FIG. 41, as indicated by arrow 4110, which points upward in the vertical direction with respect to bag 4100. Although shown vertically oriented, easy open feature 4102 may also be oriented within an angular range of about 80° to 100° with respect to the top edge or the bottom edge of bag 4100.

Figure 42:
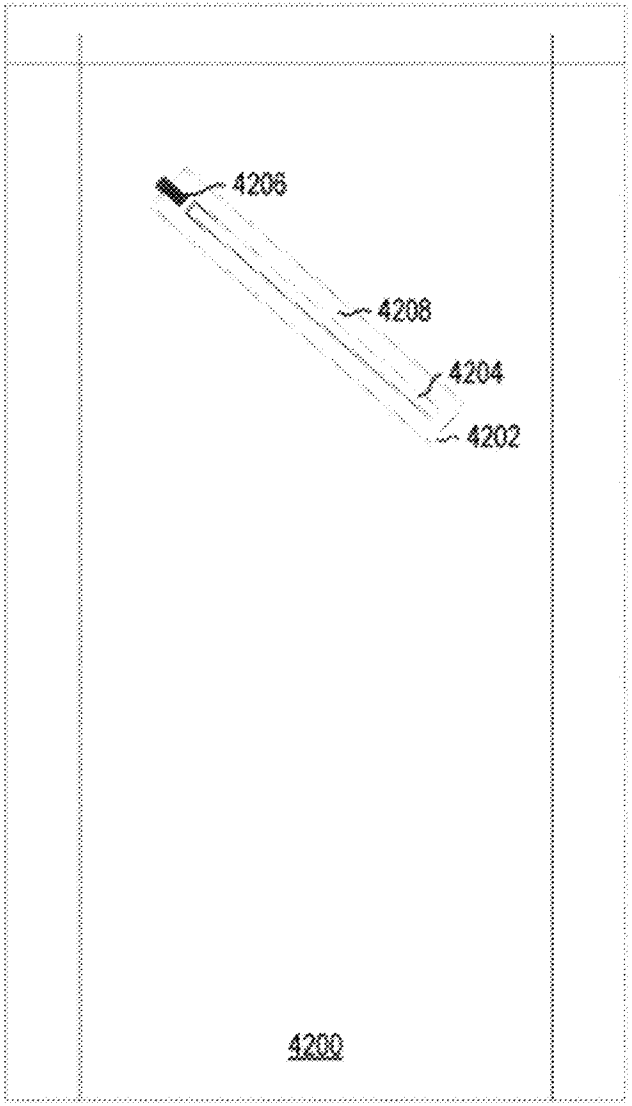
FIG. 42 is a depiction of a bag with an easy open feature that is oriented diagonally.

Similarly, a bag 4200 shown in FIG. 42 includes an easy open feature 4202. As shown, easy open feature 4202 that is substantially similar to easy open feature 4102 in FIG. 41. Accordingly, easy open feature 4202 includes a portion of tape 4208 that covers an opening 4204 and a release tab 4206, as discussed above. Easy open feature 4202 is substantially similar to easy open feature 4102 in FIG. 41, but easy open feature 4202 is oriented diagonally with respect to bag 4200 in FIG. 42. It is noted that bag 4100 in FIG. 41 is shown alongside bag 4200 in FIG. 42 in the same orientation with respect to arrow 4110. As shown, easy open feature 4202 is oriented at about a 45° angle with respect to the top edge (or the bottom edge) of bag 4200. Easy open feature 4202 can be oriented within an angular range of about 30° to 60° with respect to the top edge or the bottom edge and still be diagonally oriented.

Figure 43:
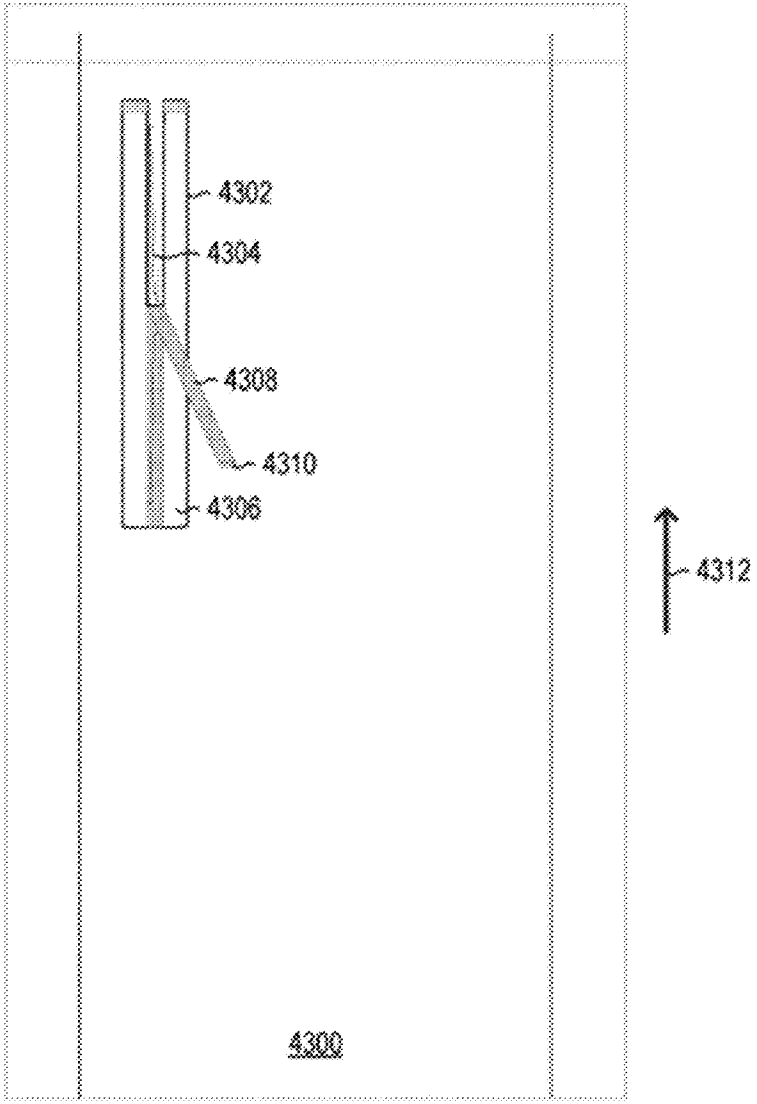
FIG. 43 is a depiction of a bag with an easy open feature that is oriented vertically.

In FIG. 43*a* view of a bag 4300 with an easy open feature 4302 is shown. As shown, easy open feature 4302 includes a cover on the exterior surface of bag 4300 over a plurality of cuts, such as perforations. The cover may be a tape 4306 that covers a weakened line 4304 formed into the bag wall of bag 4300. Weakened line 4304, such as a cut or a perforation, as discussed previously, may be substantially similar to weakened line 3752 discussed above with respect to FIG. 37. By pressing on weakened line 4304, or by pulling on a tab 4310 of a release strip 4308, a preferential tear may occur at easy open feature 4302 to enable opening of bag 4300. Tape 4306 may include release strip 4308 that preferentially separates from the remaining portions of tape 4306 and is centrally oriented to cover weakened line 4304. For example, release strip 4308 may have tab 4310 to enable removal of release strip 4308 from tape 4306 to expose weakened line 4304 that may be used to open bag 4300. After removal, release strip 4308 may be discarded. It is further noted that a depth of weakened line 4304 may vary in different embodiments. For example, weakened line 4304 may include cuts, including perforations, that penetrate all layers of bag 4300, in some embodiments. In various embodiments, weakened line 4304 may include cuts or perforations through or partially through selected one or more layers of bag 4300, but without cuts or perforations in at least one layer of bag 4300, for example. In other embodiments, various types of weakening methods may be used to form weakened line 4304, such as, but not limited to, at least one of heat, pressure, force, and cutting (including perforating). In other embodiments, various types of release tabs or tape releasing features may be included in easy open feature 4302. It is noted that a force used to pull release strip 4304 may be lower than a force used to open a seal of the walls of bag 4300, such as seals formed at the ends of bag 4300 upon filling and sealing bag 4300. Easy open feature 4302 is shown oriented substantially vertically with respect to bag 4300 in FIG. 43, as indicated by arrow 4312, which points upward in the vertical direction with respect to bag 4300. Although shown vertically oriented, easy open feature 4302 may also be oriented within an angular range of about 80° to 100° with respect to the top edge or the bottom edge of bag 4300.

Figure 44:
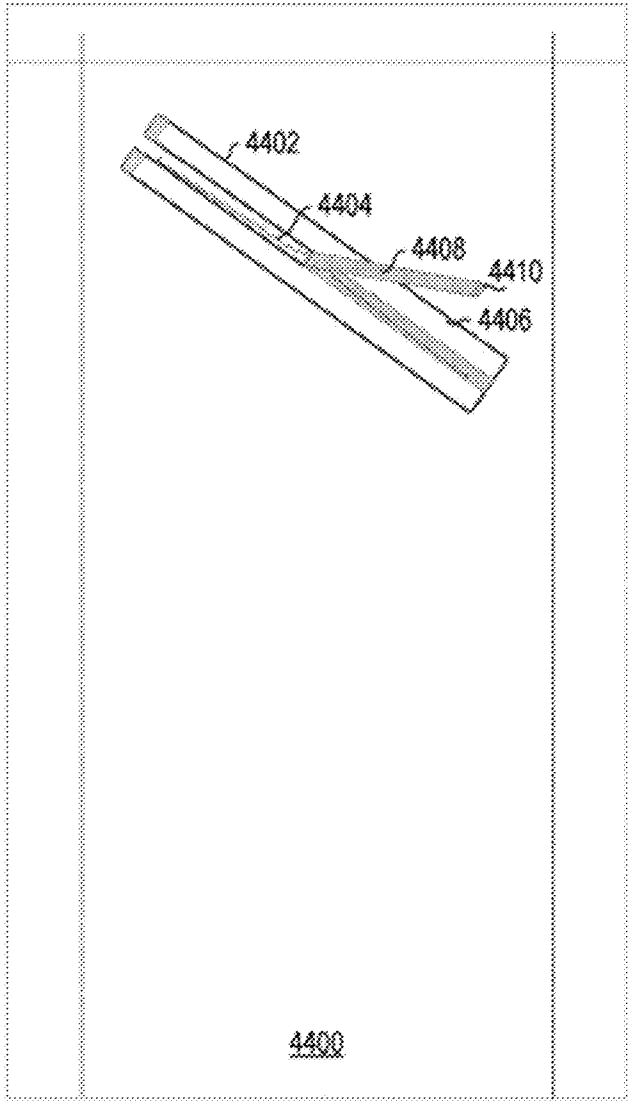
FIG. 44 is a depiction of a bag with an easy open feature that is oriented diagonally.

Similarly, a bag 4400 shown in FIG. 44 includes an easy open feature 4402. As shown, easy open feature 4402 that is substantially similar to easy open feature 4302 in FIG. 43. Accordingly, easy open feature 4402 includes a portion of tape 4406 that covers an opening 4404 and a release strip 4408 having a tab 4410, as discussed above. Easy open feature 4402 is substantially similar to easy open feature 4302 in FIG. 43, but easy open feature 4402 is oriented diagonally with respect to bag 4400 in FIG. 44. It is noted that bag 4400 in FIG. 44 is shown alongside bag 4300 in FIG. 43 in the same orientation with respect to arrow 4312. As shown, easy open feature 4402 is oriented at about a 45° angle with respect to the top edge (or the bottom edge) of bag 4400. Easy open feature 4402 can be oriented within an angular range of about 30° to 60° with respect to the top edge or the bottom edge and still be diagonally oriented.

Figure 45:
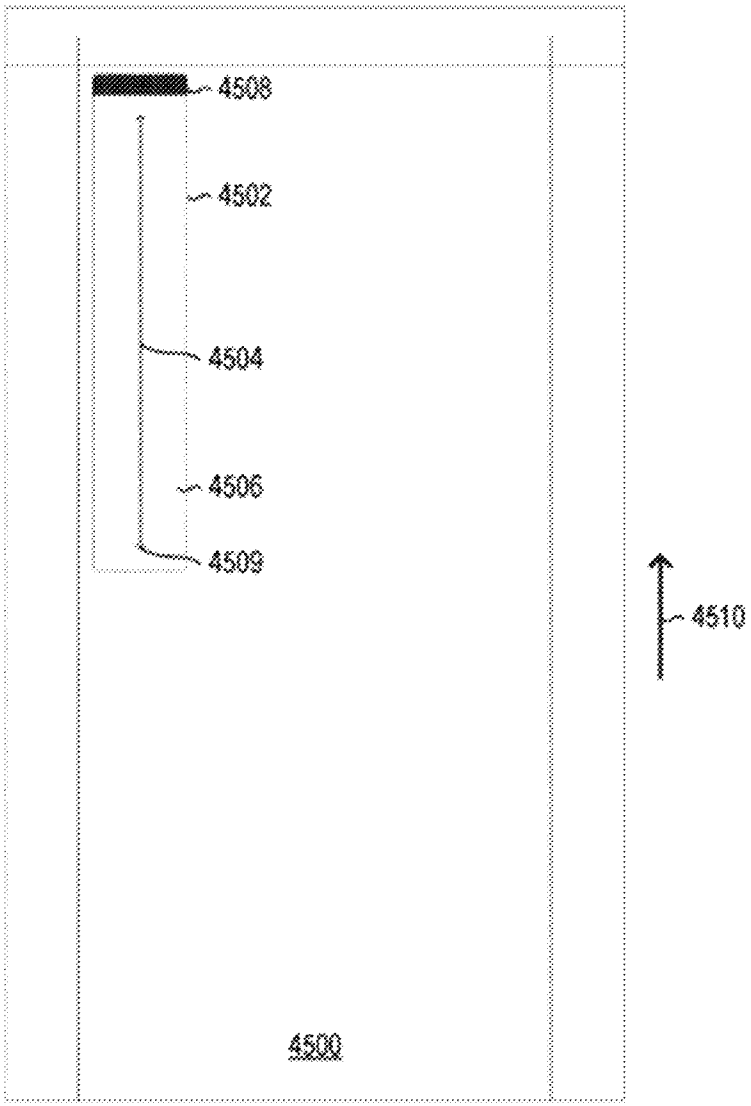
FIG. 45 is a depiction of a bag with an easy open feature that is oriented vertically.

In FIG. 45*a* view of a bag 4500 with an easy open feature 4502 is shown. As shown, easy open feature 4502 is intended to represent a portion of tape 4506 that covers a weakened line 4504 formed into the bag wall of bag 4500. Weakened line 4504, such as a cut or a perforation, as discussed previously, may be similar to weakened line 3752 discussed above with respect to FIG. 37. As shown, weakened line 4504 is a straight line without a tab formed therein. Easy open feature 4502 also includes end curves 4509 at each respective end of weakened line 4504 that enable the opening to form small flaps and prevent tearing while the contents of bag 4500 are poured out. In some implementations, weakened line 4504 may be weakened further than weakened line 3752 and may open relatively easily once tape 4506 is removed. After removing tape 4506 and then by pressing on weakened line 4504, a preferential tear may occur at easy open feature 4502 to enable opening of bag 4500. Additionally, tape 4506 may include a tab 4508 to enable removal of tape 4506 to expose weakened line 4504 that may be used to open bag 4500. After removal, tape 4506 may be discarded. In some embodiments, tape 4506 may be resealable or may be reattached to cover and at least partially seal the opening at weakened line 4504. It is further noted that a depth of weakened line 4504 may vary in different embodiments. For example, weakened line 4504 may include cuts, including perforations, that penetrate all layers of bag 4500, in some embodiments. In various embodiments, weakened line 4504 may include cuts or perforations through or partially through selected one or more layers of bag 4500, but without cuts or perforations in at least one layer of bag 4500, for example. In other embodiments, various types of weakening methods may be used to form weakened line 4504, such as, but not limited to, at least one of heat, pressure, force, and cutting (including perforating). In other embodiments, various types of release tabs or tape releasing features may be included in easy open feature 4502. It is noted that a force used to pull tape 4504 may be lower than a force used to open a seal of the walls of bag 4500, such as seals formed at the ends of bag 4500 upon filling and sealing bag 4500. Easy open feature 4502 is shown oriented substantially vertically with respect to bag 4500 in FIG. 45, as indicated by arrow 4510, which points upward in the vertical direction with respect to bag 4500. Although shown vertically oriented, easy open feature 4502 may also be oriented within an angular range of about 80° to 100° with respect to the top edge or the bottom edge of bag 4500.

Figure 46:
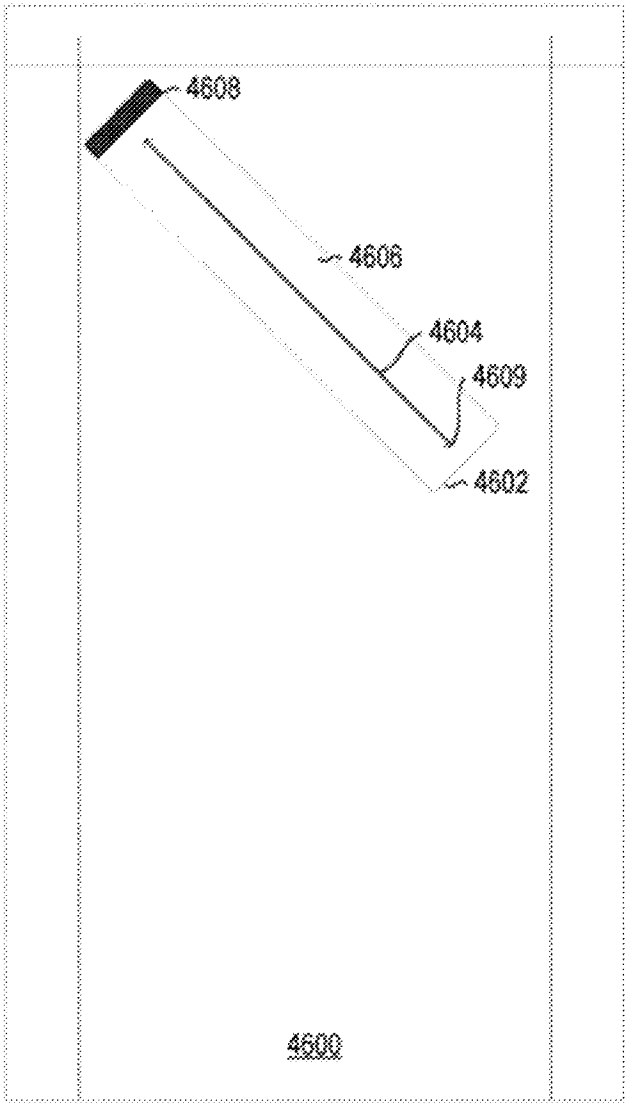
FIG. 46 is a depiction of a bag with an easy open feature that is oriented diagonally.

Similarly, a bag 4600 shown in FIG. 46 includes an easy open feature 4602. As shown, easy open feature 4602 that is substantially similar to easy open feature 4502 in FIG. 45. Accordingly, easy open feature 4602 includes a portion of tape 4606 having a tab 4608 that covers a weakened line 4604, as discussed above, as well as end curves 4609. Easy open feature 4602 is substantially similar to easy open feature 4502 in FIG. 45, but easy open feature 4602 is oriented diagonally with respect to bag 4600 in FIG. 46. It is noted that bag 4600 in FIG. 46 is shown alongside bag 4500 in FIG. 45 in the same orientation with respect to arrow 4510. As shown, easy open feature 4602 is oriented at about a 45° angle with respect to the top edge (or the bottom edge) of bag 4600. Easy open feature 4602 can be oriented within an angular range of about 30° to 60° with respect to the top edge or the bottom edge and still be diagonally oriented.

Figure 47:
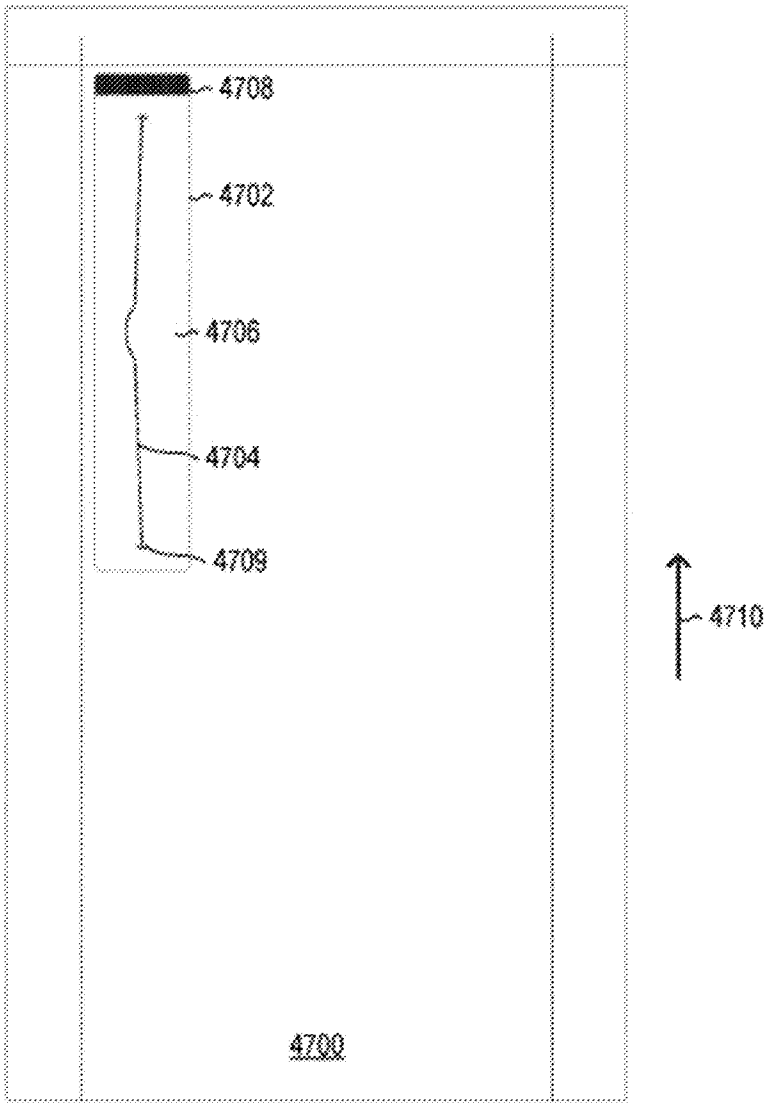
FIG. 47 is a depiction of a bag with an easy open feature that is oriented vertically.

In FIG. 47*a* view of a bag 4700 with an easy open feature 4702 is shown. As shown, easy open feature 4702 is intended to represent a portion of tape 4706 that covers a weakened line 4704 formed into the bag wall of bag 4700. Weakened line 4704, such as a cut or a perforation, as discussed previously, may be substantially similar to weakened line 3752 discussed above with respect to FIG. 37. Easy open feature 4702 also includes end curves 4709 at each respective end of weakened line 4704 that enable the opening to form small flaps and prevent tearing while the contents of bag 4700 are poured out. In some implementations, weakened line 4704 may be weakened further than weakened line 3752 and may open relatively easily once tape 4706 is removed. After removing tape 4706 and then by pressing on weakened line 4704, a preferential tear may occur at easy open feature 4702 to enable opening of bag 4700. Additionally, tape 4706 may include a tab 4708 to enable removal of tape 4706 to expose weakened line 4704 that may be used to open bag 4700. After removal, tape 4706 may be discarded. In some embodiments, tape 4706 may be resealable or may be reattached to cover and at least partially seal the opening at weakened line 4704. It is further noted that a depth of weakened line 4704 may vary in different embodiments. For example, weakened line 4704 may include cuts, including perforations, that penetrate all layers of bag 4700, in some embodiments. In various embodiments, weakened line 4704 may include cuts or perforations through or partially through selected one or more layers of bag 4700, but without cuts or perforations in at least one layer of bag 4700, for example. In other embodiments, various types of weakening methods may be used to form weakened line 4704, such as, but not limited to, at least one of heat, pressure, force, and cutting (including perforating). In other embodiments, various types of release tabs or tape releasing features may be included in easy open feature 4702. It is noted that a force used to pull tape 4704 may be lower than a force used to open a seal of the walls of bag 4700, such as seals formed at the ends of bag 4700 upon filling and sealing bag 4700. Easy open feature 4702 is shown oriented substantially vertically with respect to bag 4700 in FIG. 47, as indicated by arrow 4710, which points upward in the vertical direction with respect to bag 4700. Although shown vertically oriented, easy open feature 4702 may also be oriented within an angular range of about 80° to 100° with respect to the top edge or the bottom edge of bag 4700.

Figure 48:
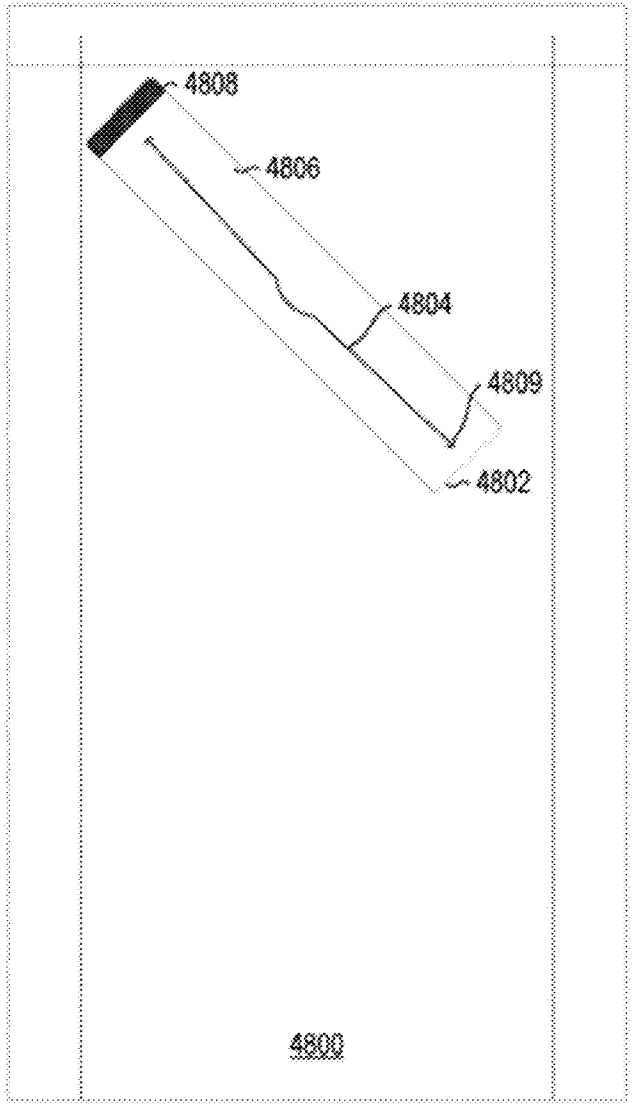
FIG. 48 is a depiction of a bag with an easy open feature that is oriented diagonally.

Similarly, a bag 4800 shown in FIG. 48 includes an easy open feature 4802. As shown, easy open feature 4802 that is substantially similar to easy open feature 4502 in FIG. 45, but is shaped according to easy open feature 3752, discussed above with respect to FIG. 37. Accordingly, easy open feature 4802 includes a portion of tape 4806 having a tab 4808 that covers a weakened line 4804, as discussed above, as well as end curves 4809. Easy open feature 4802 is substantially similar to easy open feature 4702 in FIG. 47, but easy open feature 4802 is oriented diagonally with respect to bag 4800 in FIG. 48. It is noted that bag 4800 in FIG. 48 is shown alongside bag 4700 in FIG. 47 in the same orientation with respect to arrow 4710. As shown, easy open feature 4802 is oriented at about a 45° angle with respect to the top edge (or the bottom edge) of bag 4800. Easy open feature 4802 can be oriented within an angular range of about 30° to 60° with respect to the top edge or the bottom edge and still be diagonally oriented.

Figure 49:
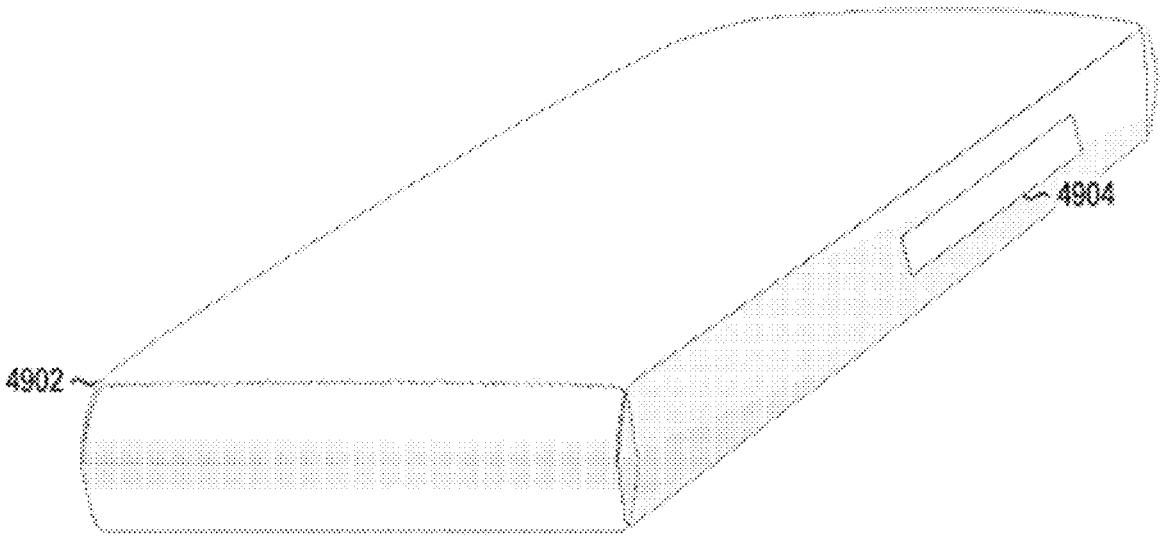
FIG. 49 is a depiction of a bag with an easy open feature that is oriented vertically.

Referring now to FIG. 49, a bag 4902 is shown with an easy open feature 4904. Easy open feature 4904 is shown as a generic feature that may be any of the features depicted with respect to FIGS. 38 through 47. As shown, easy open feature 4904 is located at a side wall of bag 4902 and is vertically oriented. Although shown vertically oriented, easy open feature 4904 may also be oriented within an angular range of about 80° to 100° with respect to the top edge or the bottom edge of bag 4900. Although the easy open feature 4904 as shown in FIG. 49 indicates a tape covering one or more cuts or perforations through or partially through one or more of the bag wall layers of the bag side wall, it should be noted that such cuts and/or perforations (such as those described above) can be provided with or without a tape covering.

Figure 50:
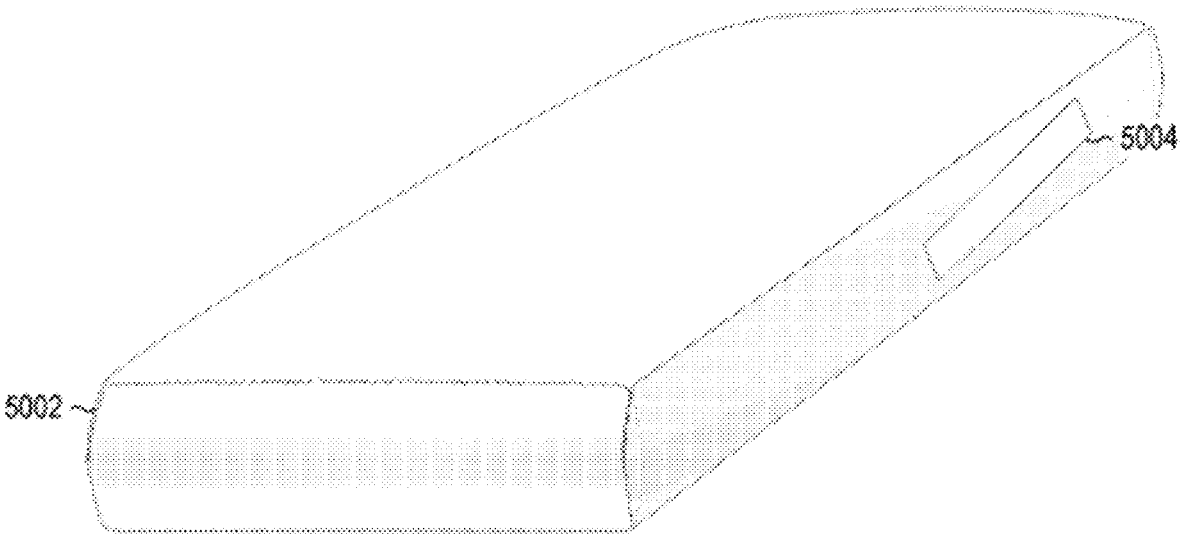
FIG. 50 is a depiction of a bag with an easy open feature that is oriented diagonally.

Referring now to FIG. 50, a bag 5002 is shown with an easy open feature 5004. Easy open feature 5004 is shown as a generic feature that may be any of the features depicted with respect to FIGS. 38 through 47. As shown, easy open feature 5004 is located at a side wall of bag 5002 and is diagonally oriented. Easy open feature 5004 can be oriented within an angular range of about 30° to 60° with respect to the top edge or the bottom edge of bag 5002 and still be diagonally oriented. Although the easy open feature 5004 as shown in FIG. 50 indicates a tape covering one or more cuts or perforations through or partially through one or more of the bag wall layers of the bag side wall, it should be noted that such cuts and/or perforations (such as those described above) can be provided with or without a tape covering.

In one particular example of a bag which is from 2.0 to 20.0 inches in width with a peelable, easy open feature like that shown and described herein, the bag walls may comprise or consist of two or more layers, including a first layer comprising woven strips of oriented polyethylene, polyester, or polypropylene and a second layer comprising a film layer comprising oriented polyethylene, polyester, or polypropylene. The second layer may be laminated to the first layer, such as without an adhesive, and may be laminated to the first layer by a third layer comprising a film layer comprising polyethylene, polyester, or polypropylene. The first, second and third layers may all comprise the same material, and may be polyethylene, polyester, and polypropylene, or a combination thereof. The top end of the back wall may extend 0.25 to 6.0 inches or so beyond the top end of the front bag wall. A polyamide ink, urethane ink, nitrocellulose ink, or combination thereof, may be applied to the exterior or interior surface of the front bag wall in an area extending across the width of the front bag wall and from the top end of the front wall to 0.25 to 6.0 inches below the top end of the bag wall. The top end of the back wall may be folded over the top end of the front wall and a portion of the interior surface of the back wall may be placed into contact with a portion of the exterior surface of the front wall to form an overlaying portion of the front and back walls. The overlaying portion may extend lengthwise across the width of the bag wall and may be from 2.0 to 20.0 inches in width. The overlaying portion may be sealed by passing it by a nozzle blowing heated air at a temperature of from 360 F. to 1800 F. or so, at a speed of about 20 to 3,000 inches per minute, to form a seal at the top end of the bag. In addition, an unsealed flap of about 0.125 to 2.0 inches or so in width may extend lengthwise across the width of the bag, wherein the flap is formed from the portion of the top end of the back wall that is not scaled to the front wall of the bag. It has been observed that such a bag is adapted to hold anywhere from 1.5 pounds, ten pounds, twenty pounds, thirty pounds, forty pounds, fifty pounds, sixty pounds, to seventy pounds of a filling material once filled, and provides a strong, durable seal that is rugged and can hold such contents without the risk of spilling or contamination, yet can be easily opened by a consumer without a knife or scissors by pulling the tab upwards and/or outwardly from the front wall of the bag. In this particular example, the bag's second layer may comprise printing and/or graphics on at least one side, which may be done with reverse printing or surface printing, and the ink coating may be applied to the second bag layer (e.g., the film layer) on the second layer's printed side. The ink coating may be applied to the film layer after the film layer has had the printing and/or graphics printed thereon.

Those skilled in the art will understand and appreciate that the bag according to the invention may vary in size, dimensions, and shape without departing from the scope of the invention, and that the foregoing description of the preferred embodiments is not intended to limit the scope of the invention as defined by the claims. For example, those skilled in the art will understand and appreciate that the bags shown and described in the various embodiments can have sealed and sewn ends in a tubular bag with side gussets as shown, or a block bottom and top, or a combination thereof, although not shown. Those skilled in the art will also appreciate that a weakened portion or area can be provided in a number of ways that may vary from those expressly described and shown, such as by stressing portions of the bag wall with or without deforming or perforating same, as well as varying the size, number, depth, and/or pattern of perforations and/or deformations in a bag wall. Similarly, those skilled in the art will understand that the bags shown and described in the various embodiments may be provided with a re-usable opening (not shown). Such features are conventional with prior art bags. Similarly, those skilled in the art will appreciate that terms such as "front" and "rear," and "top" and "bottom," are useful in describing a bag, but essentially depend on a bag's orientation when such terms are used, and are therefore not limiting as to a bag's orientation. Similarly, those skilled in the art will appreciate that the material compositions may consist essentially of any combination described herein, with the term "consisting essentially of" may include impurities and limited amounts of other items or materials that do not interfere with properties of the bags described herein, interfere with the easy-open capability, or interfere with the recyclability of the product.

What is claimed is:

1. A bag comprising:

a front wall comprising a top end and a bottom end;

a back wall comprising a top end and a bottom end, a first side wall, and a second side wall disposed on opposite sides of the front wall and the back wall and connecting the front wall to the back wall, forming a bag with a top end and a bottom end, each of the first side wall and the second side wall comprising a gusset with a central fold line extending from the bottom end to the top end of the respective side walls and dividing each of said first side wall and said second side wall into a front side wall and a back side wall;

wherein each of the front wall, back wall, first side wall and second side wall comprise (i) a first layer comprising a woven polymer and (ii) a second layer laminated to the first layer, said second layer comprising a polymer film; and wherein at least one of said top end or bottom end of the bag comprises a step cut configuration along each of the first side wall and the second side wall and the step cut configuration of each of the first side wall and the second side wall comprises a first step cut adjacent the front wall, a second step cut adjacent the back wall, and a third step cut positioned between the first step cut and the second step cut, wherein the step cut configuration of each of the first side wall and the second side wall comprise at least one of:

a curved cut or an angled cut; and wherein one of the first step cut, the second step cut, or the third step cut has a first height and one of the remaining two step cuts has a second height, the first height different from the second height.

2. The bag of claim 1, wherein the step cut configuration of the first side wall comprises an angled cut and the step cut configuration of the second side wall comprises a curved cut.

3. The bag of claim 1, wherein the step cut configuration of the first side wall comprises the angled cut for the first step cut, the second step cut, and the third step cut and wherein an angle of the first step cut differs from at least one of an angle of the second step cut or the third step cut.

4. The bag of claim 1, wherein the curved cut is at a top edge of at least one of the first step cut, the second step cut, or the third step cut.

5. The bag of claim 1, wherein the curved cut is at a bottom edge of at least one of the first step cut, the second step cut, or the third step cut.

6. The bag of claim 1, wherein the angled cut is at a top edge of at least one of the first step cut, the second step cut, or the third step cut.

7. The bag of claim 1, wherein the angled cut is at a bottom edge of at least one of the first step cut, the second step cut, or the third step cut.

8. The bag of claim 1, wherein a first curved cut of the step cut configuration has a first radius and a second curved cut of the step cut configuration has a second radius, the second radius different from the first radius.

9. The bag of claim 1, wherein a first angled cut of the step cut configuration has a first angle and a second angled cut of the step cut configuration has a second angle, the second angle different from the first angle.

10. The bag of claim 1, wherein the step cut configuration comprises the curved cut and the angled cut.

11. The bag of claim 1, wherein the bag comprises an easy open or easy access feature.

12. The bag of claim 11, wherein the easy open or easy access feature comprises a weakened area.

13. The bag of claim 1, wherein the first layer comprises polypropylene, high density polyethylene, low density polyethylene, polyester, or any combination thereof.

14. The bag of claim 1, wherein the second layer comprises polypropylene, polyethylene, polyethylene terephthalate, polyamide, or a combination thereof or paper.

15. A bag comprising:

a front wall comprising a top end and a bottom end, a back wall comprising a top end and a bottom end, and a first side wall, and a second side wall disposed on opposite sides of the front wall and back wall and connecting the front wall to the back wall, forming a bag with a top end and a bottom end, each of the first side wall and the second side wall comprising a gusset with a central fold line extending from the bottom end to the top end of the respective side walls and dividing each of said first side wall and said second side wall into a front side wall and a back side wall;

wherein each of the front wall, back wall, first side wall and second side wall comprise (i) a first layer comprising a woven polymer and (ii) a second layer laminated to the first layer, said second layer comprising a polymer film;

wherein at least one of said top end or bottom end of the bag comprises a step cut configuration, the step cut configuration comprising a first curved cut, a second curved cut, a first angled cut, and a second angled cut; and wherein a first radius of the first curved cut differs from a second radius of the second curved cut.

16. The bag of claim 15, wherein a first angle of the first angled cut differs from a second angle of the second angled cut.

17. The bag of claim 15, wherein the first curved cut and the first angled cut are adjacent the first side wall.

18. The bag of claim 15, wherein the first curved cut and the second curved cut are adjacent the first side wall.

19. The bag of claim 15, wherein the first angled cut and the second angled cut are adjacent the first side wall.

20. The bag of claim 15, wherein the step cut configuration comprises six step cuts with three step cuts of the six step cuts adjacent each of the first side wall and the second side wall.

21. The bag of claim 20, wherein a first step cut of the three step cuts has a first height and a second step cut of the three step cuts has a second height, the first height different from the second height.

22. The bag of claim 15, wherein the bag comprises an easy open or easy access feature.

23. The bag of claim 22, wherein the easy open or easy access feature comprises a weakened area.

24. A bag comprising: a front wall comprising a top end and a bottom end, a back wall comprising a top end and a bottom end, and a first side wall, and a second side wall disposed on opposite sides of the front wall and back wall and connecting the front wall to the back wall, forming a bag with a top end and a bottom end, each of the first side wall and the second side wall comprising a gusset with a central fold line extending from the bottom end to the top end of the respective side walls and dividing each of said first side wall and said second side wall into a front side wall and a back side wall;

wherein each of the front wall, back wall, first side wall and second side wall comprise (i) a first layer comprising a woven polymer and (ii) a second layer laminated to the first layer, said second layer comprising a polymer film;

wherein at least one of said top end or bottom end of the bag comprises a step cut configuration, the step cut configuration comprising a first curved cut, a second curved cut, a first angled cut, and a second angled cut, the first angled cut and the second angled cut at an angle of between about 15° and about 75° with respect to the top end of the front wall; and wherein a first angle of the first angled cut differs from a second angle of the second angled cut.

25. The bag of claim 24, wherein a first radius of the first curved cut differs from a second radius of the second curved cut.

26. The bag of claim 24, wherein the first curved cut and the first angled cut are adjacent the first side wall.

27. The bag of claim 24, wherein the first curved cut and the second curved cut are adjacent the first side wall.

28. The bag of claim 24, wherein the first angled cut and the second angled cut are adjacent the first side wall.

29. The bag of claim 24, wherein the step cut configuration comprises six step cuts with three step cuts of the six step cuts adjacent each of the first side wall and the second side wall.

30. The bag of claim 29, wherein a first step cut of the three step cuts has a first height and a second step cut of the three step cuts has a second height, the first height different from the second height.

31. The bag of claim 24, wherein the bag comprises an easy open or easy access feature comprising a weakened area.

* * * * *